US008807723B2

(12) United States Patent
Aoki et al.

(10) Patent No.: US 8,807,723 B2
(45) Date of Patent: Aug. 19, 2014

(54) PRINTING MATERIAL HOLDING CONTAINER

(71) Applicant: Seiko Epson Corporation, Tokyo (JP)

(72) Inventors: Yuji Aoki, Nagano (JP); Masahiro Karasawa, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/897,932

(22) Filed: May 20, 2013

(65) Prior Publication Data

US 2013/0307908 A1 Nov. 21, 2013

(30) Foreign Application Priority Data

May 21, 2012 (JP) ..... 2012-115536

(51) Int. Cl.
*B41J 2/175* (2006.01)

(52) U.S. Cl.
USPC ..... 347/86

(58) Field of Classification Search
USPC ..... 347/7, 84, 85, 86, 87, 49
See application file for complete search history.

(56) References Cited

U.S. PATENT DOCUMENTS

| | | | | |
|---|---|---|---|---|
| 5,604,523 | A * | 2/1997 | Tsukuda et al. | 347/86 |
| 7,404,628 | B2 * | 7/2008 | Naka et al. | 347/86 |
| 8,061,827 | B2 * | 11/2011 | Iino | 347/86 |
| 8,182,077 | B2 * | 5/2012 | Kanbe et al. | 347/86 |
| 2012/0200646 | A1 | 8/2012 | Karasawa et al. | |
| 2012/0212526 | A1 | 8/2012 | Karasawa et al. | |

FOREIGN PATENT DOCUMENTS

| | | | |
|---|---|---|---|
| JP | 2007-136807 | A | 6/2007 |
| JP | 2012-144037 | A | 8/2012 |
| WO | 2012/086171 | A1 | 6/2012 |

* cited by examiner

*Primary Examiner* — Anh T. N. Vo
(74) *Attorney, Agent, or Firm* — Global IP Counselors, LLP

(57) ABSTRACT

An advantage is to suppress larger size of printing material holding containers or printing devices. A printing material holding container is equipped with a case which is equipped with a front surface, a first side surface, a second side surface, a third side surface, a fourth side surface, and a back surface, a printing material holding unit provided on the inside of the case, a second insertion hole in which is inserted a rod shaped member provided on the front surface, and a printing material injection flow path having a printing material injection port that opens on another surface excluding the front surface and for which the other end is connected to the printing material holding unit, wherein the second insertion hole, of the front surface, is provided at an intermediate position of the first side surface and the second side surface.

19 Claims, 34 Drawing Sheets

19b-19b
CROSS SECTION VIEW 26-26
CROSS SECTION VIEW 27-27
CROSS SECTION VIEW 28-28
CROSS SECTION VIEW 29-29
CROSS SECTION VIEW 31-31
CROSS SECTION VIEW 32-32
CROSS SECTION VIEW

PRINTING MATERIAL HOLDING CONTAINER

CROSS-REFERENCE TO RELATED APPLICATIONS

This application claims priority to Japanese Patent Application No. 2012-115536 filed on May 21, 2012. The entire disclosure of Japanese Patent Application No. 2012-115536 is hereby incorporated herein by reference.

BACKGROUND

1. Technical Field

The present invention relates to a printing material holding container for holding a printing material inside.

2. Related Art

A printer, which is an example of a printing device, performs printing by discharging ink from a printing head onto a recording subject (e.g. printing paper). As technology for supplying ink to the printing head, technology that uses an ink holding container which holds the ink inside (also simply called a "printing material holding container") is known. Here, if the printing head is operated in a state when ink is not supplied to the printing head from the printing material holding container, there are cases when problems occur such as this resulting in so-called empty shots and the printing head being damaged. Thus, technology is known for which detection means for detecting a state when the ink inside the printing material holding container has run out, or a state when the remaining ink is low, is mounted in the printing material holding container or the printer (e.g. Patent Documents 1 and 2). The state when the ink has run out or the state when the remaining ink is low is called "ink end."

Japanese Laid-open Patent Publication No. 2008-270750 (Patent Document 1) and Japanese Laid-open Patent Publication No. 2007-136807 are examples of the related art.

SUMMARY

Problems to Be Solved by the Invention

The technology of Patent Document 1 detects ink end using a piezoelectric detection means. This technology provides a liquid detection unit in a printing material holding container, and detects ink end by detecting changes in the capacity of the detection chamber using the piezoelectric detection means. With the technology of Patent Document 1, it is necessary to provide a power supply to the piezoelectric detection means or an electrical conduction means (wiring or electrode terminals or the like) for sending and receiving of signals by the piezoelectric detection means and the printer inside the printing material holding container. Because of this, the structure of the printing material holding container becomes complex, which brings the risk of increasing manufacturing costs.

The technology of Patent Document 2 detects ink end using an optical detection mechanism. A structure is provided for which the position changes along with changes in the subtank capacity, and the ink end is detected by detecting the displacement of that structure using an optical sensor. With the technology of Patent Document 2, if there is a skew from the precise positional relationship that was designed for the positional relationship of the subtank, structure, and optical sensor, there is the risk that it will not be possible to detect the ink end.

The various problems like those described above are not limited to printing material holding containers that hold ink for printing, and there were also the same problems with printing devices that eject other types of liquid besides ink and the printing material holding containers for those.

Taking into consideration the issues noted above, an advantage of the invention is to provide technology that inhibits increased complexity of the printing material holding container and the printing device. Another advantage is to provide technology that aligns the printing material holding container to the printing material holding container mounting unit of the printing device with good precision. Another advantage is to provide technology that allows accurate printing material end detection to be performed.

Note that the contents disclosed in Patent Application 2010-285972 are incorporated by reference within this specification.

Means Used to Solve the Above-Mentioned Problems

The invention was created to address at least a portion of the problems noted above, and can be realized as the following modes or application examples.

Application Example 1

A printing material holding container for mounting detachably on a printing material holding container mounting that includes a printing material supply tube fixed to a device side front wall part, and having a central axis extending in a designated direction, a rod shaped member having an axis parallel to the central axis, that is movable along the axis direction, provided on the device side front wall part, and a sensor for detecting displacement of the rod shaped member, the printing material holding container including a case for which when three mutually orthogonal spatial axes are the X axis, the Y axis, and the Z axis, the directions along the X axis, the Y axis and the Z axis are the X axis direction, the Y axis direction, and the Z axis direction, the direction for which the printing material holding container is inserted in the printing material holding container mounting unit is the −Y axis direction, and the direction for which the printing material holding container is removed from the printing material holding container mounting unit is the +Y axis direction, the case includes two surfaces facing opposite in the Y axis direction, being a front surface positioned at the −Y axis direction side, and roughly rectangular in shape with the Z axis direction dimension larger than the X axis direction dimension, and a back surface positioned at the +Y axis direction side, two surfaces that intersect with the front surface and the back surface and face opposite in the Z axis direction, being a first side surface positioned at the +Z axis direction side, and a second side surface positioned at the −Z axis direction side, and two surfaces that intersect with the front surface, the back surface, the first side surface, and the second side surface, facing opposite in the X axis direction, being a third side surface positioned at the +X axis direction side, and a fourth side surface positioned at the −X axis direction side, a printing material holding unit provided inside the case, a first insertion hole provided on the front surface, for which a printing material supply port in which the printing material supply tube is inserted is arranged in the interior, and also in which the printing material supply tube is inserted, a second insertion hole provided on the front surface in which the rod shaped member is inserted, a printing material flow path having the printing material supply port at one end, and for which the other end is connected to the printing material holding portion, and a printing material injection flow path having a printing material injection port that opens to another surface excluding the front surface at one end, and for which the other end is connected to the printing material holding portion, wherein of the front surface, the second insertion hole is provided at an intermediate position between the first side surface and the second side surface.

In the printing material holding container according to application example 1, a piezoelectric type detection mechanism for detecting that the printing material within the printing material holding container has run out or is running low (called "end detection") is not provided. Because of this, it is not necessary to provide a power supply or an electrical conduction means (wiring, electrode terminals or the like) for sending and receiving signals between this kind of detection mechanism and the printer inside the printing material holding container, so it is possible to make the structure of the printing material holding container simple. Thus, it is possible to make the printing material holding container more compact. It is also possible to reduce the manufacturing cost of the printing material holding container. Also, with the printing material holding container of application example 1, of the front surface, the second insertion hole is provided at an intermediate position between the first side surface and the second side surface. Specifically, alignment of the printing material holding container is performed at an intermediate position in the lengthwise direction of the front surface. If alignment is performed at a position near one end part of the front surface lengthwise direction of the printing material holding container, positional skew is inhibited near one end part, but it is not possible to inhibit positional skew near the other end part, and that skew becomes larger. However, with the printing material holding container of application example 1, alignment of the printing material holding container is performed at an intermediate position in the lengthwise direction of the front surface, so it is possible to similarly inhibit positional skew of both end parts in the lengthwise direction. Thus, it is possible to do alignment of the printing material holding container on the printing material holding container mounting unit with good precision and good efficiency.

Here, the "intermediate position" used for the "intermediate position between the first side wall part of the device side and the second side wall part of the device side" or the "intermediate position between the first side surface and the second side surface" does not necessarily mean exactly the middle, and is acceptable as long as it is not arranged biased toward either one of the side surfaces or side wall parts. For example, the "intermediate position" includes positions skewed from the central position in the Z axis direction of the first side surface and the second side surface. In more detail, the "intermediate position" includes positions for which the central axis of the second insertion hole is within the range of 10% or less from the central position in relation to the distance in the Z axis direction of the first side surface and the second side surface. So as to have the central axis of the second insertion hole arranged more to the middle, it is preferable to have the "intermediate position" include positions within a range of 7.5% or less from the central position in relation to the distance in the Z axis direction of the first side surface and the second side surface.

Also, this is equipped with a printing material injection flow path having a printing material injection port that opens to another surface except the front surface (the first side surface, back surface or the like) at one end, and for which the other end is connected to a printing material holding portion, so when the liquid held in the printing material holding portion is consumed and runs out, it is possible to supply liquid to the printing material holding portion. Therefore, it is possible to use the printing material holding container repeatedly without replacing it.

Application Example 2

The printing material holding container according to application example 1, wherein an external printing material holding portion arranged outside the case is connected to the printing material injection port, and the printing material holding portion and the external printing material holding portion are an integrated unit and constitute a sealed type liquid holding unit. With the printing material holding container according to application example 2, as the liquid held in the printing material holding portion and the external printing material holding portion is used, there is a decrease in pressure in these interiors, so it is possible to send liquid to the device side. Also, when the liquid is used and runs out, by replacing the external printing material holding portion, it is possible to repeatedly use the printing material holding container (printing material holding portion) without replacing it.

Application Example 3

The printing material holding container according to application example 2, including a detection chamber provided midway in the printing material flow path, for which the capacity changes according to changes in the internal pressure, and a lever member which abuts the tip of the rod shaped member, and moves the rod along the axis direction by displacing it according to changes in the capacity of the detection chamber. With the printing material holding container according to application example 3, by the rod shaped member used for printing material end detection being inserted in the second insertion hole, alignment of the printing material holding container to the printing material holding container mounting unit is performed at the intermediate position in the lengthwise direction of the front surface of the printing material holding container. By doing this, it is possible to inhibit positional skew of the printing material holding container in relation to the rod shaped member, and possible to perform printing material end detection accurately. Also, since alignment of the printing material holding container to the printing material holding container mounting unit is performed using the rod shaped member used for printing material end detection, it is possible to reduce the number of parts because it is not necessary to provide a separate member for alignment, so it is possible to make the printing material holding container more compact, and also possible to make the printing device on which the printing material holding container is mounted more compact.

Application Example 4

The printing material holding container according to application example 1, wherein the printing material holding portion is an open type liquid holding portion open to the air via the printing material injection port. With the printing material holding container according to application example 4, when the liquid held in the printing material holding portion is used and runs out, it is possible to supply liquid from the printing material injection port, so it is possible to repeatedly use the printing material holding container without replacing it.

Application Example 5

The printing material holding container according to application example 4, further including an abutting part that abuts the tip of the rod shaped member when mounted on the printing material holding container mounting unit and moves the rod shaped member along the axis direction. With the printing material holding container according to application example 5, by the rod shaped member used for detecting mounting of the printing material holding container being inserted in the second insertion hole, alignment of the printing material holding container in relation to the printing material holding container mounting unit is performed at the intermediate position in the lengthwise direction of the front surface of the printing material holding container. By doing this, it is possible to inhibit positional skew of the printing material holding container in relation to the rod shaped member, making it possible to perform detection of mounting of the printing material holding container accurately. Also, since alignment of the printing material holding container in relation to the printing material holding container mounting unit is performed using the rod shaped member used for detection of mounting of the printing material holding container, it is possible to reduce the number of parts since it is not necessary to provide a separate member for alignment, so it is possible to make the printing material holding container more compact. It is also possible to make the printing device on which the printing material holding container is mounted more compact.

Application Example 6

The printing material holding container according to application example 4 or application example 5, wherein the printing material holding portion is an internal space formed inside the case. With the printing material holding container according to application example 6, it is not necessary to hold a bag portion formed using an aluminum laminate multi-layer film or the like inside the case, so it is possible to reduce the manufacturing cost of the printing material holding container.

Application Example 7

The printing material holding container according to any of application example 1 through 6, wherein the case includes a protective container having an opening at the −Y axis direction side, for which the printing material holding portion is held or formed inside, and a cap provided at the −Y axis direction side, attached to the protective container so as to close the opening of the protective container, wherein the first insertion hole and the second insertion hole are provided on the cap. With the printing material holding container according to application example 7, the case is equipped with a protective container and a cap, and a second insertion hole and first insertion hole are provided in the cap. The protective container side in which the printing material holding portion is held has a greater weight overall compared to the cap side. When the side surface of the case is formed continuously from the front surface side (tip side in the −Y axis direction) to the back surface side (tip side in the +Y axis direction), there is a possibility of the overall printing material holding container tilting so that the back surface side drops more than the front surface side. In contrast to this, if the protective container for holding the printing material holding portion and the cap are made to be separate members, it is possible to constitute this so that the protective container can move slightly in relation to the cap by the amount of clearance between the cap and the protective container. Thus, even if the weight of the printing material holding portion is large, tilting is only for the protective container part, and it is possible to maintain the correct posture without the cap tilting. By doing this, in the mounted state, it is possible to reduce the possibility of the position of the first insertion hole and the second insertion hole provided in the cap skewing from the designed proper position in relation to the printing material holding container mounting portion.

Application Example 8

The printing material holding container according to application example 7, further including a printing material holding container side terminal group that, in the mounted state, contacts the device side terminal group provided on the printing material holding container device unit, wherein the printing material holding container side terminal group is provided on the cap. With the printing material holding container according to application example 8, in the mounted state, by providing a printing material holding container side terminal group in a cap for which the possibility of skew from the correct position has been reduced, it is possible to make a stable electrical connection between the printing material holding container side terminal group and the device side terminal group.

Application Example 9

A printing material holding container for mounting detachably on a printing material holding container mounting unit that includes a printing material supply tube fixed to a device side front wall part, and having a central axis extending in a designated direction, a rod shaped member having an axis parallel to the central axis, that is movable along the axis direction, provided on the device side front wall part, and a sensor for detecting displacement of the rod shaped member, including an adapter for which when three mutually orthogonal spatial axes are the X axis, the Y axis, and the Z axis, the directions along the X axis, the Y axis and the Z axis are the X axis direction, the Y axis direction, and the Z axis direction, the direction for which the printing material holding container is inserted in the printing material holding container mounting unit is the −Y axis direction, and the direction for which the printing material holding container is removed from the printing material holding container mounting unit is the +Y axis direction, the adapter includes two surfaces facing opposite in the Y axis direction, being a front surface positioned at the −Y axis direction side, and roughly rectangular in shape with the Z axis direction dimension larger than the X axis direction dimension, and a back surface positioned at the +Y axis direction side, two surfaces that intersect with the front surface and the back surface and face opposite in the Z axis direction, being a first side surface positioned at the +Z axis direction side, and a second side surface positioned at the −Z axis direction side, and two surfaces that intersect with the front surface, the back surface, the first side surface, and the second side surface, facing opposite in the X axis direction, being a third side surface positioned at the +X axis direction side, and a fourth side surface positioned at the −X axis direction side, a printing material holding portion detachable on the back surface, a first insertion hole provided on the front surface, for which a printing material supply port in which the printing material supply tube is inserted is arranged in the interior, and also in which the printing material supply tube is inserted, a second insertion hole provided on the front surface in which the rod shaped member is inserted, and a printing material flow path provided inside the adapter, having the printing material supply port at one end, and for which the other end is connected to the printing material holding portion, wherein of the front surface, the second insertion hole is provided at an intermediate position between the first side surface and the second side surface.

With the printing material holding container according to application example 9, the same as with the printing material holding container according to application example 1, it is not necessary to provide a power supply or an electrical conduction means (wiring, electrode terminals or the like) for sending and receiving signals between this kind of detection mechanism and the printer inside the printing material holding container, so it is possible to make the structure of the printing material holding container simple. Thus, it is possible to make the printing material holding container more compact. It is also possible to reduce the manufacturing costs of the printing material holding container. Also, with the printing material holding container according to application example 9, the same as with the printing material holding container according to application example 1, alignment is performed at the lengthwise direction intermediate position of the front surface of the printing material holding container, so it is possible to similarly inhibit positional skew of both end parts in the lengthwise direction. Thus, it is possible to do alignment of the printing material holding container on the printing material holding container mounting unit with good precision and good efficiency.

Here, the "intermediate position" used for the "intermediate position between the first side wall part of the device side and the second side wall part of the device side" or the "intermediate position between the first side surface and the second side surface" is the same as the case of the printing material holding container according to application example 1.

Also, with the printing material holding container of application example 9, an adapter mounted on the printing material holding container mounting unit and a printing material holding portion detachable in relation to the back surface of the adapter are equipped, so when the liquid held in the printing material holding portion is consumed and runs out, it is possible to supply liquid by replacing only the printing material holding portion. Therefore, it is possible to use the printing material holding container (adapter) repeatedly without replacing it.

Application Example 10

The printing material holding container according to application example 9, wherein the printing material holding portion is a sealed type liquid holding portion. With the printing material holding container according to application example 10, as the liquid held in the printing material holding portion is used, the pressure decreases inside it, so it is possible to send liquid to the device side.

Application Example 11

The printing material holding container according to application example 10, including a detection chamber provided midway in the printing material flow path, for which the capacity changes according to changes in the internal pressure, and a lever member which abuts the tip of the rod shaped member, and moves the rod along the axis direction by displacing it according to changes in the capacity of the detection chamber. With the printing material holding container according to application 11, the same as with the printing material holding container according to application example 3, alignment of the printing material holding container to the printing material holding container mounting unit is performed at the intermediate position in the lengthwise direction of the front surface of the printing material holding container. By doing this, it is possible to perform printing material end detection accurately. Also, it is possible to reduce the number of parts because it is not necessary to provide a separate member for alignment, so it is possible to make the printing material holding container more compact. It is also possible to make the printing device on which the printing material holding container is mounted more compact.

Application Example 12

The printing material holding container according to application example 9, wherein the printing material holding portion is an open type liquid holding portion having an air introduction opening. With the printing material holding container according to application example 12, when the liquid held in the printing material holding portion is used and runs out, it is possible to supply liquid from the air introduction opening, so it is possible to use the printing material holding container repeatedly without replacing it.

Application Example 13

The printing material holding container according to application example 12, further including an abutting part that abuts the tip of the rod shaped member when mounted on the printing material holding container mounting unit and moves the rod shaped member along the axis direction. With the printing material holding container according to application example 13, the same as with the printing material holding container according to application example 5, by the rod shaped member used for detecting mounting of the printing material holding container being inserted in the second insertion hole, alignment of the printing material holding container in relation to the printing material holding container mounting unit is performed at the intermediate position in the lengthwise direction of the front surface of the printing material holding container. By doing this, it is possible to inhibit positional skew of the printing material holding container in relation to the rod shaped member, making it possible to perform detection of mounting of the printing material holding container accurately. Also, since alignment of the printing material holding container in relation to the printing material holding container mounting unit is performed using the rod shaped member used for detection of mounting of the printing material holding container, it is possible to reduce the number of parts since it is not necessary to provide a separate member for alignment, so it is possible to make the printing material holding container more compact. It is also possible to make the printing device on which the printing material holding container is mounted more compact.

Application Example 14

The printing material holding container according to any of application examples 9 through 12, including a printing material holding container side terminal group that, in the mounted state, contacts the device side terminal group provided on the printing material holding container device unit, wherein the printing material holding container side terminal group is provided on the adapter. With the printing material holding container according to application example 14, by providing a printing material holding container side terminal group in an adapter for which there is a reduction in the possibility of skew from the proper position in the mounted state, it is possible to have stable electric connection of the printing material holding container side terminal group and the device side terminal group.

Application Example 15

A liquid supply system for supplying liquid to a liquid jet device, including a sealed first liquid holding portion for holding liquid that can deform together with consumption of liquid, a sealed second liquid holding portion for holding liquid that can deform with consumption of liquid, connected in a sealed manner to the first liquid holding portion, and a third liquid holding portion provided with a liquid outlet portion connectable to the liquid jet device, connected in a sealed manner to the first liquid holding portion, having a deformation unit that is deformable by pressure greater than pressure at which each of the first liquid holding portion and the second liquid holding portion deforms, and by which the liquid consumption state is detected by deformation of the deformation unit.

With the constitution of application example 15, the first liquid holding portion and the second liquid holding portion are in a crushed state deformed before the third liquid holding portion, so it is possible to detect a sufficiently reduced state of the liquid volume remaining in the first liquid holding portion and the second liquid holding portion.

Application Example 16

The liquid supply system according to application example 15, wherein the deformation unit of the third liquid holding portion includes a deformation member having flexibility, and a biasing member for biasing the deformation member in the direction that expands the inside of the third liquid holding portion.

With the constitution of application example 16, the biasing member biases the deformation member in the direction that expands the interior of the third liquid holding portion, so it is more difficult for the third liquid holding portion to deform than the first and second liquid holding portions, and it is possible to detect a sufficiently reduced state of the liquid residual volume of the first liquid holding portion and the second liquid holding portion.

Application Example 17

The liquid supply system according to application example 15 or application example 16, wherein the first liquid holding portion is deformed by the equivalent pressure to that by which the second liquid holding portion is deformed, or by a pressure greater than the pressure by which the second liquid holding portion is deformed.

With the constitution of application example 17, the second liquid holding portion connected to the first liquid holding portion goes to a crushed state by deforming at the same rate or faster than the first liquid holding portion, so it is easier for the liquid residual volume of the second liquid holding portion to decrease earlier than the liquid residual volume of the first liquid holding portion, and because the liquid residual volume of the first liquid holding portion connected to the third liquid holding portion which undergoes detection decreases later than the second liquid holding portion, it is possible to detect the sufficiently reduced state of the liquid residual volume of the first liquid holding portion and the second liquid holding portion.

Application Example 18

The liquid supply system according to application example 15 or application example 16, wherein the second liquid holding portion is a bag portion constituted using a flexible material.

With the constitution of application example 18, the second liquid holding portion is a bag portion constituted using a flexible material, so it is easy to create a sealed structure, and easy to deform along with liquid consumption, so it is possible to more reliably detect a sufficiently decreased state of the liquid residual volume.

Application Example 19

The liquid supply system according to application example 15 or application example 16, wherein the third liquid holding portion has at least a portion covered by a case, and the case includes a liquid holding portion side electrical connection part that can contact a main unit side electrical connection part provided in the liquid jet device when the liquid outlet portion is connected to the liquid jet device.

With the constitution of application example 19, the case that covers at least a portion of the third liquid holding portion is equipped with an electrical connection part, so it is possible to communicate electrical signals with the main unit side electrical connection part.

The invention can be realized in various modes, and in addition to a constitution as a printing material holding container, it can also be realized in modes of a printing material holding container manufacturing method, or a printing material supply system equipped with a printing device, a printing material holding container, and a printing device or the like.

BRIEF DESCRIPTION OF THE DRAWINGS

Referring now to the attached drawings which form a part of this original disclosure:

FIG. 15 is a schematic structural drawing of the rod shaped member 92 and the sensor 138 that the printing material holding container mounting unit 6 is equipped with;

DETAILED DESCRIPTION OF EXEMPLARY EMBODIMENTS

Following, we will describe modes for carrying out the invention.

Figure 1:
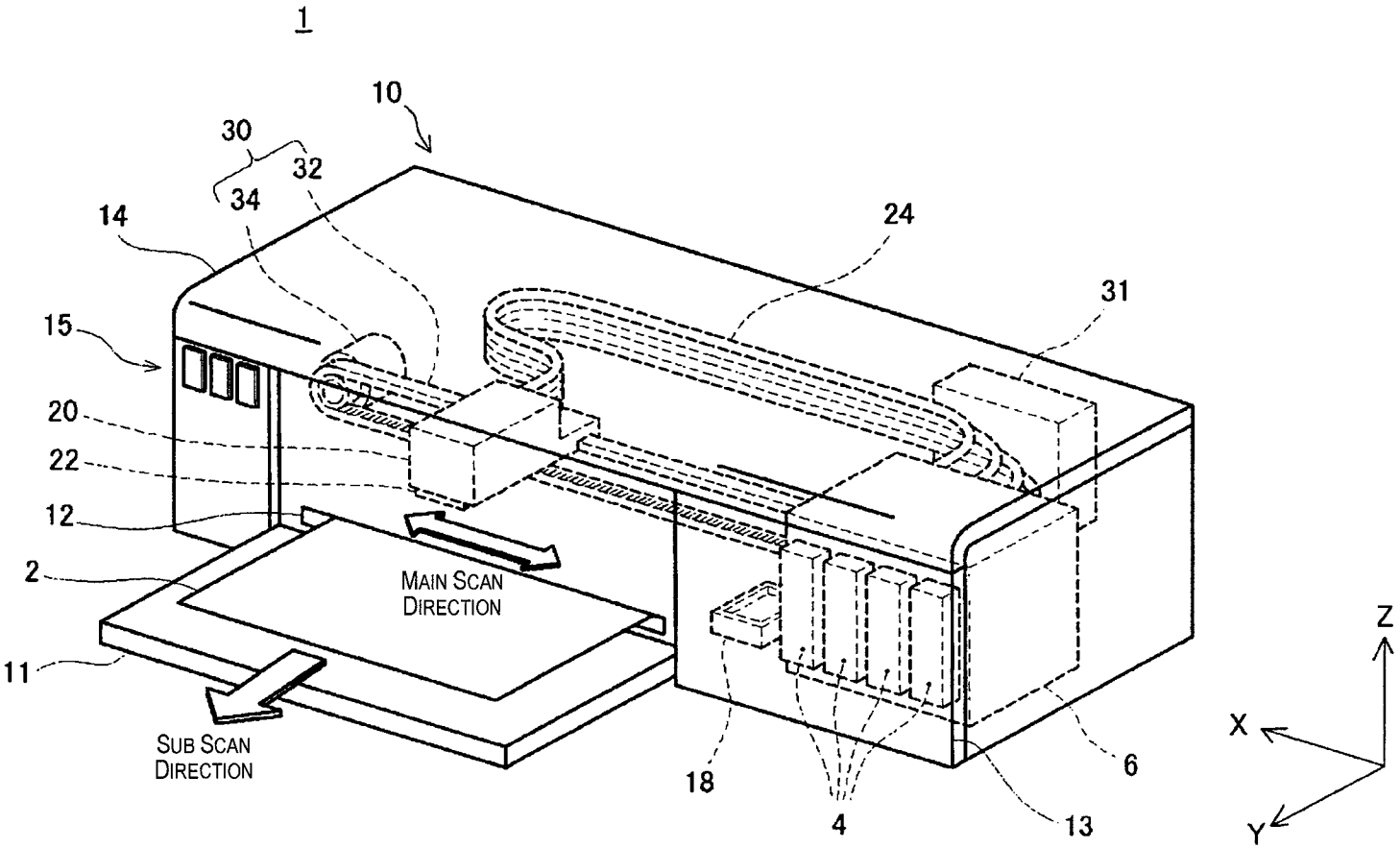
FIG. 1 is a drawing for explaining the liquid consuming system 1 as an embodiment of the invention.

A. Embodiments:

A-1. Overall Constitution of Liquid Consuming System:

FIG. 1 is a drawing for explaining the liquid consuming system 1 as an embodiment of the invention. In FIG. 1, the XYZ axes are depicted as being mutually orthogonal. For the drawings hereafter as well, the XYZ axes will be depicted as necessary. The XYZ axes depicted in other drawings correspond to the direction of the XYZ axes in FIG. 1. The liquid consuming system 1 is equipped with a printer 10 as the liquid consuming device, and a printing material holding container 4 as the liquid container.

The printer 10 of this embodiment is an inkjet printer that discharges ink from a head 22. This printer 10 is a large printer that performs printing on large size paper such as posters or the like (A2 to A0 or the like). The printer 10 is equipped with a printing material holding container mounting unit 6, a control unit 31, a carriage 20, a head 22, and a drive mechanism 30. Also, the printer 10 is equipped with an operating button 15 for the user to operate for operation of the printer 10.

A plurality of printing material holding containers 4 are respectively mounted to be detachable on the printing material holding container mounting unit 6. With this embodiment, one each of four types of the printing material holding container 4 corresponding to four colors (black, yellow, magenta, cyan) of ink, in other words a total of four printing material holding containers 4 are mounted on the printing material holding container mounting unit 6. With the printer 10 of this embodiment, a replacement cover 13 is provided on the front surface (+Y axis direction side surface). When the +Z axis direction side of the replacement cover 13 is bent to the frontward side (+Y axis direction side), an opening of the printing material holding container mounting unit 6 appears, and attachment and detachment of the printing material holding container 4 becomes possible. When the printing material holding container 4 is mounted on the printing material holding container mounting unit 6, it is possible to supply ink to the head 22 provided on the carriage 20 via a hose 24. With this embodiment, by suctioning ink within the printing material holding container 4 using a suction pump (not illustrated) of the printer 10, ink is supplied to the head 22. The hose 24 is provided for each of the types of ink. The state for which the printing material holding container 4 is mounted on the printing material holding container mounting unit 6 is called the "mounted state." During operation of the printer 10 (when the printing material holding container 4 is mounted on the printing material holding container mounting unit 6), it is possible to close the replacement cover 13, and also possible to leave it open.

Nozzles for each of the ink types are provided on the head 22. The head 22 ejects ink from the nozzles toward the printing paper 2 and prints data such as text, images or the like. With this embodiment, with the printer 10, the printing material holding container mounting unit 6 does not work in coordination with the movement of the carriage 20. This is a printer called a so-called "off carriage type." It is also possible to apply the invention to printers called the so-called "on carriage type" with which the printing material holding container mounting unit 6 is provided on the carriage 20, and the printing material holding container mounting unit 6 moves together with the carriage 20.

The control unit 31 controls each part of the printer 10, or performs sending and receiving of signals with the printing material holding container 4. The carriage 20 moves the head 22 in relation to the printing paper 2.

The drive mechanism 30 moves the carriage back and forth based on the control signals from the control unit 31. The drive mechanism 30 is equipped with a timing belt 32 and a drive motor 34. By transmitting the power of the drive motor 34 via the timing belt 32, the carriage 20 moves back and forth in the main scanning direction (X axis direction). Also, the printer 10 is equipped with a transport mechanism for moving the printing paper 2 in the sub scan direction (+Y axis direction). When printing is performed, the printing paper 2 is moved in the sub scan direction by the transport mechanism, and the printing paper 2 after printing is completed is output via the opening 12 onto the front surface cover 11.

Also, an area called a home position is provided at a position other than the printing area in which the carriage 20 is moved in the main scan direction, and a maintenance mechanism for performing maintenance so as to make normal printing possible is installed at the home position. The maintenance mechanism is pressed against the surface on which nozzles are formed (nozzle surface) at the bottom surface side (side facing the printing paper 2) of the head 22, and is constituted from items such as a cap member 18 which forms an enclosed space so as to enclose the nozzles, a raising and lowering mechanism (not illustrated) that raises and lowers the cap member 18 to press against the nozzle surface of the head 22, a suction pump (not illustrated) for introducing negative pressure into the enclosed space formed by the cap member 18 being pressed against the nozzle surface of the head 22.

With this embodiment, with the liquid consuming system 1 (the printer 10 and the printing material holding container 4) in a used state, the axis along the sub scan direction in which the printing paper 2 is conveyed is the Y axis, the axis along the gravity direction (vertical direction) is the Z axis, and the axis along the movement direction of the carriage 20 (horizontal direction) is the X axis. Here, the "liquid consuming system 1 used state" means a state in which the liquid consuming system 1 is installed on a horizontal surface. Also, with this embodiment, the sub scan direction (forward direction) is the +Y axis direction, and the reverse direction to that (reverse direction) is the −Y axis direction, the direction facing upward from below in the gravity direction (upward direction) is the +Z axis direction, and the reverse direction to that (downward direction) is the −Z axis direction. Also, when the liquid consuming system 1 is seen from the front side (+Y axis direction side), the direction facing from the right side to the left side is the +X axis direction, and the reverse direction to that is the −X axis direction. Also, with this embodiment, the insertion direction when the printing material holding container 4 is mounted on the printing material holding container mounting unit 6 is also the −Y axis direction, and the direction when the printing material holding container 4 is removed from the printing material holding container mounting unit 6 is also the +Y axis direction. Thus, of the printing material holding container mounting unit 6, the −Y axis direction side is also called the inward side, and the +Y axis direction side is also called the frontward side. Also, with this embodiment, the array direction of the plurality of the printing material holding containers 4 is also the X axis direction.

Figure 2:
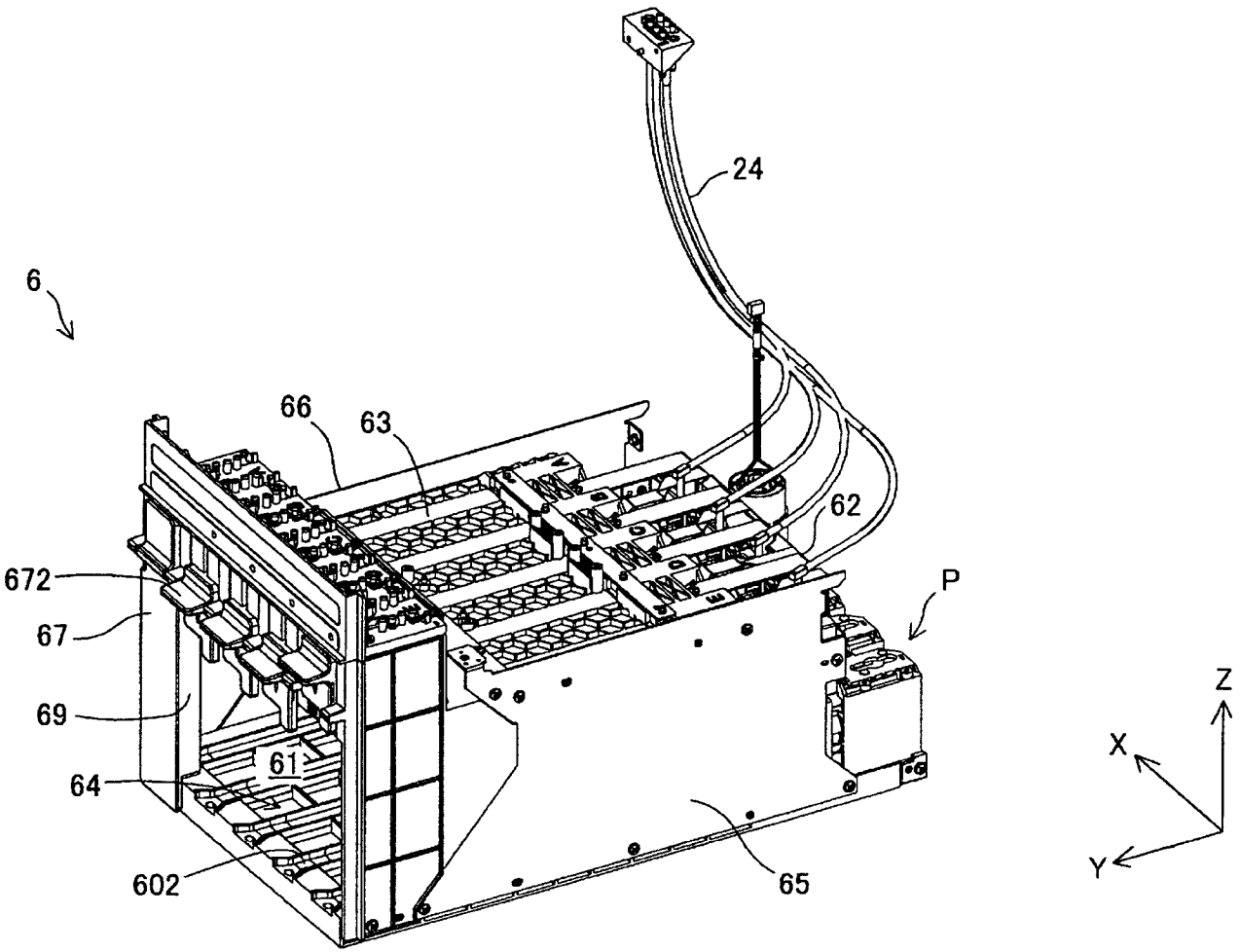
FIG. 2 is a first external appearance perspective view of the printing material holding container mounting unit 6.
Figure 3:
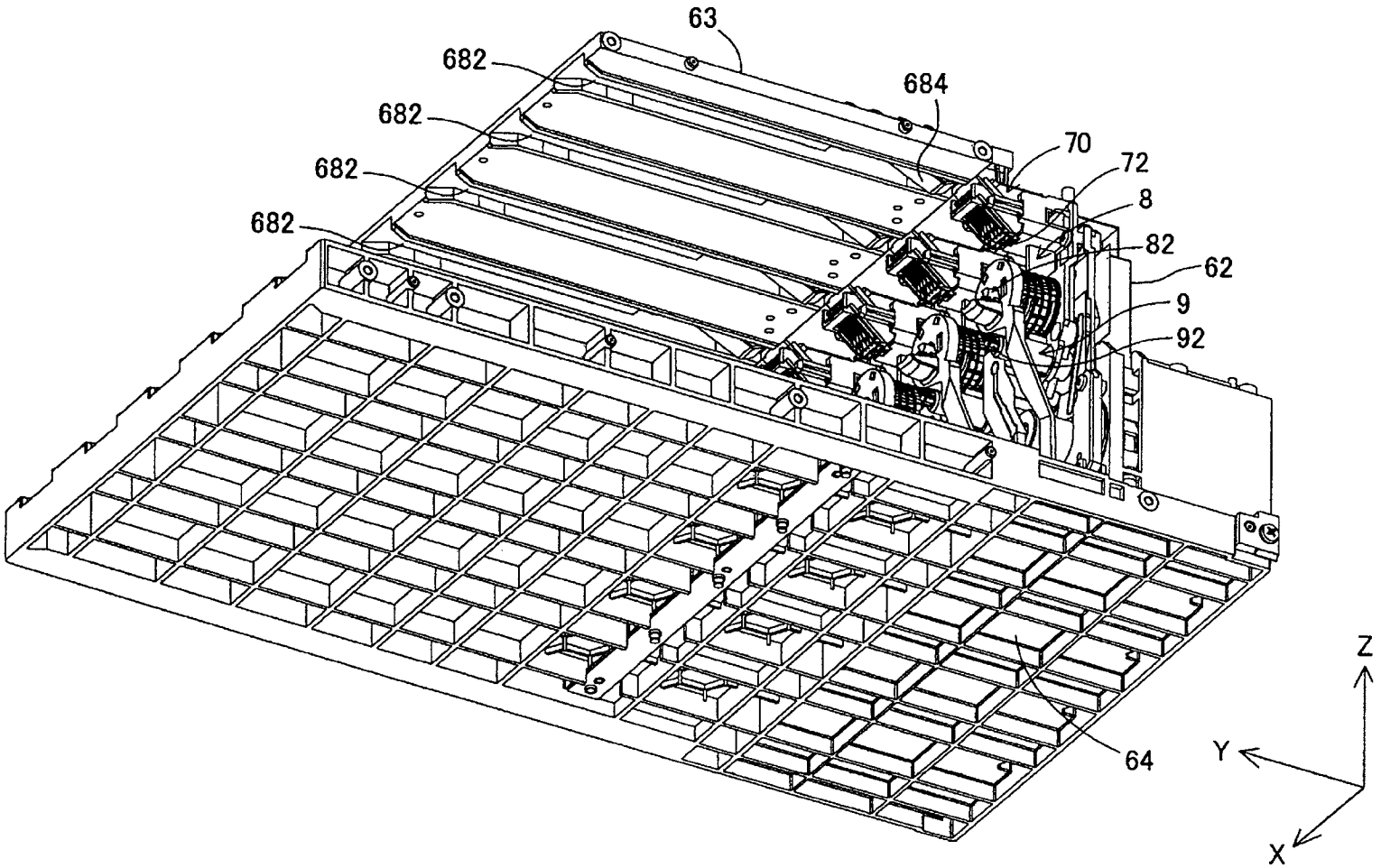
FIG. 3 is a second external appearance perspective view of the printing material holding container mounting unit 6.
Figure 4:
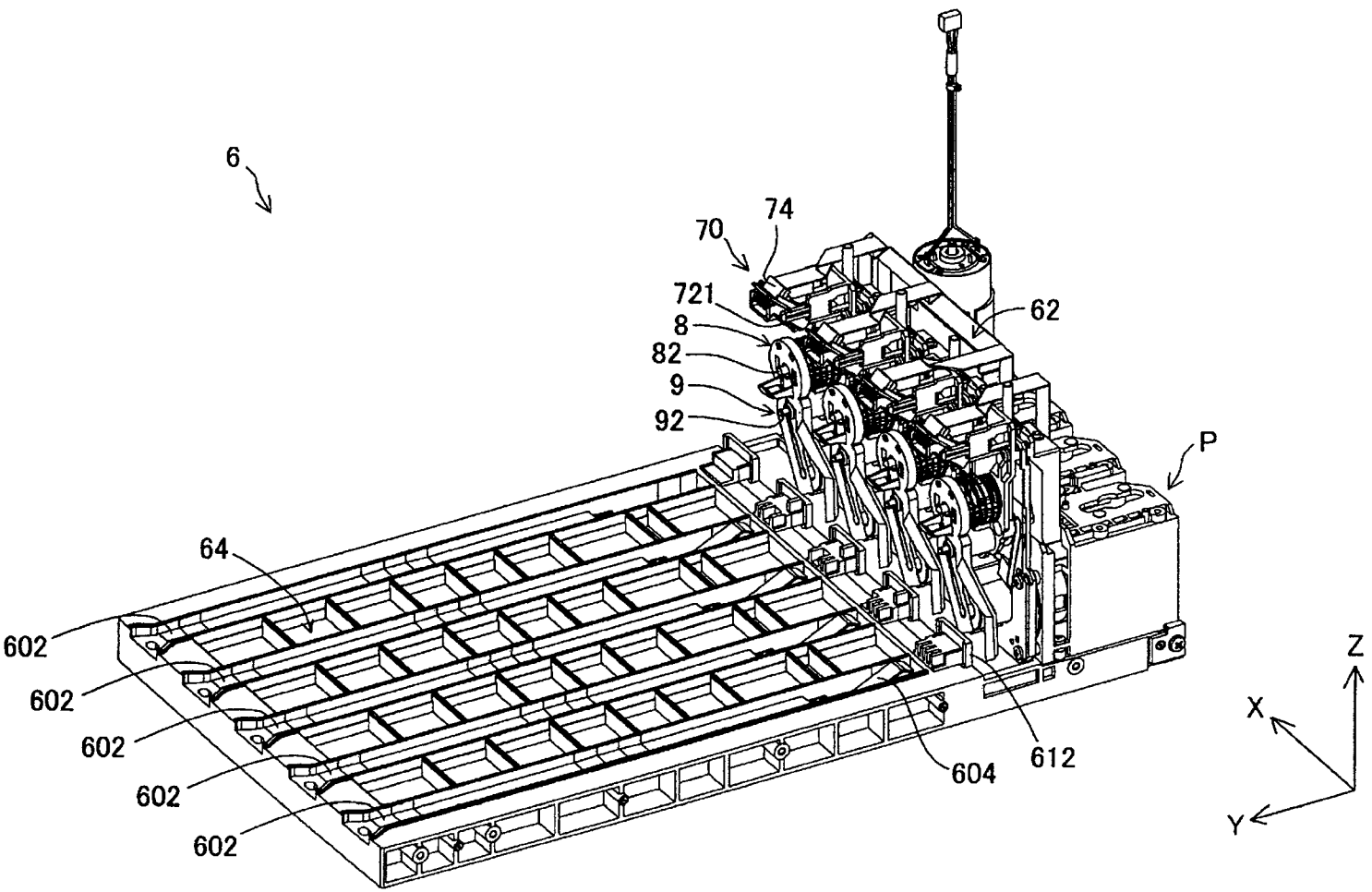
FIG. 4 is a third external appearance perspective view of the printing material holding container mounting unit 6.

A-2. Detailed Constitution of the Printing Material Holding Container Mounting Unit 6:

Following, we will explain the detailed structure of the printing material holding container mounting unit 6 using FIG. 2 through FIG. 4. FIG. 2 is a first external appearance perspective view of the printing material holding container mounting unit 6. FIG. 3 is a second external appearance perspective view of the printing material holding container mounting unit 6. FIG. 4 is a third external appearance perspective view of the printing material holding container mounting unit 6. FIG. 2 also shows the hose 24 attached to the printing material holding container mounting unit 6. FIG. 3 and FIG. 4 omit an illustration of a portion of the wall part that does compartment formation of the printing material holding container mounting unit 6 in order to explain the internal structure of the printing material holding container mounting unit 6.

As shown in FIG. 2, a printing material holding container holding chamber 61 for holding the printing material holding containers 4 has compartments formed by the six wall parts described hereafter in the printing material holding container mounting unit 6. The printing material holding container holding chamber 61 is generally a solid rectangle shape. Each of the parts of the printing material holding container holding chamber 61 that hold one of the four printing material holding containers 4 is also called a slot.

The printing material holding container mounting unit 6 is equipped with a device side front wall part 62, a first device side side-wall 63, and a second device side side-wall 64. Also, the printing material holding container mounting unit 6 is equipped with a third device side side-wall 65, a fourth device side side-wall 66, and an opening wall part 67. The printing material holding container holding chamber 61 has compartments formed by these six wall parts 62, 63, 64, 65, 66, and 67. The external shape of the respective six wall parts 62, 63, 64, 65, 66, and 67 are generally rectangle shapes.

The device side front wall part 62 and the opening wall part 67 face opposite each other. The first device side side-wall 63 and the device side side-wall 64 face opposite each other. The third device side side-wall 65 and the fourth device side side-wall 66 face opposite each other.

An opening 69 that the printing material holding container 4 passes through when attaching and detaching is formed on the opening wall part 67. Also, a lever 672 that can move in the Z axis direction is provided on the opening wall part 67. By moving the lever 672 in the −Z axis direction after the printing material holding container 4 is mounted, the lever 672 catches on the printing material holding container 4. By doing this, accidental removal of the printing material holding container 4 is prevented. The printing material holding container 4 is attached and detached to the printing material holding container mounting unit 6 along the Y axis direction. Specifically, the Y axis direction is the attachment/detachment coordinate axis extending along the direction in which the printing material holding container 4 is attached and detached. Also, the +Y axis direction is the direction in which the printing material holding container 4 is removed, and the −Y axis direction is the direction in which printing material holding container 4 is mounted.

A suction pump P for suctioning the ink within the printing material holding container 4 is arranged at the −Y axis direction side of the device side front wall part 62. The suction pumps P are provided corresponding to the number of mounted printing material holding containers 4.

As shown in FIG. 3, the first device side side-wall 63 has a first rail 682 for regulating the Y axis direction movement of the printing material holding container 4 in the mounted state. Also, the first rail 682 guides the printing material holding container 4 to the mounting position. The first rails 682 are provided at least corresponding to the number of mounted printing material holding containers 4. With this embodiment, a total of five first rails 682 are provided, with four for the printing material holding containers 4 which are actually mounted and one spare. The first rail 682 is a groove extending in the Y axis direction, and a part of the printing material holding container 4 is inserted in it. Also, a plate spring 684 is provided as a retention member on the −Y axis direction side end part of the first rail 682. In the mounted state, by the plate spring 684 retaining the printing material holding container 4, falling out of the printing material holding container 4 from the printing material holding container mounting unit 6 is prevented.

As shown in FIG. 4, the second device side side-wall 64 has a second rail 602 for regulating the Y axis direction movement of the printing material holding container 4 in the mounted state. Also, the second rail 602 guides the printing material holding container 4 to the mounting position. The second rails 602 are provided at least corresponding to the number of mounted printing material holding containers 4. With this embodiment, a total of five first rails 682 are provided, with four for the printing material holding containers 4 which are actually mounted and one spare. The first rail 682 is a groove extending in the Y axis direction, and a part of the printing material holding container 4 is inserted in it. Also, a plate spring 604 is provided as a retention member on the −Y axis direction side end part of the second rail 602. In the mounted state, by the plate spring 604 retaining the printing material holding container 4, falling out of the printing material holding container 4 from the printing material holding container mounting unit 6 is prevented. Specifically, it regulates the −Y axis direction movement of the printing material holding container 4.

Also, of the second device side side-wall 64, a regulating member 612 is provided at a position near the device side front wall part 62. The regulating members 612 are provided corresponding to at least the number of the mounted printing material holding containers 4. With this embodiment, five regulating members 612 are provided, but the actual number used is four. With the regulating member 612, the printing material holding container 4 is inserted in the printing material holding container holding chamber 61 via the opening 69 (FIG. 2), and abuts the printing material holding container 4 when it reaches the correct mounting position. Specifically, it regulates the −Y axis direction movement of the printing material holding container 4.

Here, when the printing material holding container 4 is removed from the printing material holding container mounting unit 6, the lever 672 (FIG. 2) is moved in the +Z axis direction, and the printing material holding container 4 is pulled out to the −Y axis direction side. When the printing material holding container 4 is pulled out to the −Y axis direction side, plate springs 604 and 684 are displaced so as to be held inside each rail 602 and 682, and the retention is released.

As shown in FIG. 4, a device side terminal unit 70, a liquid supply mechanism 8, and a rod member 9 are provided on the device side front wall part 62. The device side terminal unit 70 is equipped with a device side terminal group 721 consisting of a plurality of terminals, and a connector 74. The device side terminal group 721 is electrically connected to the connector 74. The device side terminal group 721 is electrically connected by being in contact with the circuit substrate (described later) provided on the printing material holding container 4. The connector 74 is electrically connected to the control unit 31 (FIG. 1) of the printer 10. By doing this, it is possible to send and receive signals between the circuit substrate of the printing material holding container 4 and the control unit 31.

The liquid supply mechanism 8 is equipped with a liquid supply needle 82. In the mounted state, the liquid supply needle 82 is connected to the printing material holding container 4. By doing this, the ink held in the printing material holding container 4 is able to flow through the liquid supply needle 82. The liquid supply needle 82 is linked with the hose 24.

The rod member 9 is equipped with a rod shaped member 92. The rod shaped member 92 is a member that extends along the Y axis direction. The rod shaped member 92 is provided so as to be able to move along the Y axis direction. With this embodiment, the rod shaped member 92 is provided piercing the device side front wall part 62. The rod shaped member 92 constitutes a portion of the detection mechanism for detecting the residual ink volume state of the printing material holding container 4. With this embodiment, the ink end state of the printing material holding container 4 is detected by the detection mechanism. Here, "ink end state" means the state when the ink of the printing material holding container 4 has run out, or the state when the remaining ink in the printing material holding container 4 is low. Details of the detection mechanism will be described later.

Figure 5:
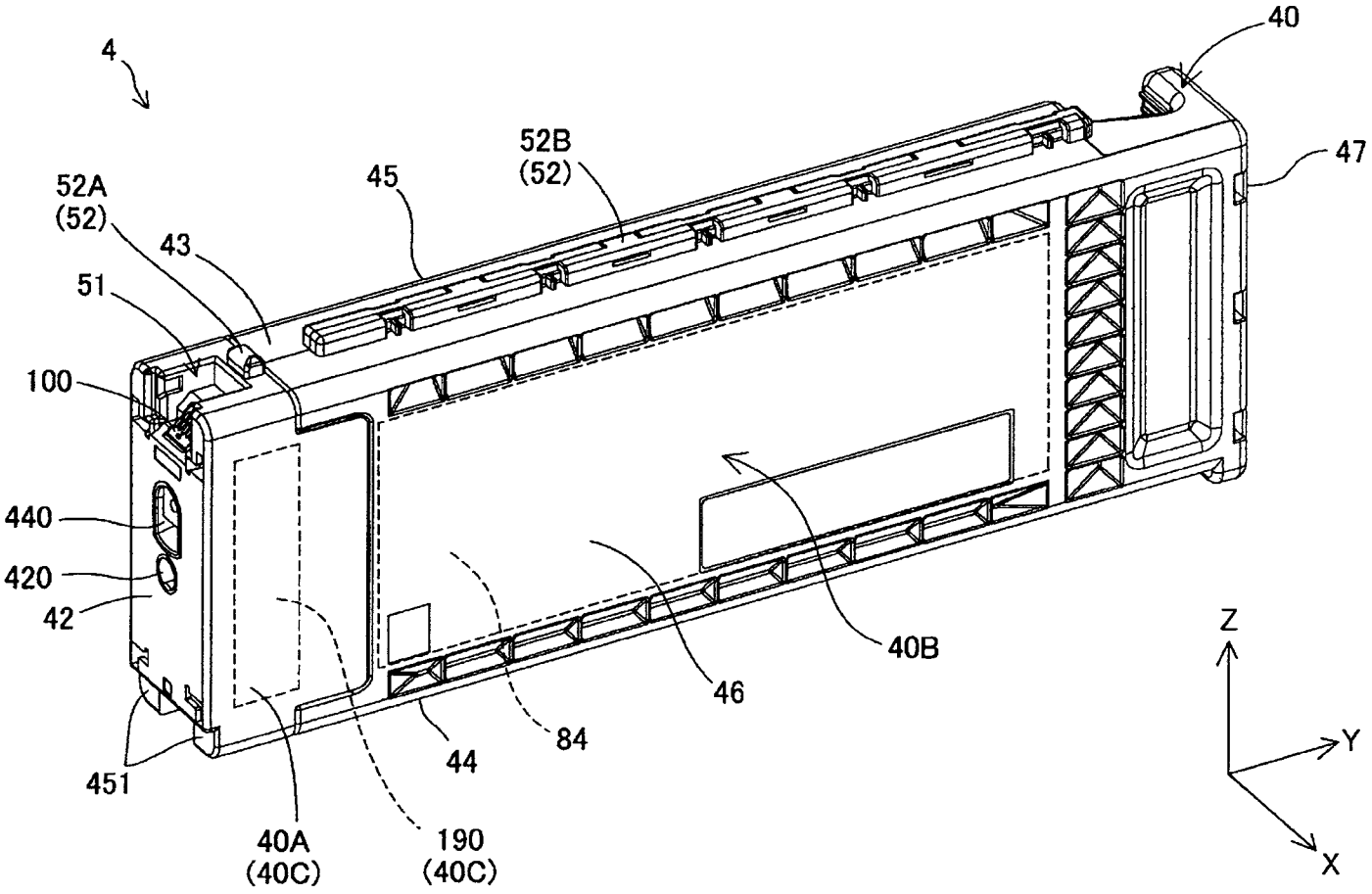
FIG. 5 is an external appearance perspective view of the printing material holding container 4.
Figure 6:
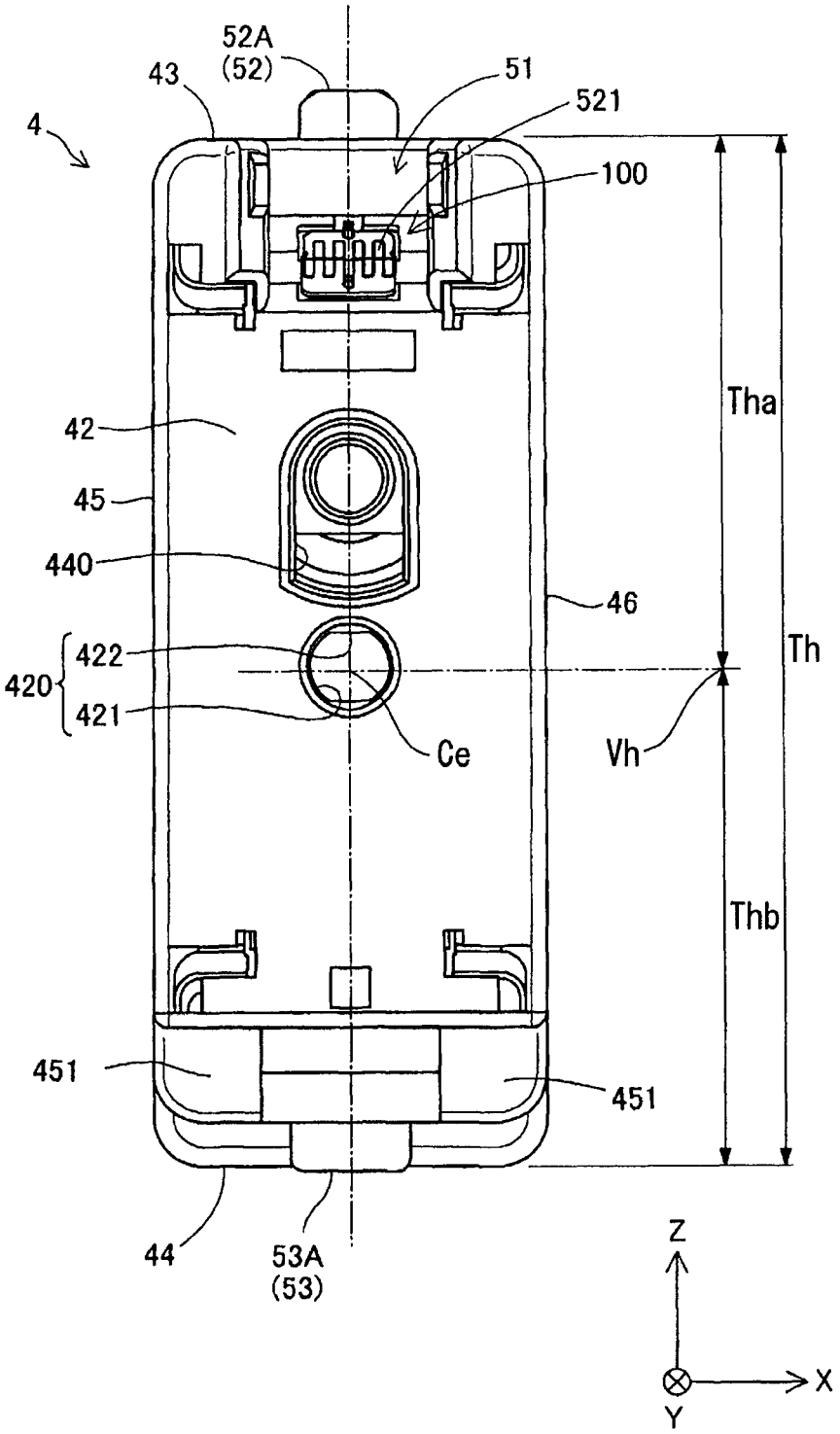
FIG. 6 is a front view of the printing material holding container 4.
Figure 7:
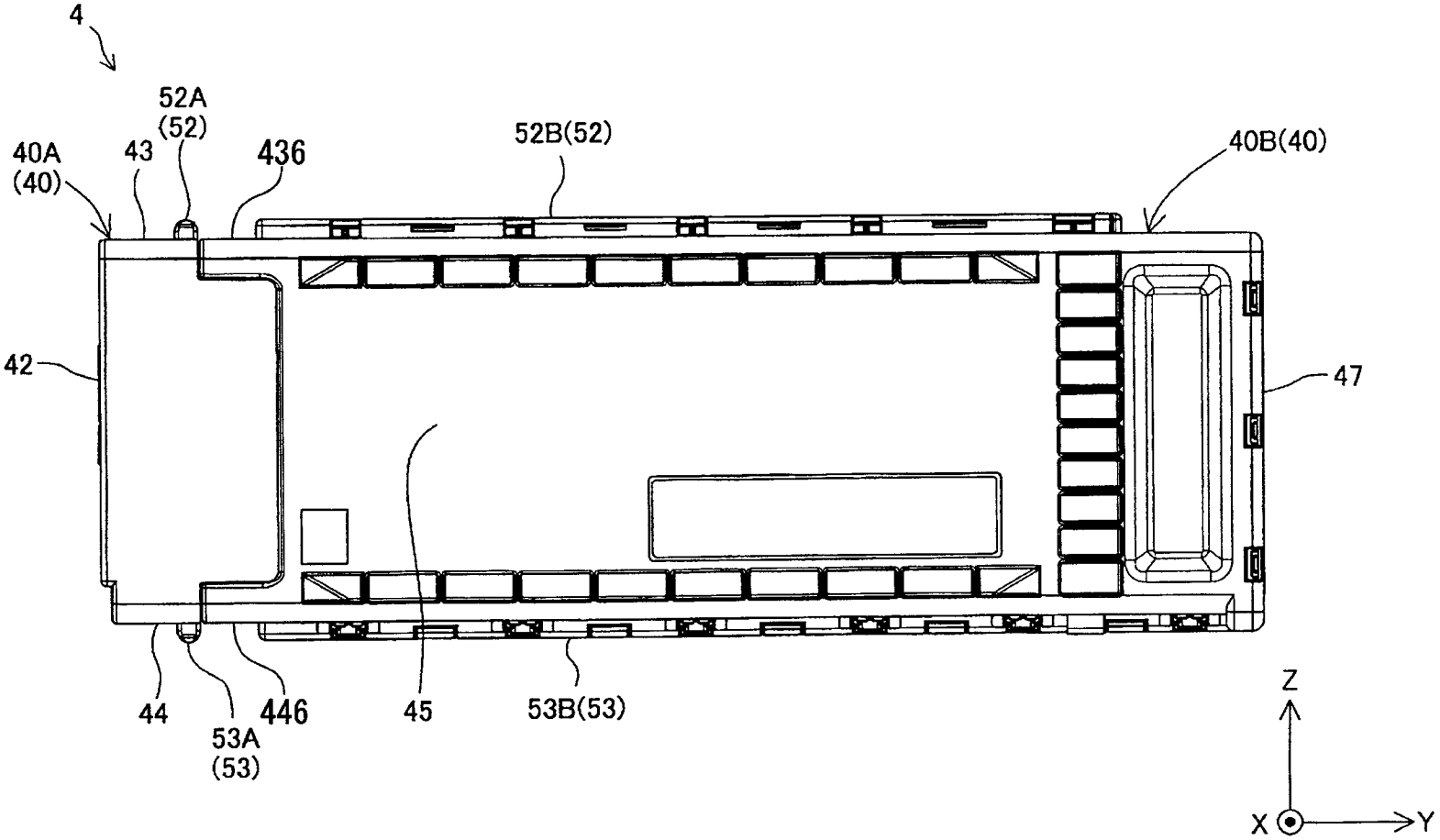
FIG. 7 is a side view of the printing material holding container 4.

A-3. External View Constitution of Printing Material Holding Container:

Next, we will explain the external appearance structure of the printing material holding container 4 using FIG. 5 to FIG. 7. FIG. 5 is an external appearance perspective view of the printing material holding container 4. FIG. 6 is a front view of the printing material holding container 4. FIG. 7 is a side view of the printing material holding container 4.

As shown in FIG. 5, the printing material holding container 4 external shape is generally a solid rectangle shape. The printing material holding container 4 is equipped with a case 40. The case 40 is equipped with an alignment member 40A in which the liquid supply needle 82 and the rod shaped member 92 of the printing material holding container mounting unit 6 are inserted, and a protective member 40B attached to the alignment member 40A. The protective member 40B is attached provided with a clearance so that it can move slightly in relation to the alignment member 40A. The case 40 holds in its interior a liquid holding portion (liquid reservoir portion) 84, and a member for attachment 190 for which an internal flow path for flowing the ink of the liquid holding portion 84 through to the liquid supply needle 82 is formed. In more detail, the member for attachment 190 is attached to the inside of the alignment member 40A. Also, the liquid holding portion 84 is held inside the protective member 40B. We will give a detailed description of the constitution of the liquid holding portion 84 and the member for attachment 190 later. Here, the alignment member 40A and the member for attachment 190 are structural members of the mounting member 40C described later.

The printing material holding container 4 is equipped with a front wall 42, a back wall 47, a first side wall 43, a second side wall 44, a third side wall 45, and a fourth side wall 46. The first side wall 43 is also called the top wall 43, the second side wall 44 is also called the bottom wall 44, the third side wall 45 is also called the right side wall 45, and the fourth side wall 46 is also called the left side wall 46. The front wall 42 and the back wall 47 face opposite each other. The first side wall 43 and the second side wall 44 face opposite each other. The third side wall 45 and the fourth side wall 46 face opposite each other.

As shown in FIG. 4 and FIG. 5, formed on the front wall 42 are a supply needle insertion hole (also called the "first insertion hole") 440 in which the liquid supply needle 82 is inserted and a rod insertion hole (also called the "second insertion hole") 420 in which the rod member 9 is inserted. As shown in FIG. 6, the second insertion hole 420 has a shape for which with the first part 421 of the −Y axis direction side, the cross section parallel to the X axis direction and the Z axis direction (XZ cross section) is a circle, and compared to the first part 421, the second part 422 of the +Y axis direction side has the maximum dimension of the Z axis direction smaller than the maximum dimension of the X axis direction in the XZ cross section.

As shown in FIG. 5 and FIG. 6, the first side wall 43 has a first convex part 52. The first convex part 52 is inserted in the first rail 682 (FIG. 3). The first convex part 52 has a first A part 52A provided on the alignment member 40A, and a first B part 52B provided on the protective member 40B. The first A part 52A and the first B part 52B are arranged via a designated space part. In the mounted state, the plate spring 684 (FIG. 3) is entered in the designated space part between the first A part 52A and the first B part 52B. By doing this, the plate spring 684 biases the first A part 52A to the device side front wall part 62 side (printing material holding container 4 insertion direction side, −Y axis direction side).

As shown in FIG. 6 and FIG. 7, the second side wall 44 has a second convex part 53. The second convex part 53 is inserted in the second rail 602 (FIG. 4). The second convex part 53 has a second A part 53A provided on the alignment member 40A, and a second B part 53B provided on the protective member 40B. The second A part 53A and the second B part 53B are arranged via a designated space part. In the mounted state, the plate spring 604 (FIG. 4) is entered in a designated space part between the second A part 53A and the second B part 53B. By doing this, the plate spring 604 biases the second A part 53A to the device side front wall part 62 side (printing material holding container 4 insertion direction side, −Y axis direction side).

As noted above, by the plate spring 684 biasing the first A part 52A to the −Y axis direction side, and the plate spring 604 biasing the second A part 53A to the −Y axis direction side, the movement of the printing material holding container 4 in the mounted state is regulated in the +Y axis direction.

As shown in FIG. 5, a recess 51 is formed at the corner at which the front wall 42 and the first side wall 43 intersect. The circuit substrate 100 is arranged in the recess 51. As shown in FIG. 6, a printing material holding container side terminal group 521 consisting of a plurality of terminals is arranged on the surface of the circuit substrate 100. With this embodiment, there are nine terminals of the printing material holding container side terminal group 521. Also, the nine terminals are rectangular. Also, a storage device is arranged on the back surface of the circuit substrate 100. Information relation to the printing material holding container 4 (e.g. the ink color) is stored in the storage device. The printing material holding container side terminal group 521 and the storage device are electrically connected. The recess 51 is provided on the alignment member 40A.

A regulating surface 451 is provided at the corner at which the front wall 42 and the second side wall 44 intersect. The regulating surface 451 is a surface facing the −Y axis direction (insertion direction). When the printing material holding container 4 is mounted on the printing material holding container mounting unit 6, by the regulating surface 451 abutting the regulating member 612 (FIG. 4), the movement of the printing material holding container 4 in the −Y axis direction is regulated.

As shown in FIG. 6, the second insertion hole 420 is provided at an intermediate position of the first side wall 43 and the second side wall 44 of the front wall 42. Said another way, it is provided at an intermediate position that connects the first side wall 43 and the second side wall 44 in the Z axis direction. Specifically, the central axis Ce of the second insertion hole 420 is arranged at an intermediate position of the first side wall 43 and the second side wall 44 in the Z axis direction. Here, "intermediate position" does not have to be perfectly in the middle, and can also be arranged skewed toward either direction of the first side wall 43 and the second side wall 44. For example, "intermediate position" includes a position within a range within 10% from the center position Vh in relation to a distance Th in the Z axis direction of the first side wall 43 and the second side wall 44. In other words, in the case when the distance from the first side wall 43 to the central axis Ce of the second insertion hole 420 is Tha, and the distance from the second side wall 44 to the central axis Ce of the second insertion hole 420 is Thb, the "intermediate position" does not only mean a case when Tha and Thb are perfectly equal, in other words, when $Tha=Thb=0.5\times Th$. "Intermediate position" includes positions for which $0.4\times Th\leq Tha\leq 0.6\times Th$ or $0.6\times Th\geq Thb\geq 0.4\times Th$. This is because as long as it is within this range, it is possible to sufficiently obtain the effect of the invention. As long as it is within this range, at a glance, it does not look like the second insertion hole 420 is arranged skewed toward one of either the first side wall 43 or the second side wall 44. To have the central axis Ce arranged more to the middle, the "intermediate position" preferably includes positions within a range within 7.5% from the center position Vh in relation to the distance of the first side wall 43 and the second side wall 44 in the Z axis direction.

Figure 8:
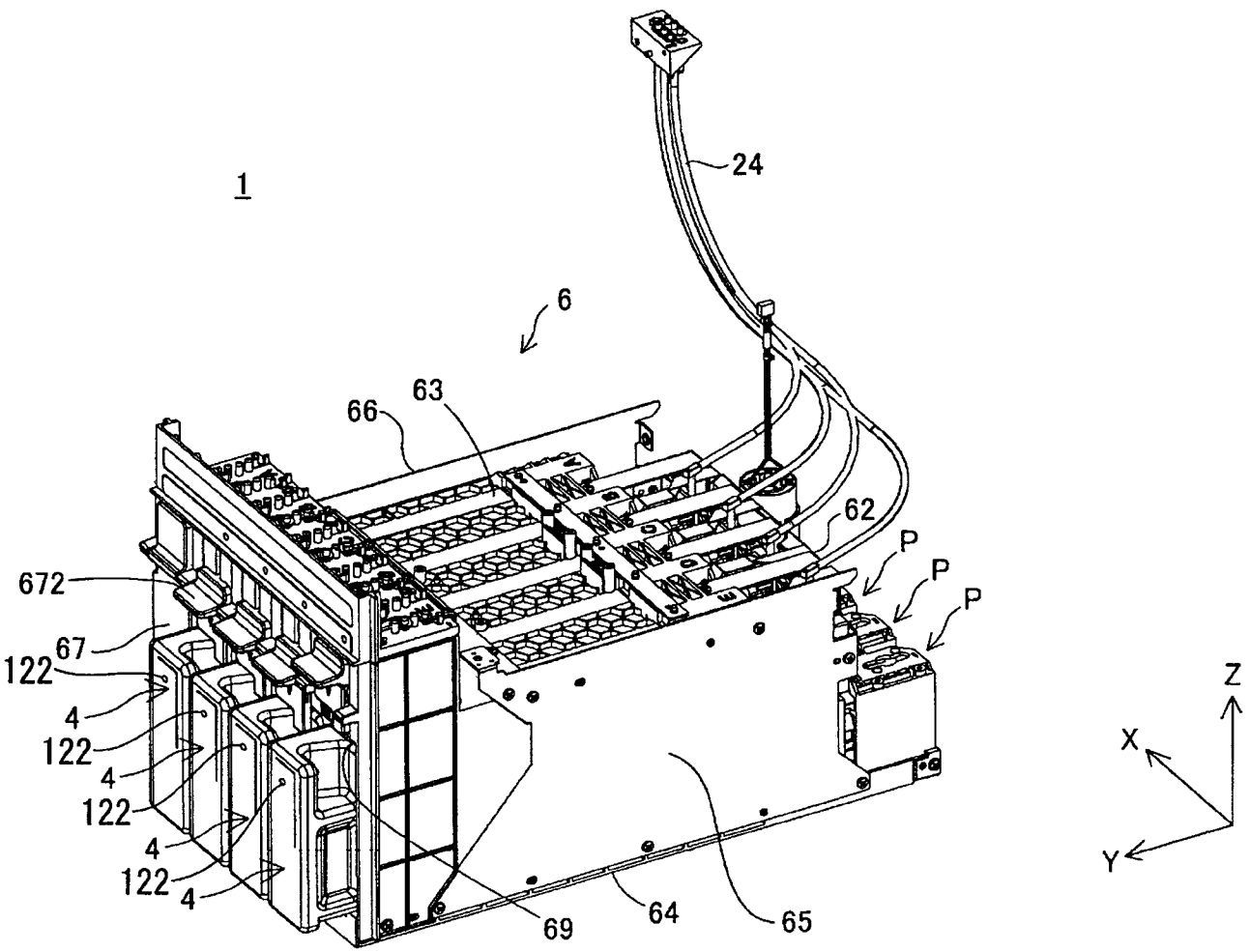
FIG. 8 is an external appearance perspective view when the printing material holding container 4 is mounted on the printing material holding container mounting unit 6.
Figure 9:
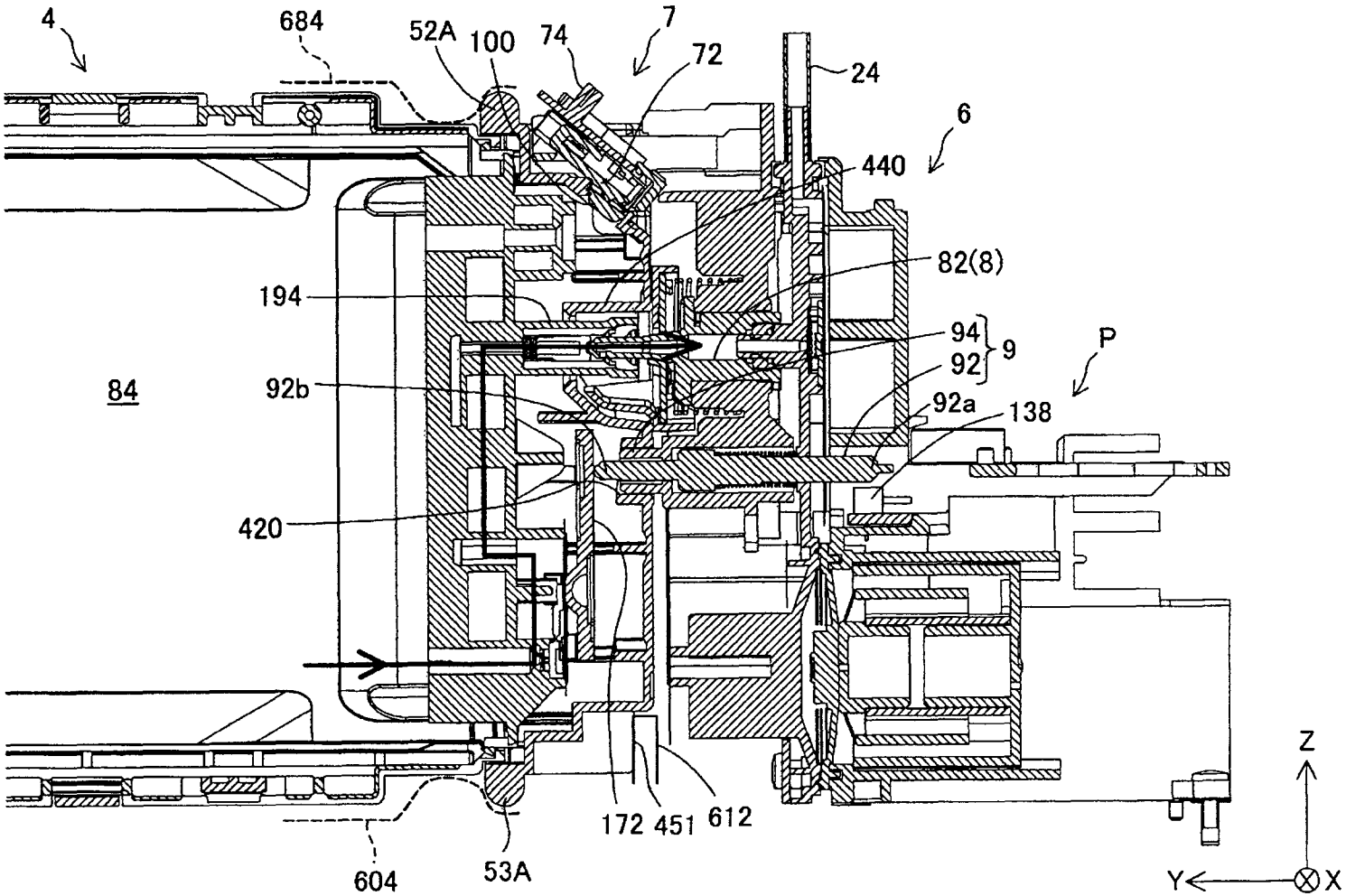
FIG. 9 is a cross section view of the F8-F8 part of FIG. 8.

A-4. Description of Mounted State:

Before giving a detailed description of the constitution of the printing material holding container 4, we will describe the relationship of the printing material holding container mounting unit 6 and the printing material holding container 4 in the mounted state using FIG. 8 and FIG. 9. FIG. 8 is an external appearance perspective view of when the printing material holding container 4 is mounted in the printing material holding container mounting unit 6. FIG. 9 is a cross section view of the F8-F8 part of FIG. 8. FIG. 9 illustrates the device side front wall part 62 of the printing material holding container mounting unit 6, and also typically shows the regulating member 612 and the plate springs 684 and 604.

As shown in FIG. 8, in the mounted state, the printing material holding container 4 is mounted in the printing material holding container mounting unit 6 with a portion of the +Y axis direction side exposed from the opening 69. As shown in FIG. 9, in the mounted state, the device side terminal group 721 and the circuit substrate 100 are electrically connected. Also, the liquid supply needle 82 is inserted in the first insertion hole 440. Also, the liquid supply needle 82 is connected to a liquid supply port 194 for flowing the ink of the liquid holding portion 84 to the outside. "Connected to the liquid supply port 194" means the state of ink of the liquid holding portion 84 being able to flow from the liquid supply port 194 to the printer 10 side. The flow of the ink from the liquid holding portion 84 to the liquid supply needle 82 is typically shown by an arrow.

Also, in the mounted state, the rod member 9 is inserted in the second insertion hole 420. Also, in the mounted state, the +Y axis direction side end part 92*b* (also called the "other end part 92*b*") of the rod shaped member 92 abuts the moving member 172 of the printing material holding container 4. The moving member 172 is a part of the detection mechanism and is described in detail later. The −Y axis direction side end part 92*a* (also called "one end part 92*a*") of the rod shaped member 92 has displacement detected by the optical sensor 138 of the printer 10. The sensor 138 is a part of the detection mechanism, and will be described in detail later. Also, in the mounted state, the regulating surface 451 abuts the regulating member 612. Also, in the mounted state, the plate spring 684 biases the first A part 52A to the −Y axis direction side, and the plate spring 604 biases the second A part 53A to the −Y axis direction side.

In the mounted state, with the printing material holding container 4 (more specifically, the alignment member 40A), the movement of three directions (X axis direction, Y axis direction, and Z axis direction) parallel to the three mutually orthogonal axes (X axis, Y axis, and Z axis) including the attachment/detachment coordinate axis is regulated by the printing material holding container mounting unit 6. More specifically, in the mounted state, the alignment member 40A is aligned in relation to the print material holding container mounting unit 6 by the movement of the three directions of the X axis direction, the Y axis direction, and the Z axis direction being regulated by the printing material holding container mounting unit 6. Specifically, in the mounted state, the X axis direction movement of the alignment member 40A is regulated by the first A part 52A being inserted in the first rail 682 (FIG. 3), and the second A part 53A being inserted in the second rail 602 (FIG. 4). Also, in the mounted state, the Y axis direction movement of the alignment member 40A is regulated by doing as described hereafter. Specifically, the +Y axis direction movement of the alignment member 40A is regulated by the first A part 52A being biased to the −Y axis direction side by the plate spring 684, and the second A part 53A being biased to the −Y axis direction side by the plate spring 604. Also, the −Y axis direction movement of the alignment member 40A is regulated by the regulating surface 451 abutting the regulating member 612. Also, in the mounted state, the Z axis direction movement of the alignment member 40A is regulated by the rod member 9 being inserted in the second insertion hole 420.

Figure 10:
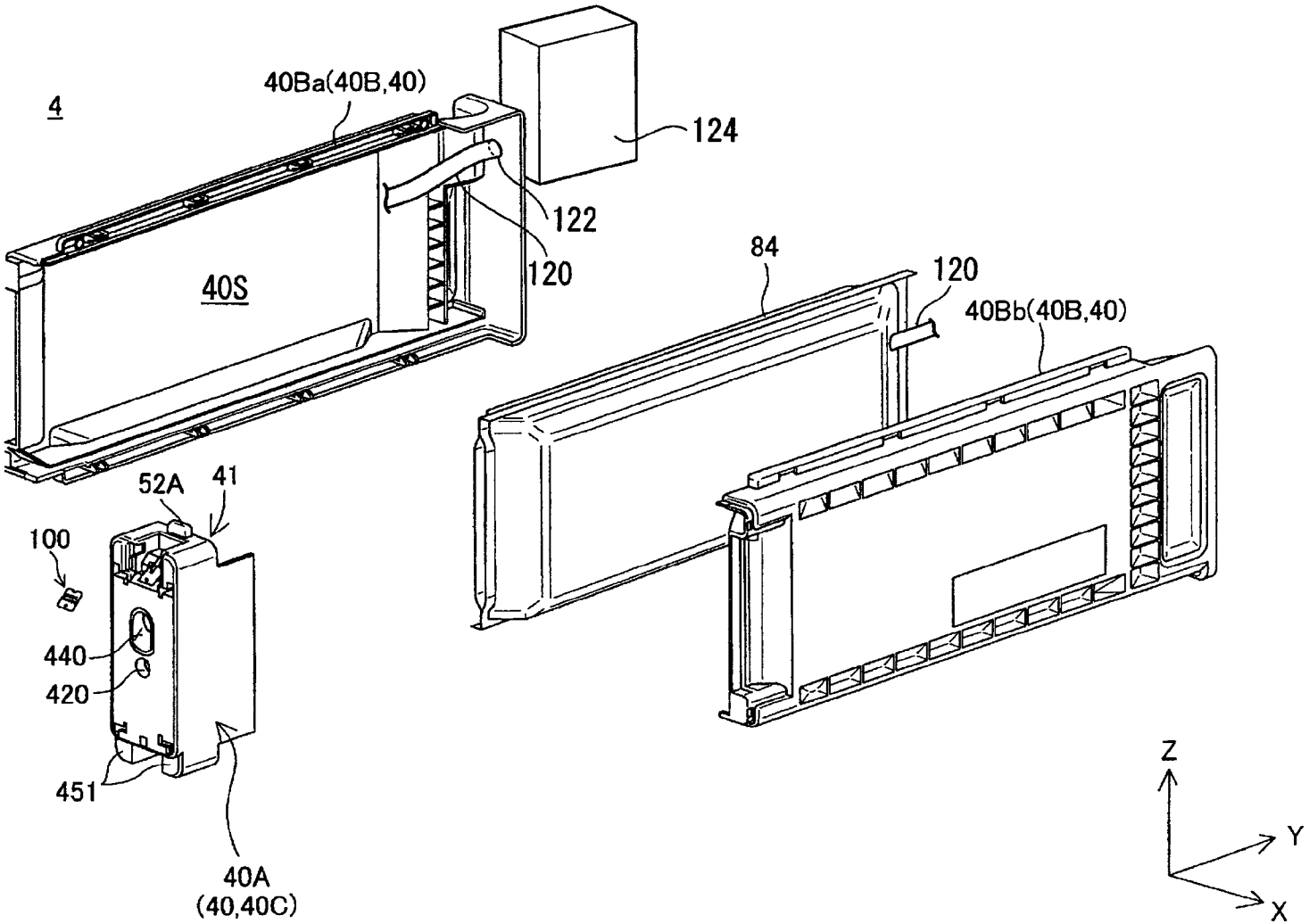
FIG. 10 is a first exploded perspective view of the printing material holding container 4.
Figure 11:
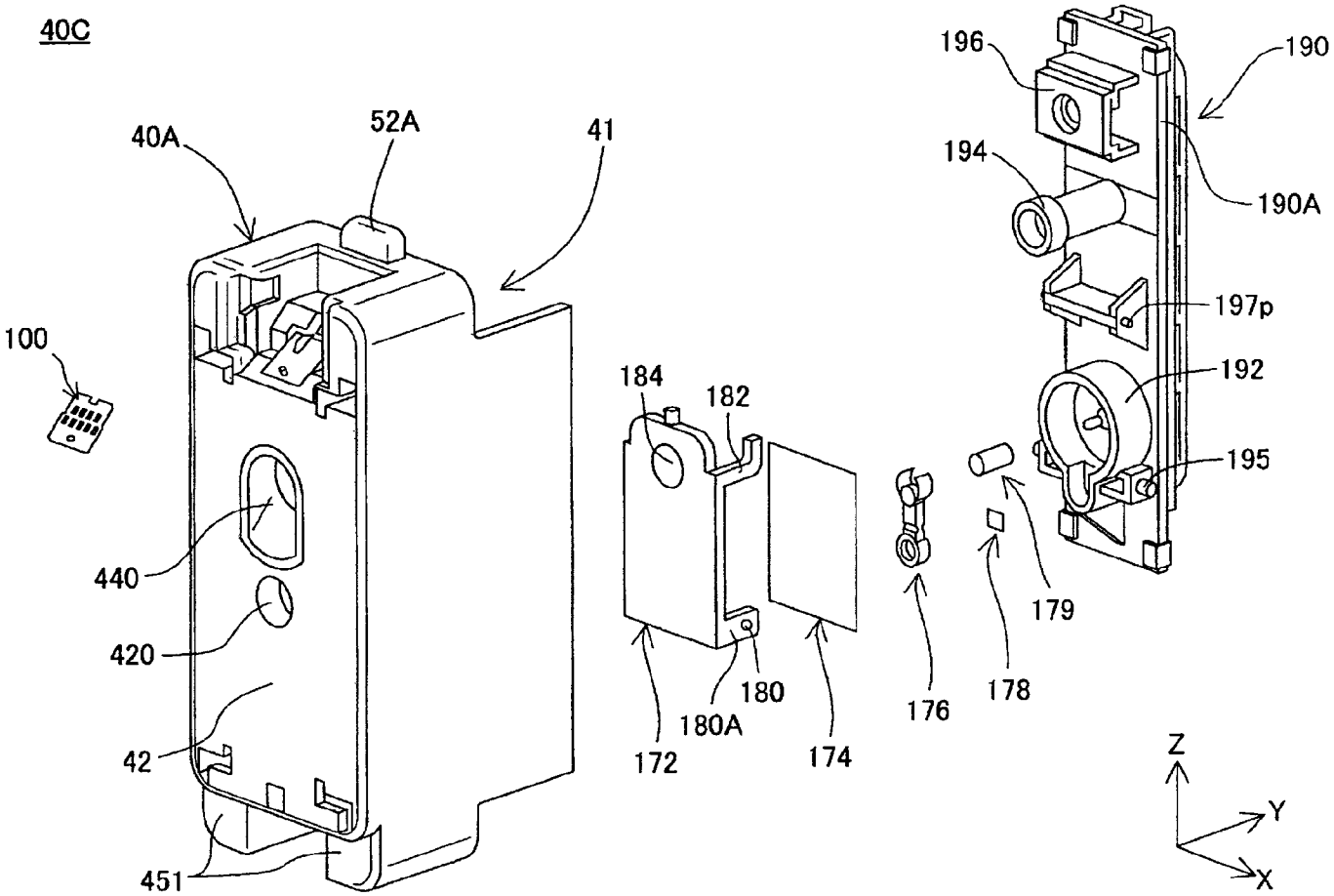
FIG. 11 is an exploded perspective view of the side part of the mounting member 40C.
Figure 12:
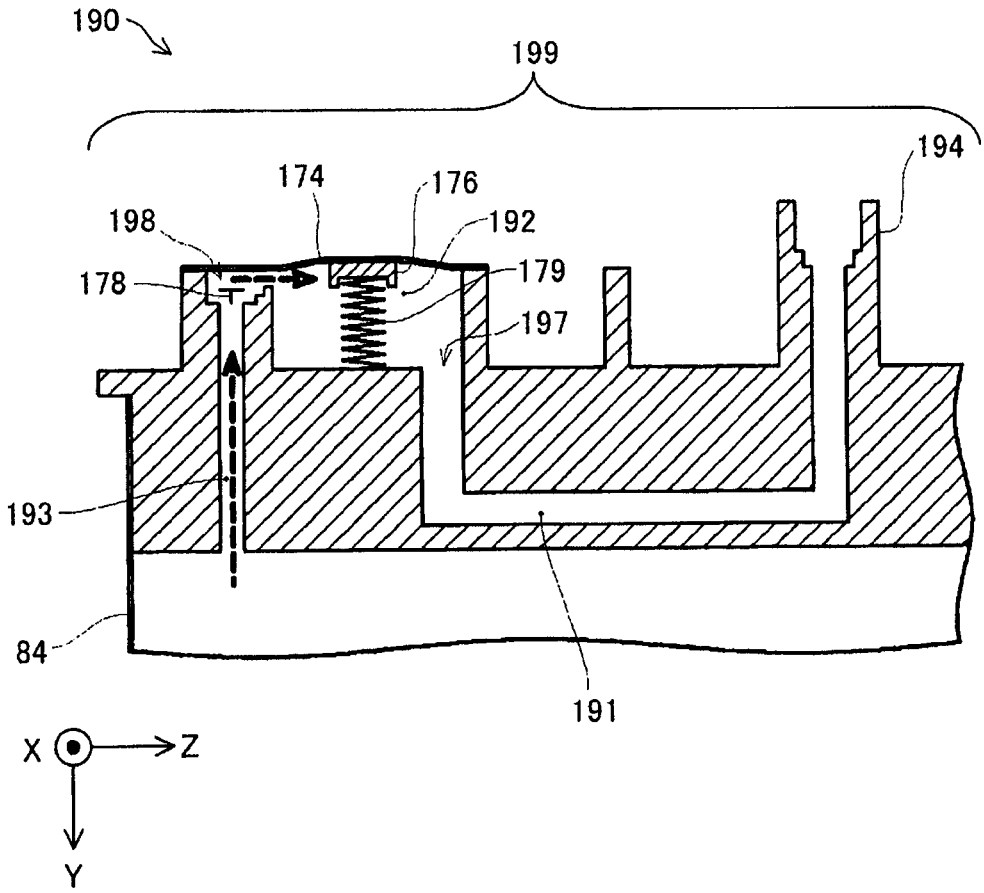
FIG. 12 is a first drawing for explaining the internal flow path 199.
Figure 13:
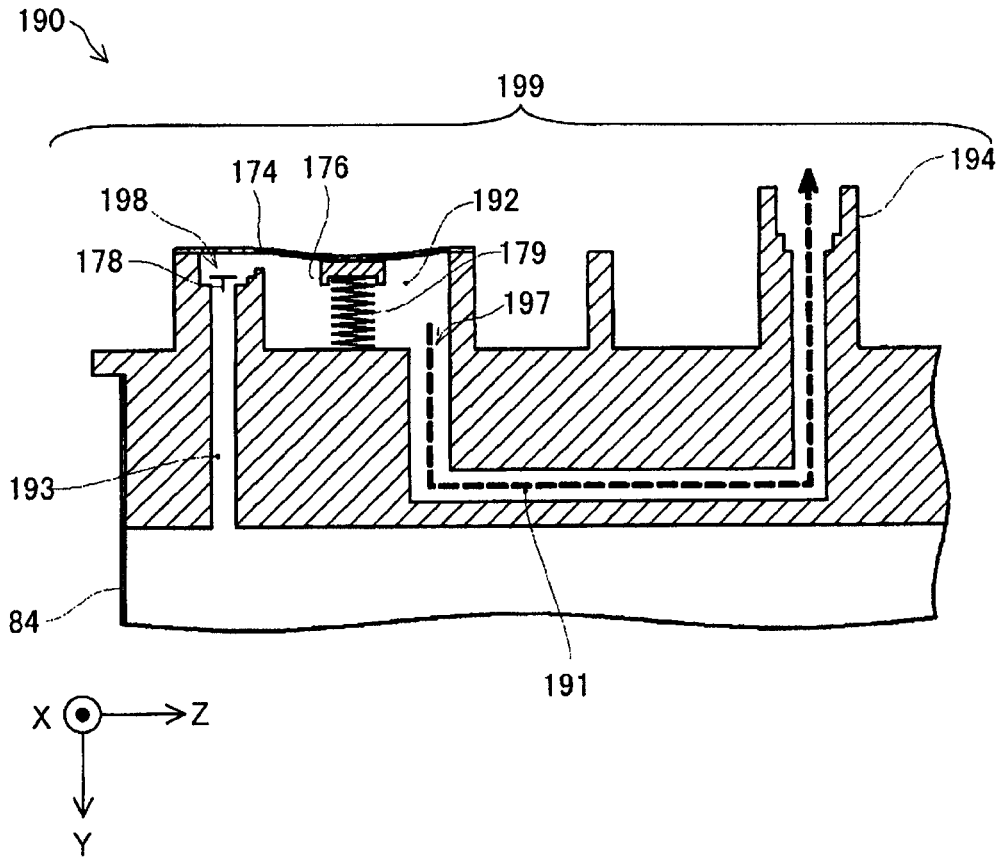
FIG. 13 is a second drawing for explaining the internal flow path 199.

A-5. Detailed Constitution of Printing Material Holding Container 4:

Next, we will give a detailed description of the constitution of the printing material holding container 4. FIG. 10 is a first exploded perspective view of the printing material holding container 4. FIG. 11 is an exploded perspective view of the side part of the mounting member 40C. FIG. 12 is a first drawing for explaining the internal flow path 199. FIG. 13 is a second drawing for explaining the internal flow path 199. FIG. 12 and FIG. 13 typically show the internal flow path 199. Also, FIG. 12 shows the situation when the suction pump P is not operating, and FIG. 13 shows the situation when the suction pump P is operating. An illustration of the moving member 172 is omitted in FIG. 12 and FIG. 13.

As shown in FIG. 10 and FIG. 11, the liquid holding portion 84, the member for attachment 190, and the moving member 172 are held in the case 40 of the printing material holding container 4. Here, as shown in FIG. 10, the liquid holding portion 84 is held in the internal space 40S of the protective member 40B. Also, as shown in FIG. 11, the member for attachment 190 and the moving member 172 attached to the member for attachment 190 are held in the alignment member 40A that constitutes a portion of the case 40. The member for attachment 190 is equipped with plate shaped member to be abutted 190A having a designated thickness in the Y axis direction. The member to be abutted 190A has movement in three directions of the member for attachment 190 regulated by abutting the alignment member 40A. The alignment member 40A is a box shape that is open in one direction. The opening 41 is formed on the +Y axis direction side. The first insertion hole 440 and the second insertion hole 420 are formed on the bottom part 42 which becomes the front wall 42. With the bottom part 42, the direction facing opposite the opening 41 is the attachment/detachment direction (Y axis direction). Also, the direction facing the opening 41 from the bottom part 42 is the +Y axis direction, and the direction facing from the opening 41 to the bottom part 42 is the −Y axis direction.

The member for attachment 190 forms an internal flow path 199 (FIG. 12, FIG. 13) for linking the liquid holding portion 84 and the external part (printer 10). The moving member 172 is provided at a position facing opposite the other end part 92*b* of the rod shaped member 92.

As shown in FIG. 10, the protective member 40B is formed by assembling the first protective member 40Ba and the second protective member 40Bb. The liquid holding portion 84 is formed by an aluminum laminate multi-layer film formed by laminating an aluminum layer on a resin film layer, for example. The liquid holding portion 84 (correlating to the "first liquid holding portion" of the Means for Solving the Problems) has flexibility, and is constituted to be able to deform together with the consumption of liquid. A liquid injection flow path 120 is provided between the +Y axis direction end part of the liquid holding portion 84 and the protective member 40B (back wall 47 of the printing material holding container 4). With the liquid injection flow path 120, one end is connected to the liquid injection port 122 that opens to the back wall 47 of the printing material holding container 4, and the other end is connected to the +Y axis direction end part of the liquid holding portion 84, making it possible to supply ink to the inside of the liquid holding portion 84 from the outside. For the liquid injection flow path 120, it is possible to use a resin tube or the like, and also possible to form it as an integral unit with the liquid holding portion 84 using an aluminum laminate multi-layer film. An external liquid holding portion 124 (correlating to the "second liquid holding portion" of the Means for Solving the Problems) is linked to the liquid injection port 122 that opens at the back wall 47 of the printing material holding container 4. The external liquid holding portion 124, the same as the liquid holding portion 84, is formed from an aluminum laminate multi-layer film formed by laminating an aluminum layer on a resin film layer. The external liquid holding portion 124 has flexibility, and is constituted to be able to deform together with the consumption of liquid. A sealing seal (not illustrated) is provided for preventing penetration of outside air into the linked part of the liquid injection port 122 and the external liquid holding portion 124 or the like. The liquid holding portion 84 is linked to be sealed tight with the external liquid holding portion 124, so the liquid holding portion 84, the liquid injection flow path 120, and the external liquid holding portion 124 are an integrated unit, and constitute a sealed type liquid holding portion. In other words, the liquid holding portion 84, the liquid injection flow path 120, and the external liquid holding portion 124 are sealed so as not to allow inflow of the atmosphere (air). Because of this, as the ink held in the liquid holding portion 84 and the external liquid holding portion 124 decreases, the capacity of the liquid holding portion 84 and the external liquid holding portion 124 decreases. When the ink held in the liquid holding portion 84 and the external liquid holding portion 124 is consumed and runs out, it is possible to remove the external liquid holding portion 124 and supply liquid from the liquid injection port 122 to the liquid holding portion 184. Furthermore, by linking a new external liquid holding portion 124 filled with liquid to the liquid injection port 122, the liquid holding portion 84, the liquid injection flow path 120, and the external liquid holding portion 124 are repeatedly used as the sealed type liquid holding portion. Any external shape (liquid holding capacity) can be used for the external liquid holding portion 124. It is also possible to not link the external liquid holding portion 124 to the printing material holding container 4. In this case, it is necessary to insert a plug (not illustrated) in the liquid injection port 122 so there is no inflow of air into the liquid holding portion 84.

As shown in FIG. 12 and FIG. 13, of the internal flow path 199, in the flow direction in which the ink flows from the liquid holding portion 84 to the printer 10, the upstream side is linked to the liquid holding portion 84, and the liquid supply needle 82 is inserted at the downstream side. This downstream side part (one end part) is also called the liquid supply port 194. The liquid supply port 194 is generally a round cylinder shape.

As shown in FIG. 12, the internal flow path 199 has a liquid chamber 192 midway (correlating to the "third liquid portion" noted in the Means for Solving the Problems). On the liquid chamber 192 are opened an inflow port 198 for which ink inflows into the liquid holding portion 84 and an outlet port 197 for which ink flows out toward the liquid supply port 194. Also, the liquid chamber 192 is formed by a film 174 formed using a material for which the top end surface which is one side surface is flexible. The liquid chamber 192 capacity changes as the film 174 is deformed along with changes in the internal pressure. This film 174 correlates to the "deformation member" noted in the Means for Solving the Problems.

As shown in FIG. 11 to FIG. 13, inside the liquid chamber 192 are arranged a check valve 178 and a spring 179 (correlating to the "biasing member" noted in the Means for Solving the Problems). The check valve 178 prevents backflow of ink flowing into the liquid chamber 192 from the inflow port 198. The spring 179 biases the film 174 toward the outside of the liquid chamber 192. Specifically, the spring 179 biases the film 174 in the direction for which the capacity of the liquid chamber 192 increases. More specifically, the spring 179 is arranged in a compressed state in the liquid chamber 192. Also, a pressure plate 176 is inserted between the spring 179 and the film 174. The item including this film 174, or the film 174 and the spring 179, or the film 174, the spring 179, and the pressure plate 176 correlates to the "deformation unit" noted in the Means for Solving the Problems. The film 174 constitutes at least a part of the wall constituting the liquid chamber 192.

Also, the moving member 172 contacts the film 174 that constitutes one end surface of the liquid chamber 192 from the outside of the liquid chamber 192. The moving member 172 is attached to the member for attachment 190 so as to be able to be displaced with a designated rotation fulcrum point as the center. As shown in FIG. 11, the moving member 172 has an attachment part 180A attached to the moving member 172 at the −Z axis direction side. The attachment part 180A has a shaft hole 180. The moving member 172 is axially supported on the axis pin 195 so as to be able to rotate by the shaft hole 180 fitting with the axis pin 195 provided on the outer surface of the liquid chamber 192. Meanwhile, as shown in FIG. 11, the moving member 172 is provided with a guide part 182 on the +Z axis direction side. By the guide part 182 contacting a guide pin 197*p* provided on the member for attachment 190, the rotational operation of the moving member 172 is guided. Of the moving member 172, at the surface of the side opposite to the surface in contact with the film 174, in the mounted state, a contact part 184 (also called the "second contact part 184") abutting the other end part 92*b* of the rod shaped member 92 is formed.

Also, the member for attachment 190 is equipped with an injection port 196. The injection port 196 links the outside and the liquid holding portion 84, and is used to inject ink from the outside into the liquid holding portion 84. After the ink is filled in the liquid holding portion 84, the linking flow path inside the injection port 196 is blocked.

Using the member to be equipped 190 having this kind of constitution, ink is supplied from the liquid holding portion 84 to the printer 10 by doing as described hereafter.

As shown in FIG. 12, when the suction pump P of the printing material holding container mounting unit 6 is not operating, the spring 179 presses the film 174 so that the capacity of the liquid chamber 192 increases. Along with the increase in capacity of the liquid chamber 192, ink passes through the inflow path 193 linking the liquid holding portion 84 and the inflow port 198 and flows into the liquid chamber 192. The dotted line arrow in the drawing represents the flow of ink.

When the suction pump P of the printing material holding container mounting unit 6 operates, the ink is suctioned from the liquid supply port 194, and the ink inside the liquid chamber 192 is supplied to the printing material holding container mounting unit 6 through the outlet path 191 linking the outlet port 197 and the liquid supply port 194. Then, with the printing material holding container 4 of this embodiment, the inner diameter of the outlet path 191 is set to be larger than the inner diameter of the inflow path 193, so the ink inflow volume to the liquid chamber 192 cannot keep up with the ink outlet volume from the liquid chamber 192, and the interior of the liquid chamber 192 becomes negative pressure. Because of this, as shown in FIG. 13, in resistance to the force of the spring 179, the film 174 deforms so as to be drawn into the inside of the liquid chamber 192.

This negative pressure generated inside the liquid chamber 192 is gradually consumed by the ink of the liquid holding portion 84 inflowing to the liquid chamber 192 through the inflow path 193. As a result, with the force of the spring 179, the film 174 is again pressed to the outside of the liquid chamber 192, and the capacity of the liquid chamber 192 is restored. By doing this, after a designated time has elapsed since the suction pump P of the printing material holding container mounting unit 6 stops, this returns to the state shown in FIG. 12. When the suction pump P of the printing material holding container mounting unit 6 operates again, the interior of the liquid chamber 192 becomes negative pressure, and this goes to the state whereby the film 174 is drawn into the inside of the liquid chamber 192 as shown in FIG. 13. Meanwhile, when the ink of the liquid holding portion 84, or of the liquid holding portion 84 and the external liquid holding portion 124 is consumed and runs out, even if the interior of the liquid chamber 192 is negative pressure, the ink stops flowing into the liquid chamber 192. Specifically, even after a designated time has elapsed after the operation of the suction pump P stops, the negative pressure within the liquid chamber 192 is not consumed, and the film 174 is left in the state drawn into the inside within the liquid chamber 192 as shown in FIG. 13.

In this way, when the ink within the liquid holding portion 84, or within the liquid holding portion 84 and the external liquid holding portion 124 runs out, the film 174 of the liquid chamber 192 stays in the same state of being deformed so as to be drawn into the inside of the liquid chamber 192. Specifically, it is possible to detect the ink end state by detecting displacement of the film 174. However, the displacement volume of the film 174 is small, so the displacement volume is amplified using the moving member 172 as noted hereafter.

Figure 14:
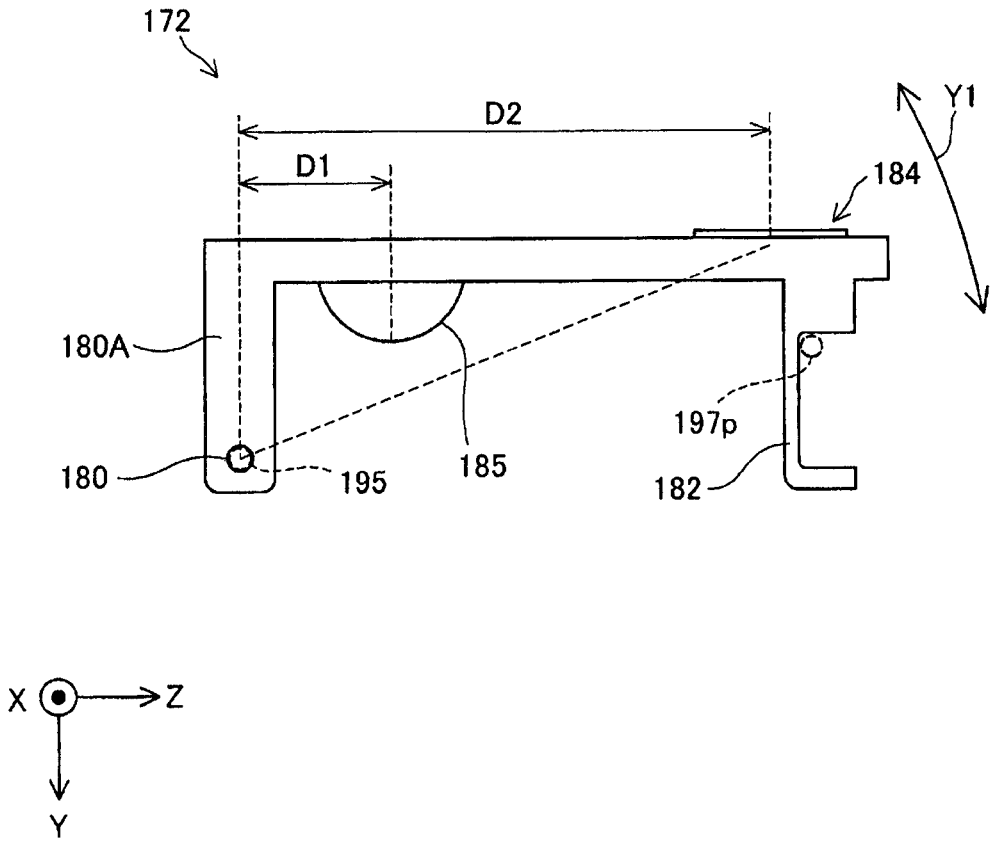
FIG. 14 is a drawing for explaining the moving member 172.

FIG. 14 is a drawing for explaining the moving member 172. The moving member 172 has a first contact part 185, a second contact part 184, and an attachment member 180A on which is formed the shaft hole 180. The first contact part 185 is a hemispherical convex part that contacts the film 174. The second contact part 184 contacts the rod shaped member 92 (FIG. 9). Also, the second contact part 184 external shape is a round convex part. The second contact part 184 is positioned at the side opposite the shaft hole 180 sandwiching the first contact part 185 in the direction orthogonal to the attachment/detachment direction (Y direction) (with this embodiment, the Z axis direction) of the printing material holding container 4. Specifically, the distance D2 from the shaft hole 180 that is the rotational fulcrum point of the moving member 172 to the second contact part 184 is greater than the distance D1 from the shaft hole 180 to the first contact part 185. As a result, when the film 174 contacting the first contact part 185 is displaced, that displacement volume is amplified by lever ratio R (=D2/D1>1, with this embodiment, 3.1), and becomes the displacement volume of the second contact part 184. Here, the second contact part 184 has the shaft hole 180 as the rotational fulcrum point, and is displaced in the arrow Y1 direction. The arrow Y1 direction is the direction including the element of the direction (Y axis direction) along the attachment/detachment coordinate axis (Y axis).

Figure 15:
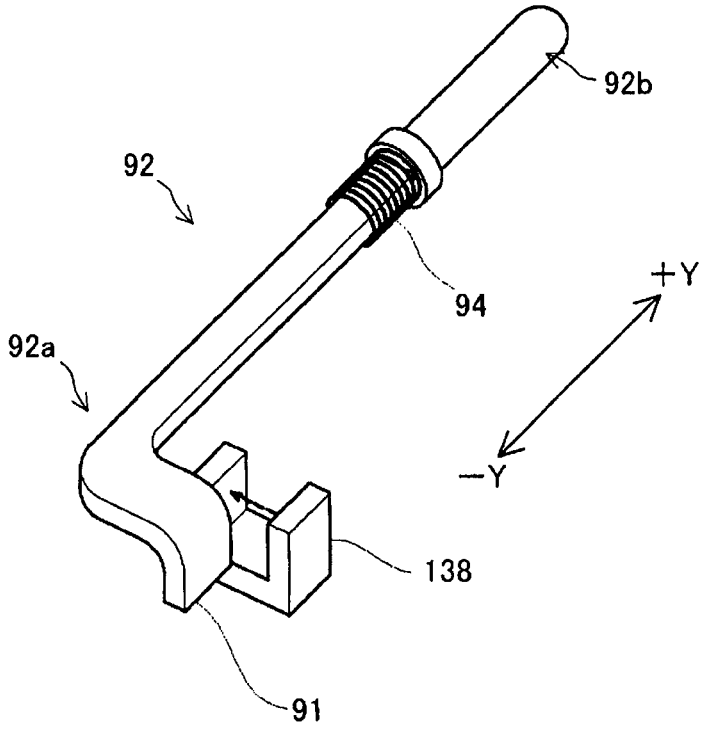

A-6. Method of Detecting the Residual Ink Volume State:

FIG. 15 is a schematic structural drawing of the rod shaped member 92 and the sensor 138 that the printing material holding container mounting unit 6 is equipped with. As shown in FIG. 15, the spring 94 is attached to the rod shaped member 92. The spring 94 biases the rod shaped member 92 toward the printing material holding container 4 mounted on the printing material holding container mounting unit 6.

The sensor 138 is a concave-shaped so-called transmission type photo sensor. A light receiving unit and light emitting unit (not illustrated) are provided facing opposite each other on this sensor 138, and the light emitted by the light emitting unit is received by the light receiving unit. Moreover, the dotted line arrow in the drawing shows the light transmission direction.

The one end part 92*a* of the rod shaped member 92 has a light shielding unit 91. When the rod shaped member 92 is moved by the force of the spring 94 to the printing material holding container 4 side (+Y axis direction side), the light shielding unit 91 is inserted between the light receiving unit and the light emitting unit of the sensor 138, and blocks light from the light emitting unit. As a result, light from the light emitting unit cannot be received at the light receiving unit of the sensor 138, and it is possible to detect displacement of the one end part 92*a* of the rod shaped member 92. A transmission type photo sensor is used for the sensor 138 of this embodiment, but any item that is able to detect displacement of the rod shaped member 92 is acceptable, and this is not limited to a photo sensor.

Figure 16:
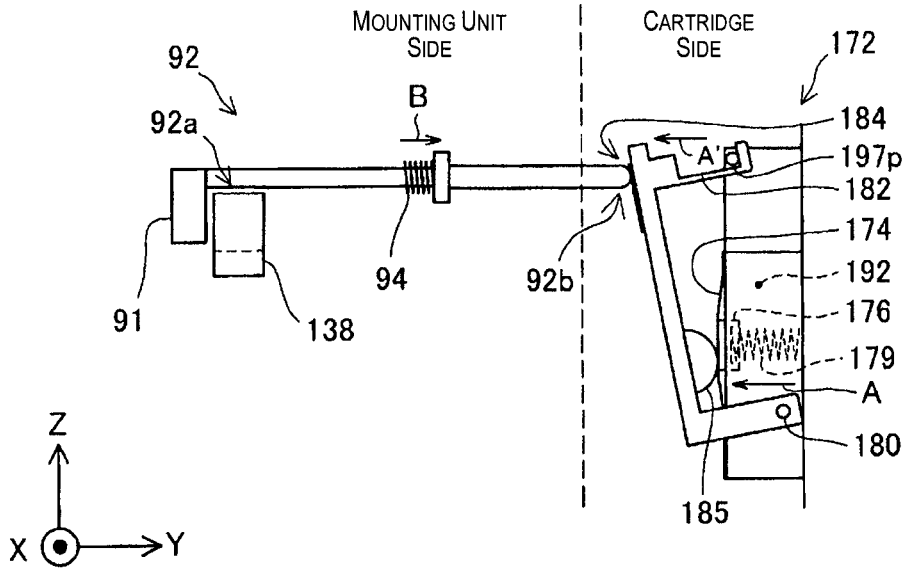
FIG. 16 is a first drawing for explaining the detection method of the residual ink volume state.
Figure 17:
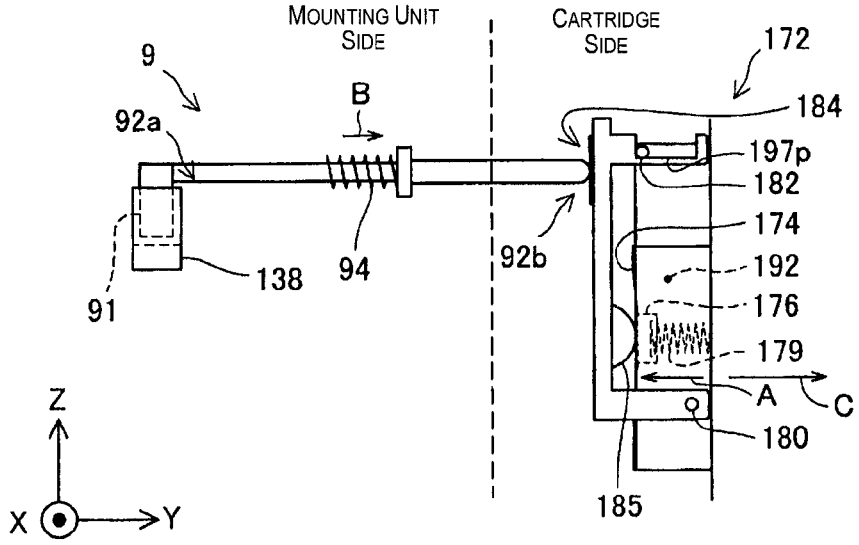
FIG. 17 is a second drawing for explaining the detection method of the residual ink volume state.

FIG. 16 is a first drawing for explaining the detection method of the residual ink volume state. FIG. 17 is a second drawing for explaining the detection method of the residual ink volume state. FIG. 16 is a drawing showing the state when ink is sufficiently held in the liquid holding portion 84. FIG. 17 is a drawing showing when the ink of the liquid holding portion 84 is at the ink end state.

As shown in FIG. 16, when the printing material holding container 4 in a state with sufficient ink remaining is mounted in the printing material holding container mounting unit 6, the other end part 92*b* of the rod shaped member 92 abuts the contact part 184 of the moving member 172 provided on the printing material holding container 4 side. Here, the bias force A' applied to the contact part 184 of the moving member 172 by the bias force A of the spring 179 of the printing material holding container 4 is set so as to be greater than the bias force B of the spring 94. By doing this, when the other end part 92*b* of the rod shaped member 92 abuts the moving member 172, in resistance to the bias force B of the spring 94, the rod shaped member 92 moves to the inward side (−Y axis direction side) of the printing material holding container mounting unit 6. As a result, the light shielding unit 91 of the rod shaped member 92 separates from the sensor 138, so the sensor 138 is in a state transmitting light. In this way, the sensor 138 is able to detect that the printing material holding container 4 is mounted in the printing material holding container mounting unit 6 based on the change from the light shielded state to the transmitted state by the movement of the light shielding unit 91 of the rod shaped member 92. Until the ink within the liquid holding portion 84 runs out or the remainder is low, this state will be maintained. In this state, as long as there are no other abnormalities within the printing material holding container 4 or the printer 10, the printer 10 is controlled so as to be able to print. Technology relating to the types of "other abnormalities" and the method of detecting those is well known, so an explanation will be omitted here.

As shown in FIG. 17, when the ink within the liquid holding portion 84 runs out (or the remainder is low), ink no longer flows into the liquid chamber 192 from the liquid holding portion 84, and the negative pressure of the liquid chamber 192 functions. Here, the bias force A of the spring 179 of the printing material holding container 4 is set to be smaller than the force C due to negative pressure generated when the ink in the liquid holding portion 84 runs out (or when the remainder is low). Thus, with this force C, the film 174 stays in the state drawn into the inside of the liquid chamber 192. When the film 174 deforms in the direction by which the capacity of the liquid chamber 192 decreases, the rod shaped member 92 is displaced to the +Y axis direction by the bias force B of the spring 94. Also, along with this displacement, with the rod shaped member 92, the moving member 172 is rotated to follow the deformation of the film 174, and the moving member 172 is kept in a closed state. As a result, the rod shaped member 92 moves to the printing material holding container 4 side, and the light shielding unit 91 of the rod shaped member 92 is inserted between the light emitting unit and the light receiving unit of the sensor 138. The sensor 138 detects that the ink within the liquid holding portion 84 has run out or the remainder is low (ink end state) based on the light being blocked by the light shielding unit 91 of the rod shaped member 92 (the rod shaped member 92 having moved). Then, the printer 10 is controlled so that it is impossible to print in this state. The force B by which the spring 94 biases the rod shaped member 92 is amplified by the lever ratio R of the moving member 172. Thus, when moving from the state in FIG. 16 to the state in FIG. 17, even with a relatively small force, it is possible to rotate the moving member 172 smoothly, and possible to quickly detect ink end.

As noted above, the liquid consuming system 1 detects the residual ink volume state using the moving member 172 provided on the printing material holding container 4 and the rod shaped member 92 and the sensor 138 provided on the printer 10. Thus, when the positional relationship of the moving member 172 and the rod shaped member 92 is skewed from the preset correct positional relationship, there are cases when the detection precision of the residual ink volume state decreases. Thus, as with this embodiment, with the detection method of detecting the residual ink volume state using both the members on the printing material holding container side and the members on the printer 10 side, the decrease in the detection precision of the residual ink volume state is inhibited by arranging the correct positional relationship between the members used for detecting the residual ink volume state.

Figure 18:
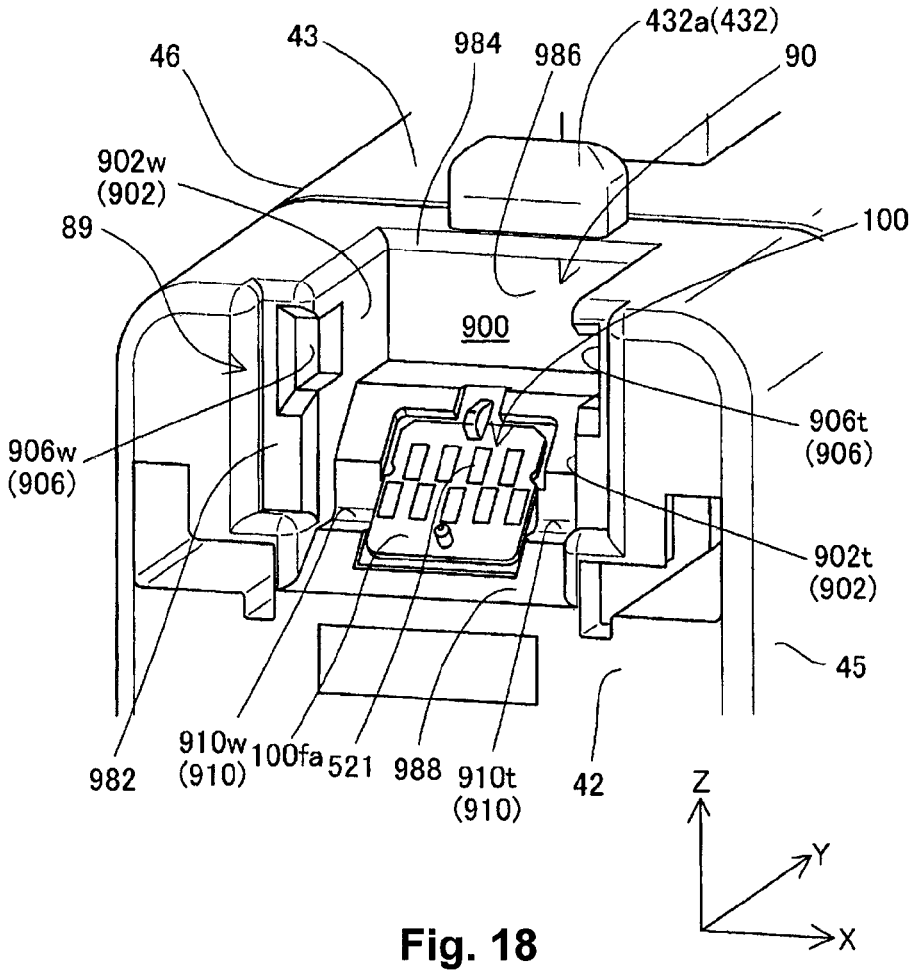
FIG. 18 is an external appearance perspective view near the recess 90.

A-7: Arrangement Mode of the Circuit Substrate 100:

As shown in FIG. 18, the recess 90 has an opening 982 provided along the surface orthogonal to the Y axis and an opening provided along the surface orthogonal to the Z axis. Also, the inner wall of the recess 90 is roughly constituted by a pair of side walls 902 (902*t*, 902*w*), a bottom wall 988, and a back wall 986. The terminal holding chamber 900 in which the device side terminal unit 70 is inserted has compartments formed on the recess interior by the inner walls 902, 986, and 988. The recess 90 is roughly a hexahedron constituted by the opening 982, the opening 984, and the pair of side walls 902*t*, 902*w*, the bottom wall 988, and the back wall 986 as the key surfaces. The opening 982 and the back wall 986 face opposite in the Y axis direction, the opening 982 is positioned at the −Y axis direction, and the back wall 986 at the +Y axis direction. Also, the pair of side walls 902*t* and 902*w* face opposite in the X axis direction, with the first side wall 902*t* positioned at the +X axis direction side, and the second side wall 902*w* at the −X axis direction side. The opening 984 and the bottom wall 988 face opposite in a mutually non-parallel state in the Z axis direction, and the opening 984 is positioned at the +X axis direction side, and the bottom wall 988 at the −Z axis direction side. The opening 982 is an entry port when the device side terminal unit 70 is inserted in the recess 90 when the printing material holding container 4 is mounted in the printing material holding container mounting unit 6. The bottom wall 988 intersects with the first side wall 902*t* and the second side wall 902*w*. The bottom wall 988 intersects with the opening 982 near the −Z direction side. Then, it extends from the position near the opening 982 −Z direction side to the +Y axis direction while tilting in the +Z direction, and intersects with the back wall 986. The back wall 986 intersects with the bottom wall 988, the first side wall 902*t*, and the second side wall 902*w*. The opening 984 intersects with the back wall 986, the first side wall 902*t*, the second side wall 902*w*, and the opening 982. When using without distinguishing between the first side wall 902*t* and the second side wall 902*w*, the side wall 902 is used.

Figure 20:
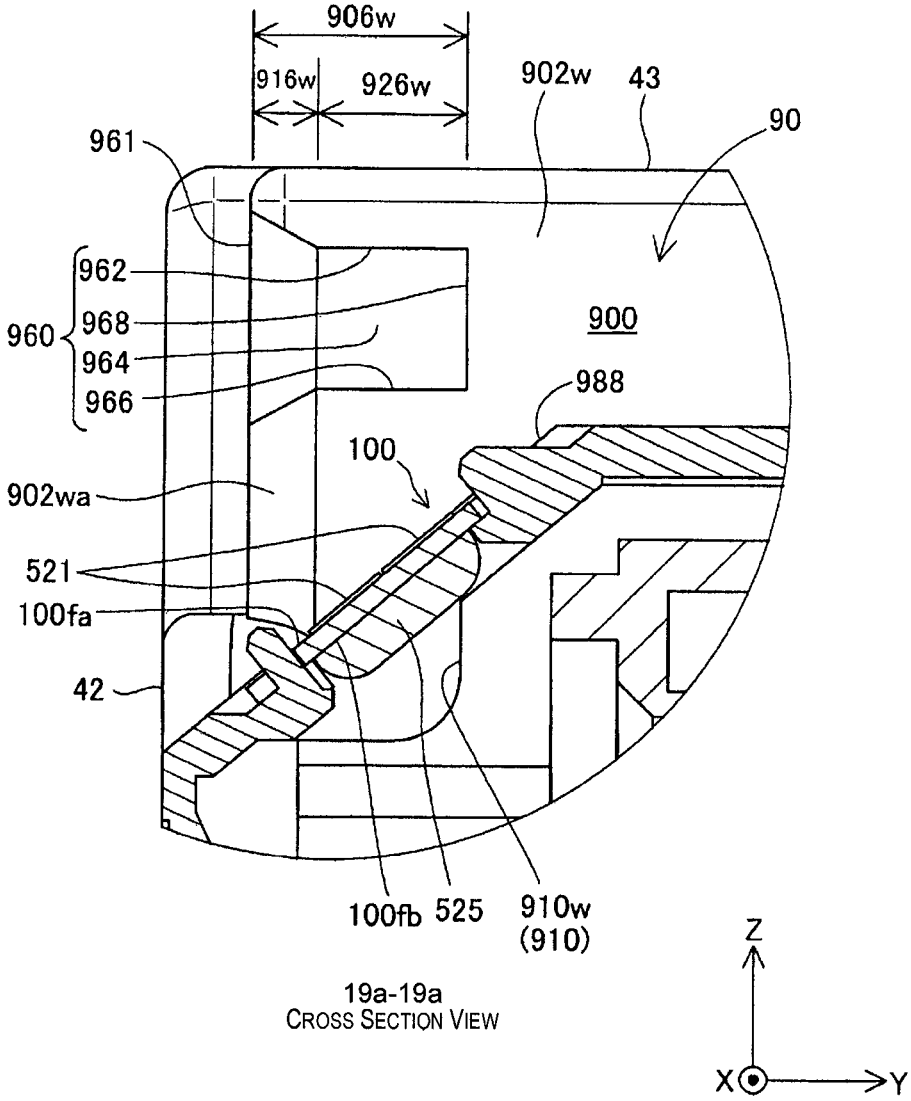
FIG. 20 is a cross section view of 19*a*-19*a* of FIG. 19.

The circuit substrate 100 is attached to the bottom wall 988. More specifically, as shown in FIG. 20, the surface 100*fa* of the circuit substrate 100 is arranged so as to tilt toward the direction including the −Y axis direction element and the +Z axis direction element. Specifically, the surface 100*fa* of the circuit substrate 100 tilts toward the Y axis and the Z axis. Here, the surface 100*fa* correlates to the "tilted surface" noted in the Means for Solving the Problems. As described above, the surface 100*fa* is equipped with the printing material holding container side terminal group 521. Specifically, the printing material holding container side terminal group 521 is provided on the surface tilted in relation to the −Y axis direction which is the insertion direction of the printing material holding container 4 into the printing material holding container mounting unit 6. Also, the back surface 100*fb* of the circuit substrate 100 is equipped with the storage device 525. Information relating to the printing material holding container 4 (e.g. ink color, manufacturing date and the like) is stored in the storage device 525. The printing material holding container side terminal group 521 and the storage device 525 are electrically connected.

Figure 19:
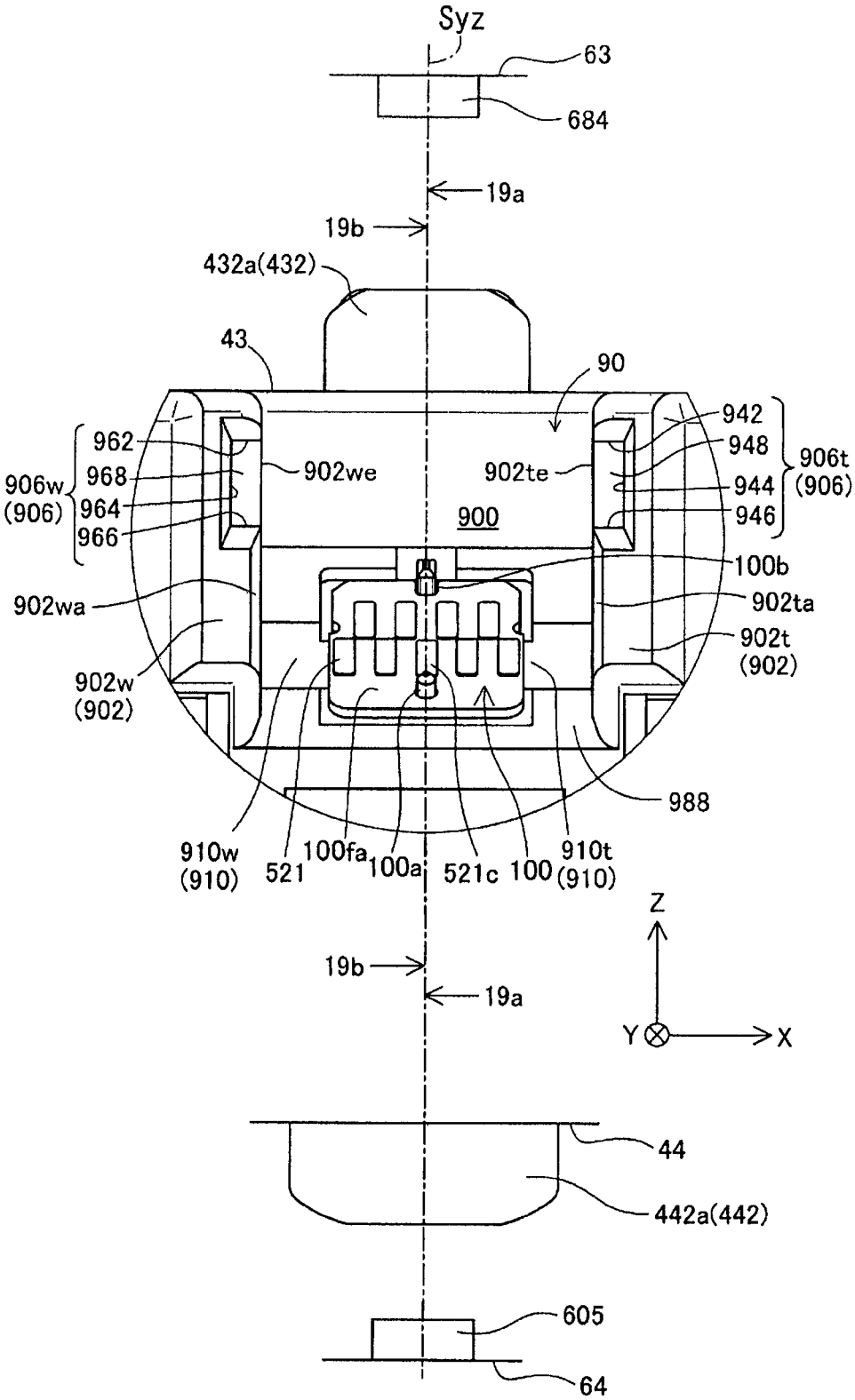
FIG. 19 is a front view near the recess 90.

As shown in FIG. 18 through FIG. 21, a pair of grooves 906*t* and 906*w* are respectively provided on the pair of side walls 902*t* and 902*w* facing opposite in the X axis direction of the recess 90. These grooves 906*t* and 906*w* are provided so as to face opposite each other in the X axis direction. Also, as shown in FIG. 19, the grooves 906*t* and 906*w* are provided symmetrically in relation to the YZ plane Syz. This YZ plane Syz is a surface constituting the center of the X axis dimension (width) of the printing material holding container. The circuit substrate 100 arranged within the recess 90 and each element constituting the recess 90 are provided symmetrically in relation to the YZ plane Syz. Specifically, the YZ plane Syz passes through the center of the X axis direction dimension (width) of the printing material holding container side terminal group 521. Then, of the printing material holding container side terminal group 521, the electrode 521*c* provided at the center of the width direction of the printing material holding container side terminal group 521 intersects with the YZ plane Syz. Also, the YZ plane Syz passes through the center of the X axis direction (width) of the circuit substrate 100. Also, to attach the circuit substrate 100 to the bottom wall 988, this YZ plane Syz passes through attachment parts 100*a* and 100*b* provided on the bottom wall 988. Also, of the printing material holding container side terminal group 521, the YZ plane Syz passes through the terminal 521*c* provided at the center part in the X axis direction. This terminal 521*c* is the terminal in contact with the terminal 721*c* (not illustrated) provided at the center part of the X axis direction of the device side terminal group 721. Also, the grooves 906*t* and 906*w* and the pair of side walls 902*t* and 902*w* of the recess 90 are provided symmetrically in relation to the YZ plane Syz. Furthermore, the YZ plane Syz passes through the center of the X axis direction dimension (width) of the first convex part 52 (52A, 52B) and the second convex part 53 (53A, 53B, see FIG. 6 and FIG. 7) described previously. Also, though not shown in FIG. 19, the YZ plane Syz passes through the center of the first retaining part 436 (FIG. 7) provided on the first side wall 43 and the second retaining part 446 provided on the second side wall 44 (FIG. 7). Also, the plate springs 684 and 604 (FIG. 3, FIG. 7) that retain the first retaining part 436 and the second retaining part 446 intersect with this YZ plane Syz.

Figure 21:
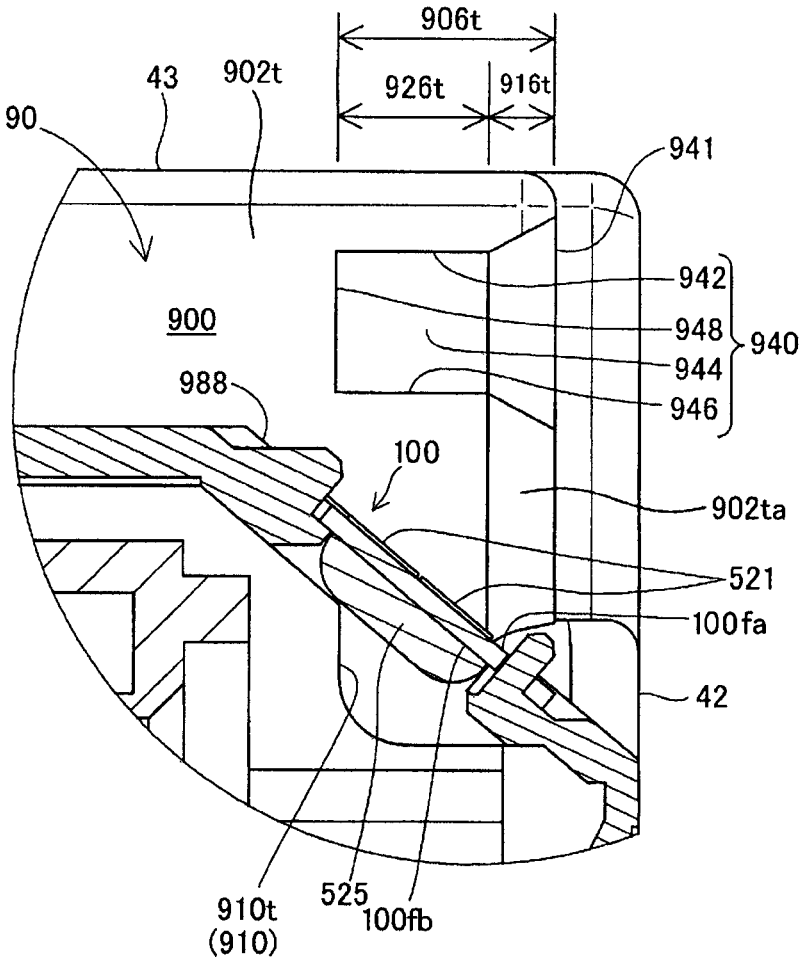
FIG. 21 is a cross section view of 19*b*-19*b* of FIG. 19.
Figure 21:
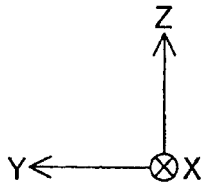

As shown in FIG. 18 and FIG. 21, the first groove 906*t* is provided as the first regulating unit on the first side wall 902*t*. The first groove 906*t* is formed in a shape for which a part of the first side wall 902*t* has been dug down in the +X axis direction. In other words, the first groove 906*t* is hollowed in the +X axis direction from the first side wall 902*t*. The first groove 906*t* extends along the Y axis direction. More specifically, the first groove 906*t* extends along the +Y axis direction facing the back wall 986 side from the position of the opening 982. In the mounted state, a first alignment unit 756*t* (not illustrated) is inserted in the first groove 906*t*. With the first groove 906*t*, the −Y axis direction side end surface and the −X axis direction side surface are open. As shown in FIG. 18 and FIG. 20, the second groove 906*w* is provided as the second regulating unit on the second side wall 902*w*. The second groove 906*w* for which a part of the second side wall 902*w* is formed in a shape dug down in the −X axis direction. In other words, the second groove 906*w* is hollowed in the −X axis direction from the second side wall 902*w*. The second groove 906*w* extends along the Y axis direction. More specifically, the second groove 906*w* extends along the +Y axis direction toward the back wall 986 side from the position of the opening 982. With the second groove 906*w*, the −Y axis direction side end surface and the +X axis direction side surface are open.

As shown in FIG. 20 and FIG. 21, the grooves 906*t* and 906*w* respectively have openings 941 and 961 on the −Y axis direction side end surface. The grooves 906*t* and 906*w* are equipped with inlet parts 916*t* and 916*w* extending to the +Y axis direction side from these openings 941 and 961, and contact parts 926*t* and 926*w* extending to the +Y axis direction side from the +Y axis direction end part of the inlet part 916*t*. The −Y axis direction side end surface openings 941 and 961 respectively become the inlets for insertion of the alignment parts 756*t* and 756*w* when the printing material holding container 4 is mounted in the printing material holding container mounting unit 6. The openings 941 and 961 are formed more to the −Y axis direction side than the printing material holding container side terminal group 521, so before contact of the device side terminal group 721 and the printing material holding container side terminal group 521 starts, insertion of the alignment parts 756*t* and 756*w* to the grooves 906*t* and 906*w* starts.

The inlet parts 916*t* and 916*w* are parts in which of the grooves 906*t* and 906*w*, the alignment parts 756*t* and 756*w* are initially inserted. As shown in FIG. 19 through FIG. 21, the inlet parts 916*t* and 916*w* have the Z axis direction dimension evenly decrease going along facing the +Y axis direction. Also, as shown in FIG. 19, with the inlet parts 916*t* and 916*w*, the X axis direction dimension decreases along facing the +Y axis direction from the −Y axis direction. Specifically, a taper is provided at the inlet parts 916*t* and *w* for which the dimensions gradually decrease in the Z axis direction and the X axis direction. To say this yet another way, the inlet parts 916*t* and 916*w* have a taper shape for which the area of the openings 941 and 961 is the largest. Also, as shown in FIG. 19 through FIG. 21, the inlet parts 902*wa* and 902*ta* of the side walls 902*w* and 902*t* of the recess 90 also have a taper shape so as to correspond to the inlet parts 916*t* and 916*w*. Specifically, the distance between the side walls 902*w* and 902*t* at the inlet parts 902*wa* and 902*ta* (gap in the X axis direction) becomes smaller going along facing the +Y axis direction from the −Y axis direction.

The contact parts 926*t* and 926*w* are respectively in contact with the alignment parts 756*t* and 756*w* when in a mounted state. As shown in FIG. 20 and FIG. 21, the contact parts 926*t* and 926*w* respectively have contact surfaces 940 and 960 that contact the alignment parts 756*t* and 756*w* when in the mounted state. As shown in FIG. 21, the contact surface 940 with the first alignment part 756*t*, in other words, the contact surface 940 of the groove 906*t* is equipped with four surfaces 942, 946, 948, and 944. Similarly, as shown in FIG. 20, the contact surface 960 with the second alignment part 756*w*, in other words, the contact surface of the groove 906*w* also is equipped with four surfaces 962, 966, 968, and 964. These four contact surfaces are also respectively called A surface 942 and 962, B surface 946 and 966, C surface 944 and 964, and D surface 948 and 968. As shown in FIG. 21, the A surface 942 and the B surface 946 of the groove 906*t* face opposite in the Z axis direction, and the A surface 942 is positioned at the +Z axis direction side, while the B surface 946 is positioned at the −Z axis direction side. The D surface 948 of the groove 906*t* faces opposite the opening 941 in the Y axis direction, and the opening 941 is positioned at the −Y axis direction side, while the D surface 948 is positioned at the +Y axis direction side. Also, the D surface 948 intersects with the A surface 942 and the B surface 946. As shown in FIG. 19, the C surface 944 of the groove 906*t* faces opposite the extended surface 902*te* of the first side wall 902*t*, and is positioned at the +X axis direction side in relation to the extended surface 9Q2*te* of the first side wall 902*t*. Also, the C surface 944 intersects with the A surface 942, the B surface 946, and the D surface 948. The A surface 942 of the groove 906*t* contacts the +Z axis direction side end part of the first alignment part 756*t* (not illustrated). The B surface 946 contacts the −Z axis direction side end part of the first alignment part 756*t*. The first D surface 948 contacts the +Y axis direction side end part of the first alignment part 756*t*. The first C surface 944 contacts the +X axis direction side end part of the first alignment part 756*t*.

As shown in FIG. 20, the A surface 962 and the B surface 966 of the groove 906*w* face opposite in the Z axis direction, and the A surface 962 is positioned at the +Z axis direction side while the B surface 966 is positioned at the −Z axis direction side. The D surface 968 of the groove 906*w* faces opposite the opening 961 in the Y axis direction, and the opening 961 is positioned at the −Y axis direction side while the D surface 968 is positioned at the +Y axis direction side. Also, the D surface 968 intersects the A surface 962 and the B surface 966. As shown in FIG. 19, the C surface 964 of the groove 906*w* faces opposite the extended surface 902*we* of the second side wall 902*w*, and is positioned at the −X axis direction side in relation to the extended surface 902*we* of the first side wall 902*w*. Also, the C surface 964 intersects with the A surface 962, the B surface 966, and the D surface 968. The A surface 962 of the groove 906*w* contacts the +Z axis direction side end part of the second alignment part 756*w* (not illustrated). The B surface 966 contacts the −Z axis direction side end part of the second alignment part 756*w*. The D surface 968 contacts the +Y axis direction side end part of the second alignment part 756*w*. The C surface 964 contacts the −X axis direction side end part of the second alignment part 756*w*.

Here, when using the first groove 906*t* and the second groove 906*w* without distinguishing them, this is also simply called the "groove 906." Also, when using the first contact part 926*t* and the second contact part 926*w* without distinguishing them, this is also simply called the "contact part 926." Also, when using the first inlet part 916*t* and the second inlet part 916*w* without distinguishing them, this is also simply called the "inlet part 916."

As shown in FIG. 18, between the tilted surface 100*fa* and the first side wall 902*t* of the bottom wall 988, and between its tilted surface 100*fa* and the second side wall 902*w* are respectively formed a pair of bottom wall side recesses 910*t* and 910*w*. Though not illustrated, in the mounted state, the pair of bottom wall side recesses 910*t* and 901*w* are respectively constituted so as to accept a pair of projections 759*t* and 759*w* (not illustrated) of the device side terminal unit 70. The pair of bottom wall side recesses 910*t* and 910*w* are collectively also called the first bottom wall side recess 910.

Figure 22:
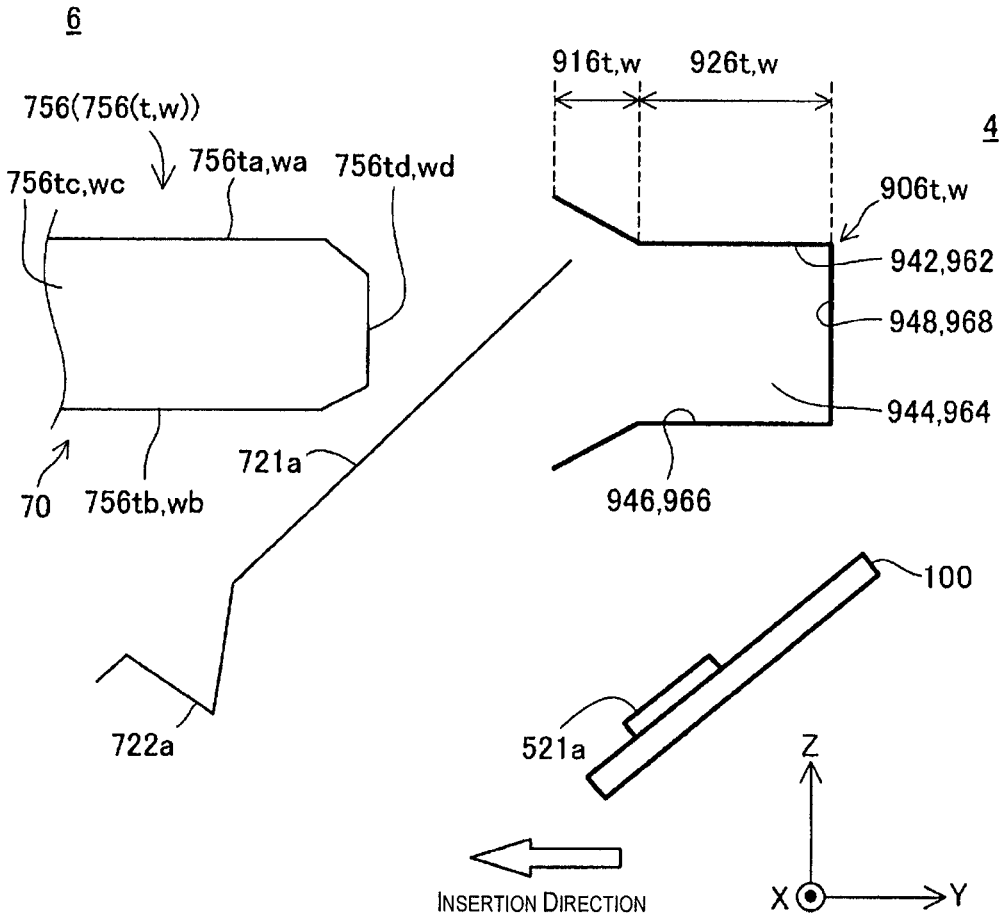
FIG. 22 is a first drawing for explaining the contact mode.
Figure 23:
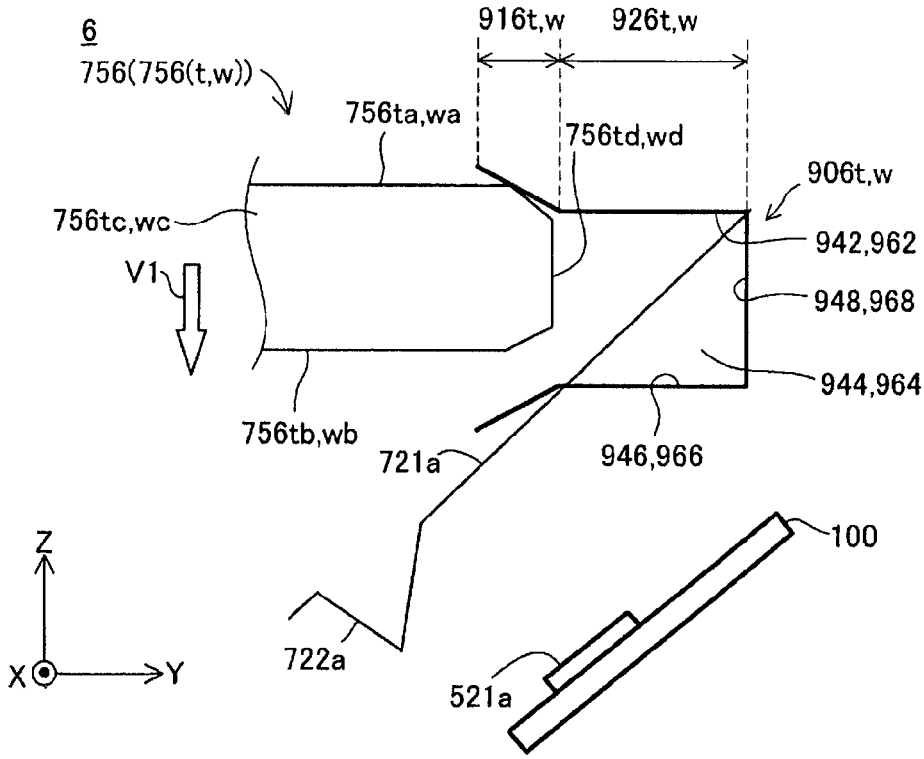
FIG. 23 is a second drawing for explaining the contact mode.
Figure 24:
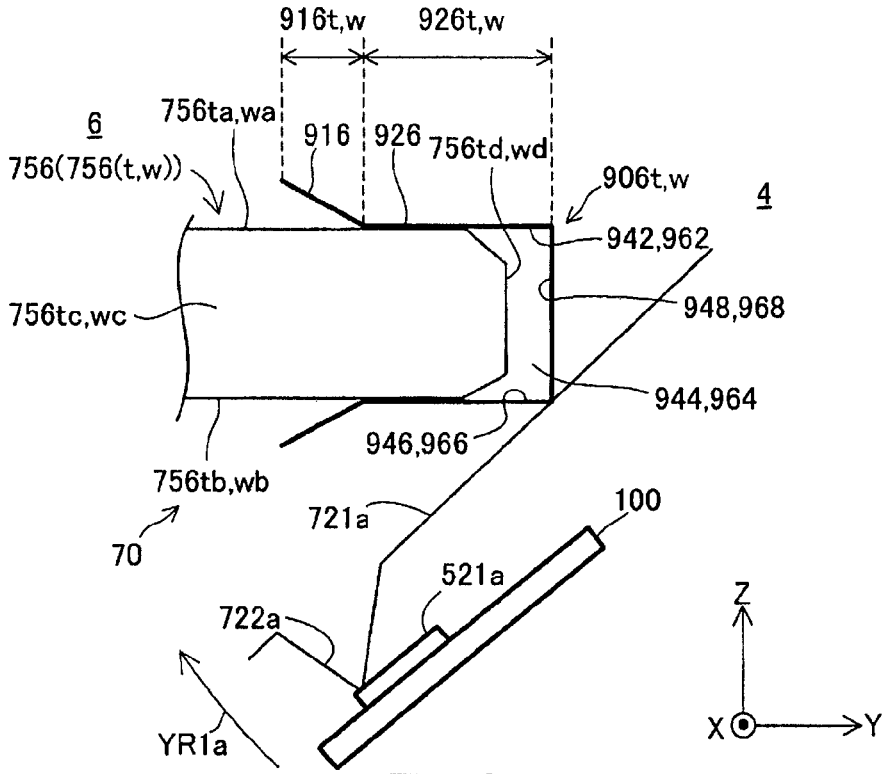
FIG. 24 is a third drawing for explaining the contact mode.
Figure 25:
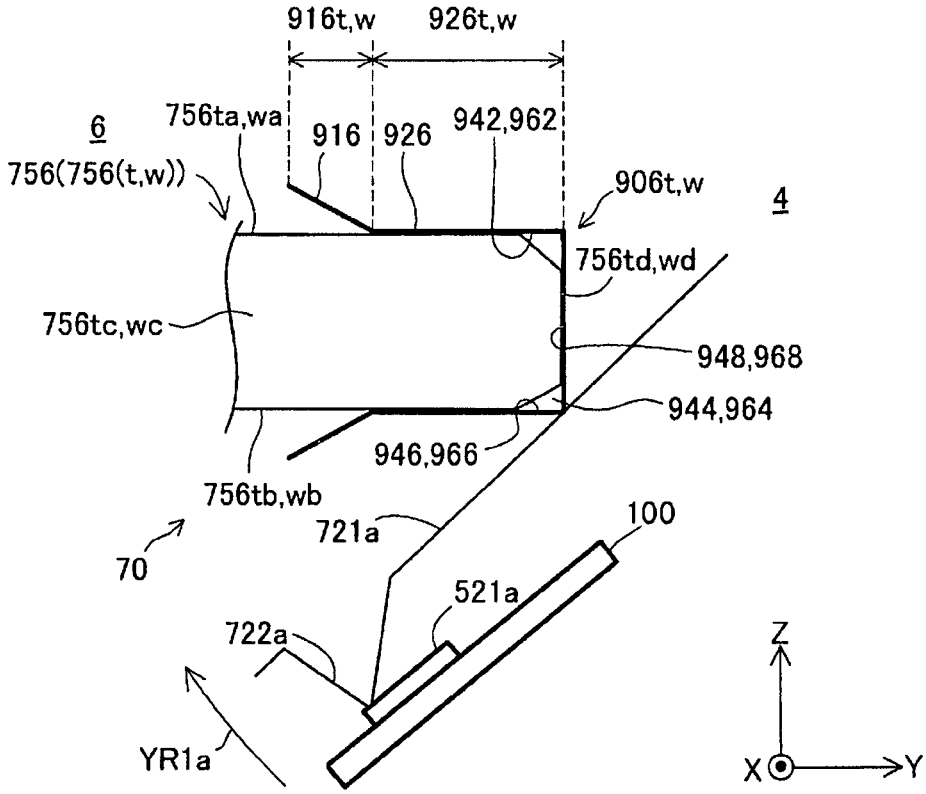
FIG. 25 is a fourth drawing for explaining the contact mode.

A-8: Contact Mode of the Printing Material Holding Container Side Terminal Group 521 and the Device Side Terminal Group 721:

Next, using FIG. 22 through FIG. 25, we will describe the contact mode of the printing material holding container side terminal group 521 and the device side terminal group 721 when the printing material holding container 4 is mounted in the printing material holding container mounting unit 6. FIG. 22 is a first drawing for explaining the contact mode. FIG. 23 is a second drawing for explaining the contact mode. FIG. 24 is a third drawing for explaining the contact mode. FIG. 25 is a fourth drawing for explaining the contact mode. The situation when mounting the printing material holding container 4 is shown in time series in the drawing number sequence of FIG. 22 to FIG. 25. Also, FIG. 22 through FIG. 25 describe with a focus on one printing material holding container side terminal 521*a* among the printing material holding container side terminal group 521 and on one device side terminal 721*a* among the device side terminal group 721. The same mounting mode applies for the other terminals as well. The shape of the first and second alignment parts 756*ta* and *wa* are the same, and the shape of the first and second grooves 906*t* and *w* are the same, so with FIG. 22 to FIG. 25, to make it easier to understand, the code numbers 756*ta* and *wa* are noted together, and the code numbers 906*t* and *w* are noted together.

As shown in FIG. 22, when the printing material holding container 4 is mounted in the printing material holding container mounting unit 6, the printing material holding container 4 is pushed forward into the slot of the printing material holding container mounting unit 6 in the −Y axis direction. At this time, as shown in FIG. 23, before the printing material holding container side terminal 521*a* contacts the device side terminal 721*a* and the terminal contact point 722*a*, insertion of the alignment part 756 into the groove 906 starts. At this time, even when a slight manufacturing error occurs with the printing material holding container mounting unit 6, by moving the device side terminal unit 70 in the X axis direction and the Z axis direction, this is guided into the recess 90 of the printing material holding container 4 while that error is being absorbed. By the printing material holding container 4 being pushed forward in the −Y axis direction while the alignment part 756 is in contact with the surface of the inlet part 916 of the groove 906, the device side terminal unit 70 is guided to a position at which the printing material holding container side terminal 521*a* and the device side terminal 721*a* are in contact. With FIG. 23, a state is shown in which the device side terminal unit 70 is guided into the recess 90 (FIG. 18) while it is being slightly moved in the direction shown by arrow V1 (−Z axis direction).

As shown in FIG. 24, when the printing material holding container 4 is further pushed forward in the −Y axis direction and the alignment parts 756*t* and *w* are inserted in the contact parts 926*t* and *w* of the groove 906, the C surfaces 756*tc* and we of the alignment parts 756*t* and *w* respectively contact the C surfaces 944 and 964 of the grooves 906*t* and *w*, and thus the X axis direction movement of the device side terminal unit 70 is regulated. Also, at this time, the A surfaces 756*ta* and *wa* of the alignment parts 756*t* and *w* respectively contact the A surfaces 942 and 962 of the grooves 906*t* and *w*, and the B surfaces 756*t* and *w* respectively contact the B surfaces 946 and 966, and thus the Z axis direction movement of the device side terminal unit 70 is regulated. By doing this, the X axis direction and the Z axis direction positions of the printing material holding container side terminal 521*a* and the terminal contact point 722*a* are determined. Then, after insertion to the contact part 926 of the alignment part 756 starts, immediately before completion of total insertion, the terminal contact point 722*a* first is in contact with the printing material holding container side terminal 521*a*. At this point, the tip surfaces 756*t*d and wd of the alignment parts 756*t* and *w* are not in contact with the D surfaces 948 and 968 of the grooves 906*t* and *w*, and it is possible for the printing material holding container 4 to be further pushed forward. From the state shown in FIG. 24, when the printing material holding container 4 is further pushed forward in the −Y axis direction, the device side terminal 721*a* is elastically deformed, and movement toward the arrow YR1*a* occurs while the contact point 722*a* of the device side terminal 721*a* is in contact with the printing material holding container side terminal 521*a*. At this time, the device side terminal group and the printing material holding container side terminal group slightly rub against each other. Then, ultimately, as shown in FIG. 25, the tip surfaces 756*td* and wd of the alignment parts 756*t* and *w* are in contact with the D surfaces 948 and 968 of the grooves 906*t* and *w*, and the Y axis direction position of the printing material holding container side terminal 521*a* and the terminal contact point 722*a* are determined. In this state, the mounting of the printing material holding container 4 into the printing material holding container mounting unit 6 is completed. Also, at the time of mounting completion and in the mounted state, the same as at the final stage of mounting shown in FIG. 24, the A surfaces 756*ta* and *wa* of the alignment parts 756*t* and *w* are in contact with the A surfaces 942 and 944 of the grooves 906*t* and *w* in the +Z axis direction. Also, the B surfaces 756*tb* and *wb* are in contact with the B surfaces 946 and 966 of the grooves 906*t* and *w* in the −Z axis direction. Also, the C surface 756*tc* of the first alignment part is in contact with the C surface 944 of the first groove 906*t* in the +X axis direction, and the C surface 756*wc* of the second alignment part is in contact with the C surface 964 of the second groove 906*w* in the −X axis direction. Thus, the Z axis direction and the X axis direction movement of the alignment parts 756*t* and *w* is regulated by the grooves 906*t* and *w*. By doing this, it is possible to keep both 721*a* and 521*a* in positions that allow good contact between the device side terminal 721*a* and the printing material holding container side terminal 521*a*.

Figure 26A:
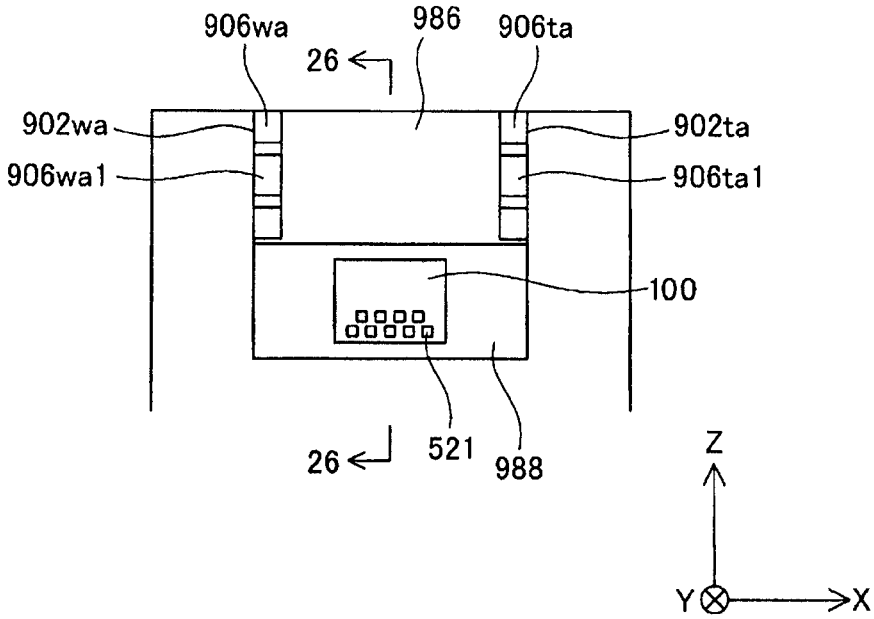
FIG. 26A is a front view of a first modification mode.

A-9: Modification Modes of the Regulating Unit:

FIG. 26A through FIG. 34B are typical drawings for describing various modification modes of the regulating unit provided on the recess 90. FIG. 26A is a front view of the first modification mode.

Figure 26B:
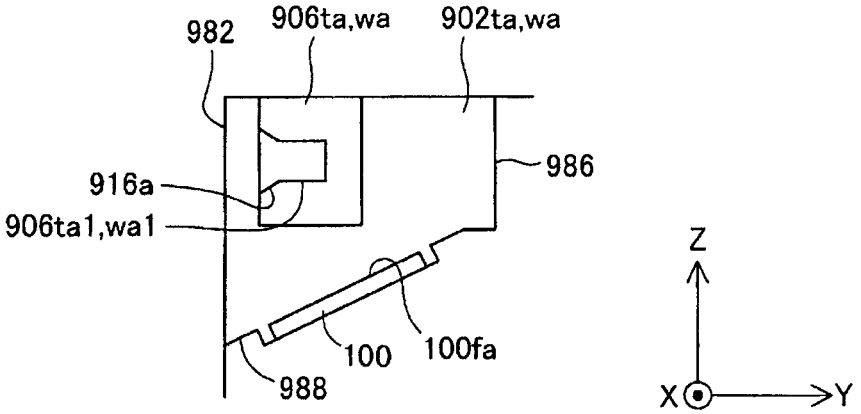
FIG. 26B is a cross section view of 26-26 in FIG. 26A.
Figure 27A:
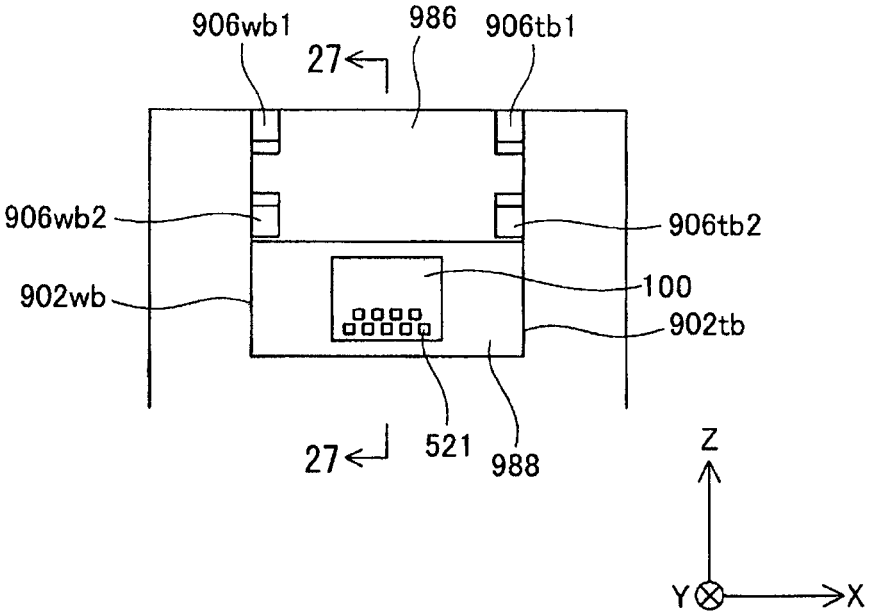
FIG. 27A is a front view of a second modification mode.
Figure 27B:
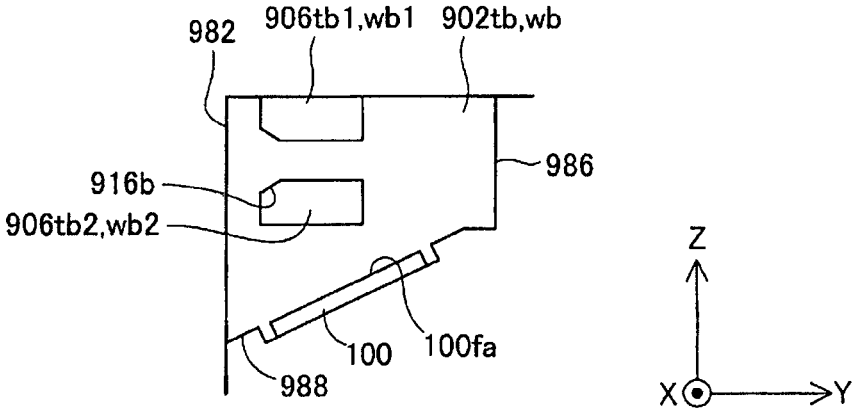
FIG. 27B is a cross section view of 27-27 in FIG. 27A.
Figure 28A:
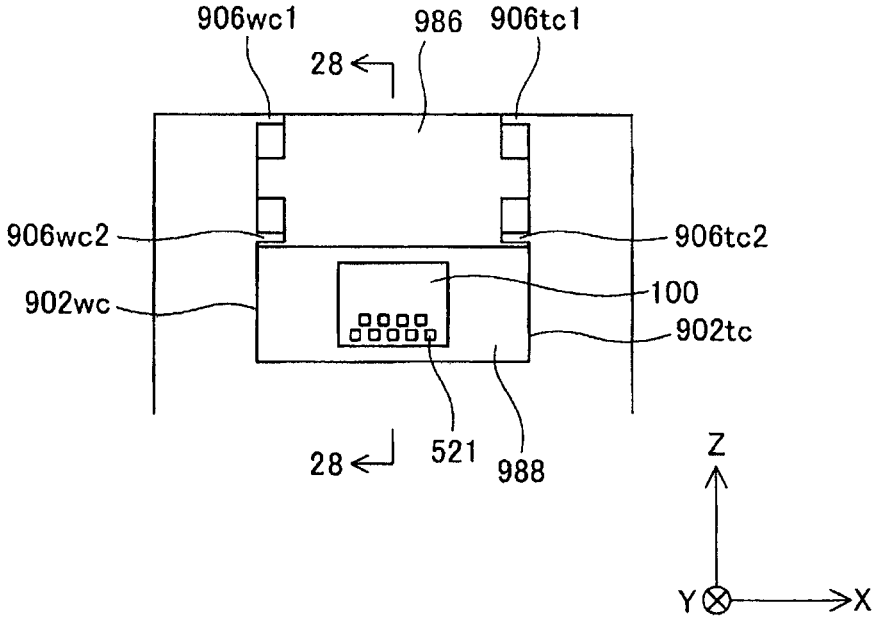
FIG. 28A is a front view of a third modification mode.
Figure 28B:
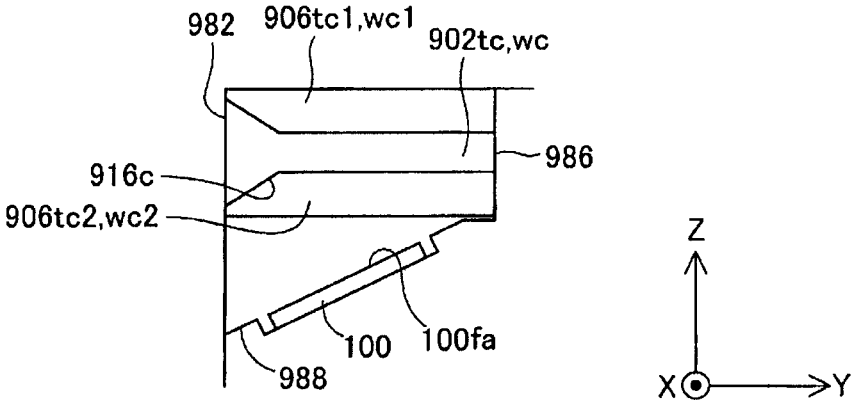
FIG. 28B is a cross section view of 28-28 in FIG. 28A.
Figure 29A:
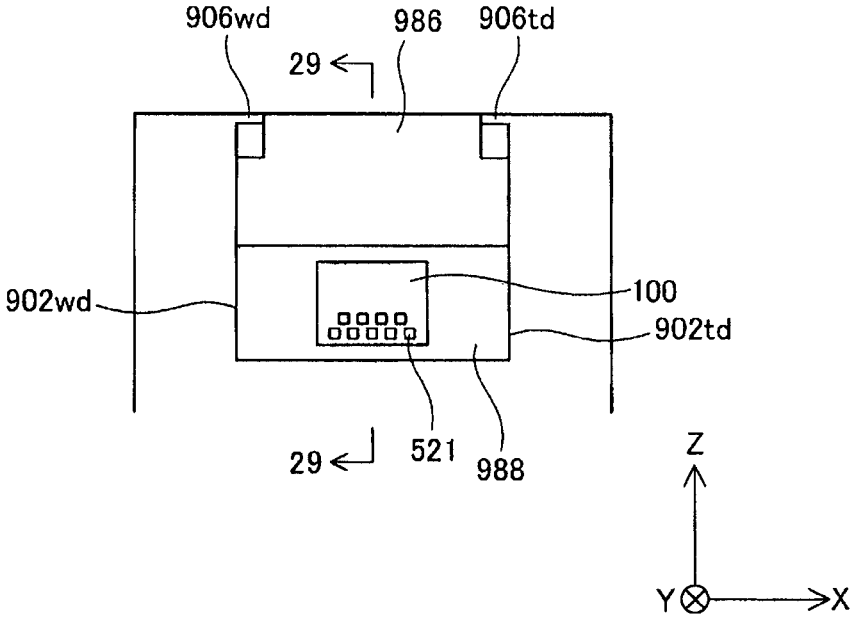
FIG. 29A is a front view of a fourth modification mode.
Figure 29B:
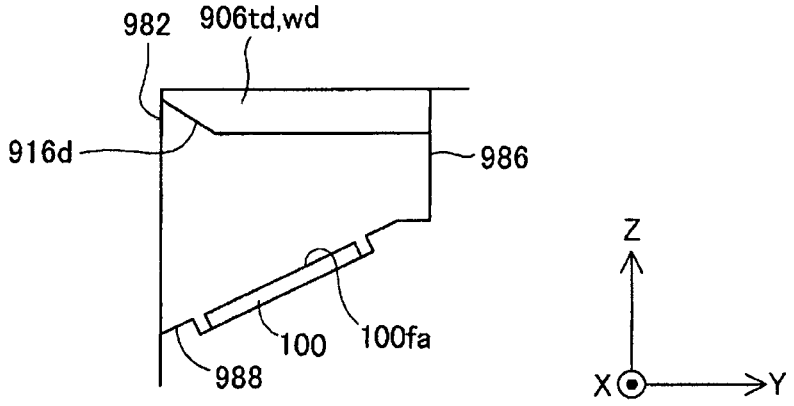
FIG. 29B is a cross section view of 29-29 in FIG. 29A.
Figure 30A:
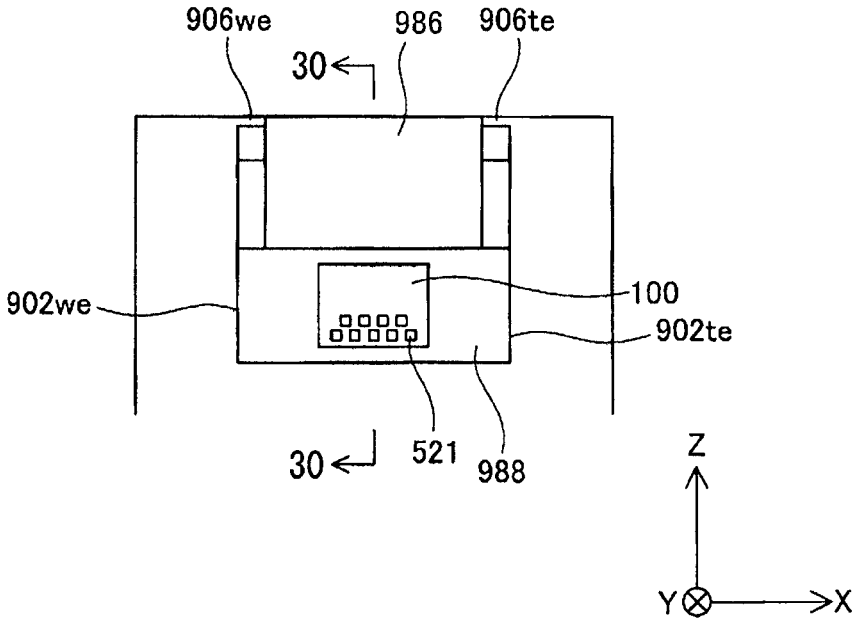
FIG. 30A is a front view of a fifth modification mode.
Figure 30B:
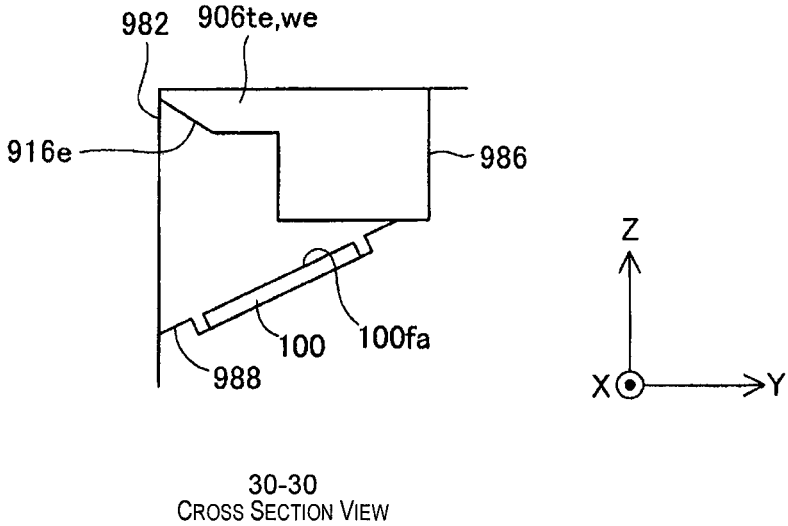
FIG. 30B is a cross section view of 30-30 in FIG. 30A.
Figure 31A:
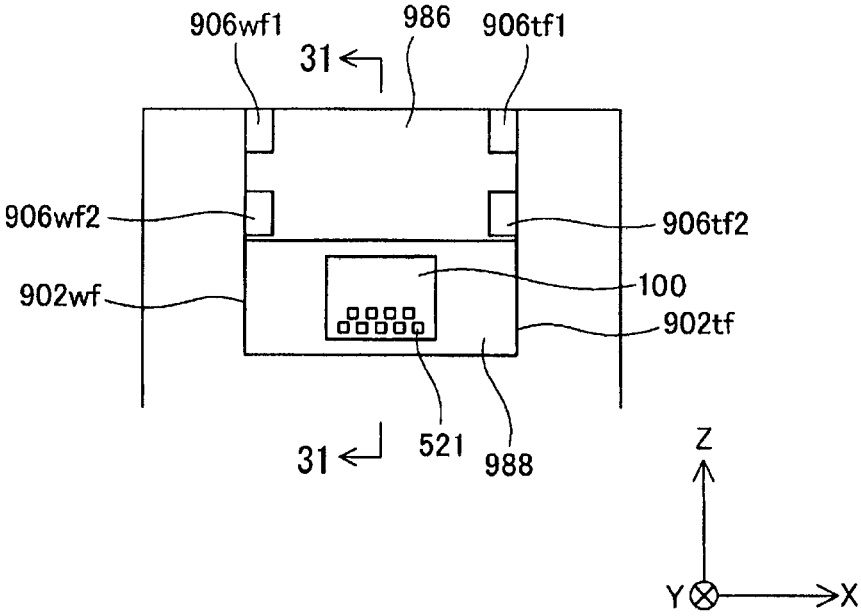
FIG. 31A is a front view of a sixth modification mode.
Figure 31B:
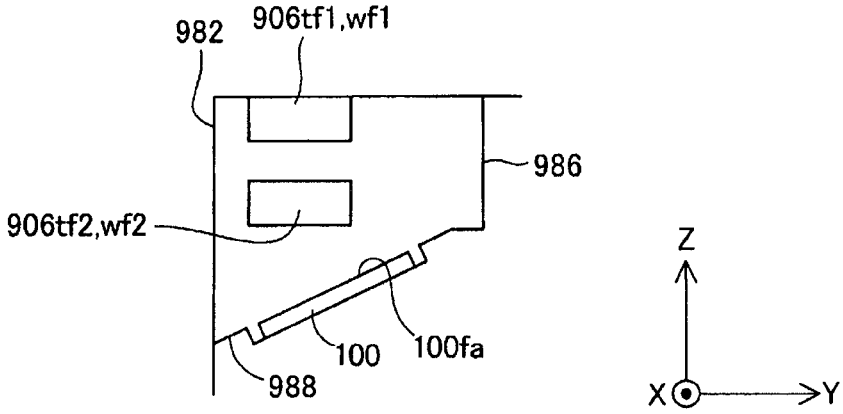
FIG. 31B is a cross section view of 31-31 in FIG. 31A.
Figure 32A:
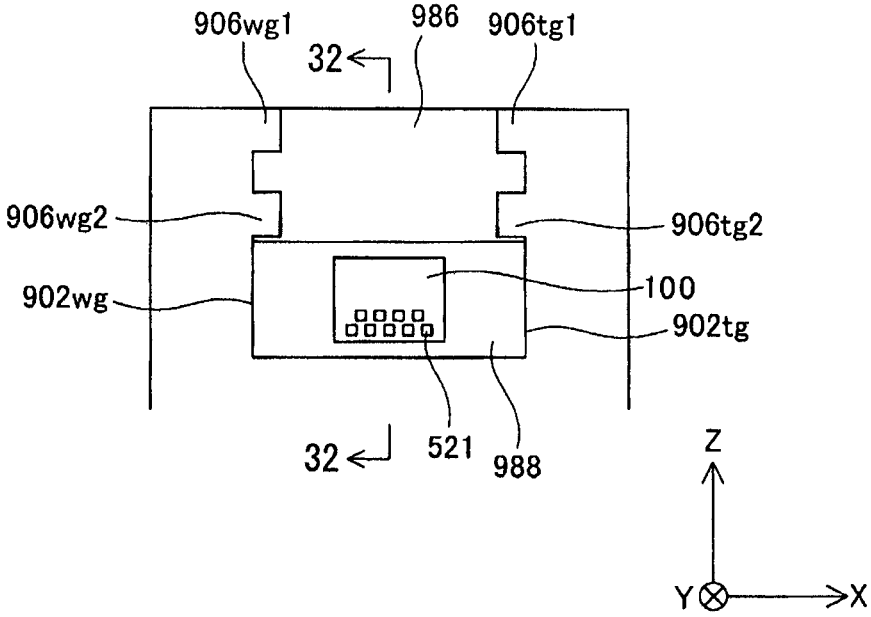
FIG. 32A is a front view of a seventh modification mode.
Figure 32B:
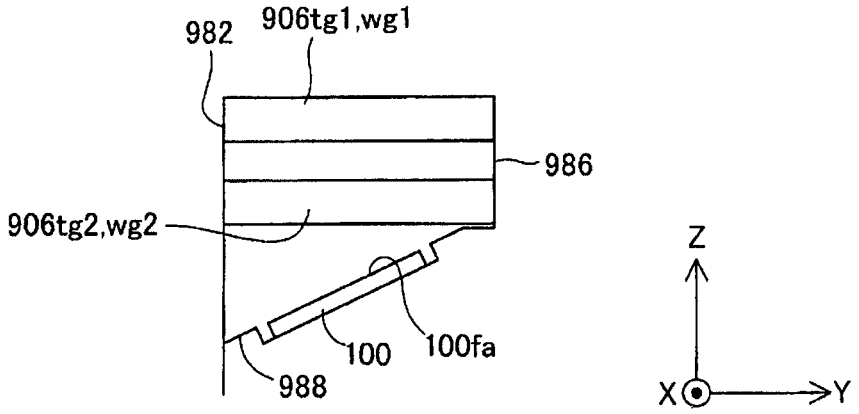
FIG. 32B is a cross section view of 32-32 in FIG. 32A.
Figure 33A:
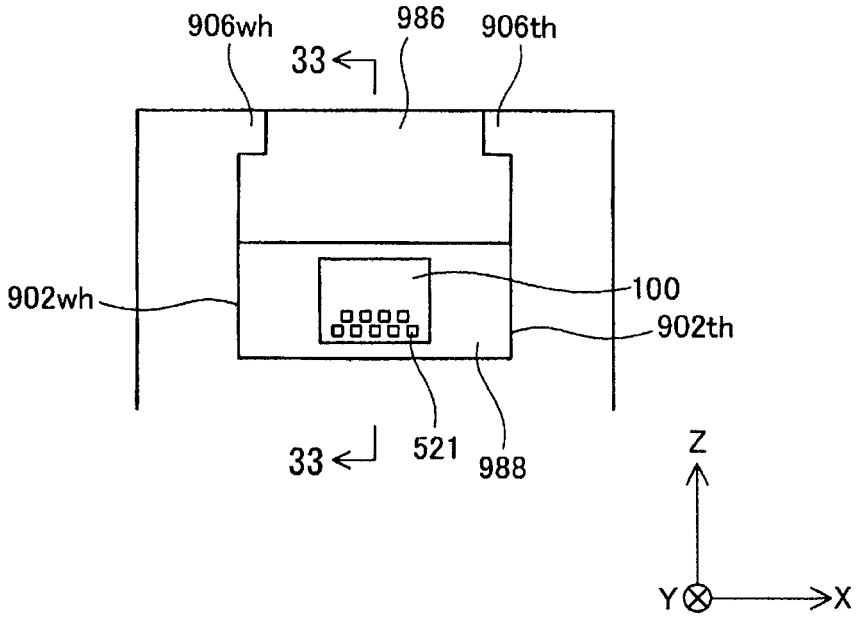
FIG. 33A is a front view of an eighth modification mode.
Figure 33B:
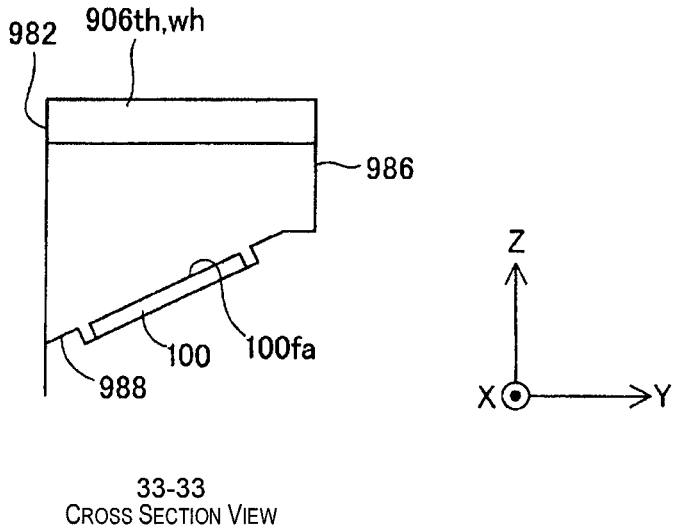
FIG. 33B is a cross section view of 33-33 in FIG. 33A.
Figure 34A:
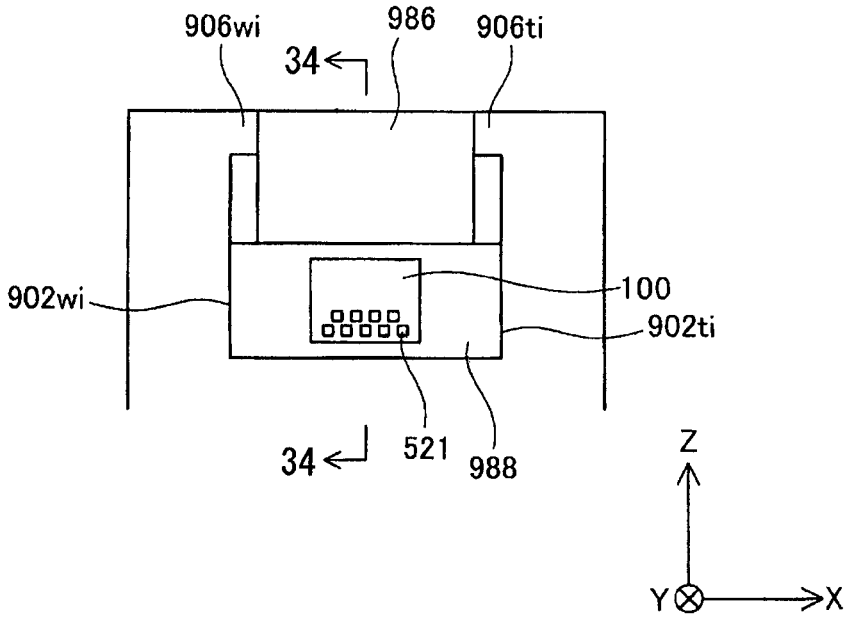
FIG. 34A is a front view of a ninth modification mode.
Figure 34B:
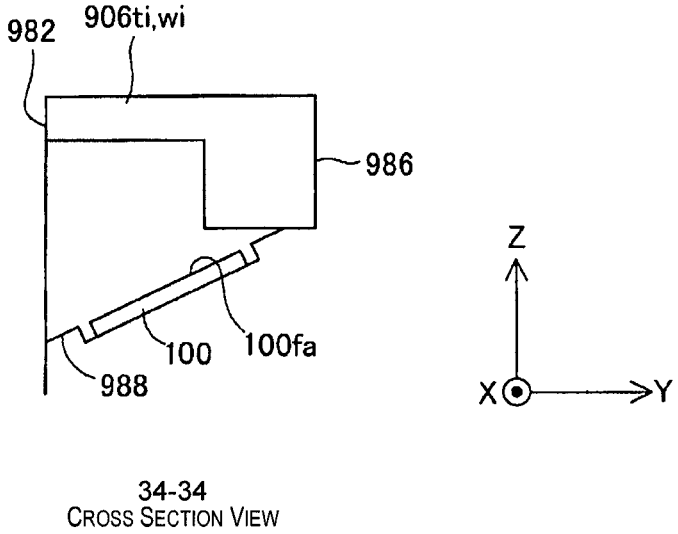
FIG. 34B is a cross section view of 34-34 in FIG. 34A.

FIG. 26B is a cross section view of 26-26 of FIG. 26A.
FIG. 27A is a front view of the second modification mode.
FIG. 27B is a cross section view of 27-27 of FIG. 27A.
FIG. 28A is a front view of the third modification mode.
FIG. 28B is a cross section view of 28-28 of FIG. 28A.
FIG. 29A is a front view of the fourth modification mode.
FIG. 29B is a cross section view of 29-29 of FIG. 29A.
FIG. 30A is a front view of the fifth modification mode.
FIG. 30B is a cross section view of 30-30 of FIG. 30A.
FIG. 31A is a front view of the sixth modification mode.
FIG. 31B is a cross section view of 31-31.
FIG. 32A is a front view of the seventh modification mode.
FIG. 32B is a cross section view of 32-32 of FIG. 32A.
FIG. 33A is a front view of the eighth modification mode.
FIG. 33B is a cross section view of 33-33 of FIG. 33A.
FIG. 34A is a front view of the ninth modification mode.
FIG. 34B is a cross section view of 34-34 of FIG. 34A.

Of FIG. 26A to FIG. 34B, the front views give a typical view of the recess 90 and its vicinity, and the cross section views give a typical view of a cross section of the recess 90 and its vicinity. For all of the modification modes of FIG. 26A through FIG. 34B, for other than the constitution of the regulating unit for which the alignment part 756 of the holder 750 is inserted, the constitution is the same as that of the first embodiment. Also, with FIG. 26A through FIG. 34B, the same code numbers are given for the same constitution as that of the first embodiment, and an explanation is omitted. The constitution of the printer 10 is the same constitution as that of the first embodiment. The shape of the first and second regulating units are the same, so with the cross section views among FIG. 26A through FIG. 34B, to make it easier to understand, in addition to the code numbers indicating the second regulating unit, the code numbers indicating the first regulating unit are noted together.

The modification modes of FIG. 26A through FIG. 34B are each equipped with a convex part projecting in the −X axis direction from the first side wall of the recess 90, and a convex part projecting in the +X axis direction from the second side wall, and the first and second regulating units are constituted by these convex parts. These convex parts can be provided as separate units from the first and second side walls of the recess 90, or can be provided as an integrated unit. With the first modification mode shown in FIGS. 26A and B, grooves 906*ta*1 and *wa*1 are formed in a shape similar to that of the first embodiment using the convex parts 906*ta* and *wa* and the side walls 902*ta* and *wa*, and the alignment parts 756*t* and *w* of the device side terminal unit 70 are inserted in the grooves 906*ta*1 and *wa*1. A taper is provided only in the Z axis direction for the inlet part 916*a* of the grooves 906*ta*1 and *wa*1. Regulation of the ±Z direction movement of the alignment parts 756*t* and *w* of the device side terminal unit 70 is performed by the grooves 906*ta*1 and *wa*1 A surface (+Z axis direction side surface) and B surface (−X axis direction side surface), and regulation of the +Y axis direction movement is performed by the D surface of the grooves 906*ta*1 and *wa*1 (+Y axis direction side surface). Regulation of the ±X axis direction movement is performed by the C surface formed by the side walls 902*ta* and *wa*. Specifically, the C surface is formed by portions of the side walls 902*ta* and *wa*. The second modification mode shown in FIGS. 27A and B is equipped with a pair of convex parts 906*tb*1 and *tb*2 projecting in the −X axis direction form the first side wall 902*tb* of the recess 90, and a pair of convex parts 906*wb*1 and *wb*2 projecting in the +X axis direction from the second side wall 902*wb*. The convex parts 906*tb*1, *tb*2, *wb*1, and *wb*2 correlate to items for which the D surface (+Y axis direction side surface) is omitted from the grooves 906*ta*1 and *wa*1 of the first modification mode shown in FIGS. 26A and B. Regulation of the +Z direction movement of the alignment parts 756*t* and *w* of the device side terminal unit 70 is performed by the convex parts 906*tb*1 and *wb*1. Regulation of the −Z direction movement of the alignment parts 756*t* and *w* of the device side terminal unit 70 is performed by the convex parts 906*tb*2 and *wb*2. Regulation of the ±X axis direction movement is performed by the side walls 902*tb* and *wb*. The third modification mode shown in FIGS. 28A and B is equipped with a pair of convex parts 906*tc*1 and *tc*2 projecting in the −X axis direction from the first side wall 902*tc* of the recess 90, and a pair of convex parts 906*wc*1 and *wc*2 projecting in the +X axis direction from the second side wall 902*wc*. The third modification mode differs from the second modification mode shown in FIGS. 27A and B by the point that the −Y axis direction opening end of the convex parts 906*tc*1, *tc*2, *wc*1, and *wc*2 is lined up with the position of the opening 982 of the recess 90, and the point that the +Y axis direction end part extends to the position of the back wall 986 of the recess 90, but the other points are in common with the second modification mode. The fourth modification mode of FIGS. 29A and B is equipped with a convex part 906*t*d projecting in the −X axis direction from the first side wall 902*t*d of the recess 90, and a convex part 906*wd* projecting in the +X axis direction from the second side wall 902*wd*. The fourth modification mode is an item for which of the alignment parts 756*t* and *w* of the device side terminal unit 70, the convex parts 906*tc*2 and *wc*2 that regulate the −Z axis direction movement are eliminated from the third modification mode shown in FIGS. 28A and B. With the convex parts 906*td* and *wd*, regulation of the +Z direction of the alignment parts 756*t* and *w* of the device side terminal unit 70 is possible. The −Z axis direction movement is regulated by the device side terminal group 721 and the printing material holding container side terminal group 521 coming into contact, so it is possible to omit the function of regulating the −Z axis direction movement. Also, regulation of the +X axis direction is performed by the side walls 902*td* and *wd*. The fifth modification mode of FIGS. 30A and B is equipped with a convex part 906*te* projecting in the −X axis direction from the first side wall 902*te* of the recess 90, and a convex part 906*we* projecting in the +X axis direction from the second side wall 902*we*. The fifth modification mode is an item for which a D surface for regulating the +Y axis direction movement of the alignment parts 756*t* and *w* of the device side terminal unit 70 is added to the convex parts 906*t*d and *wd* of the fourth modification mode shown in FIGS. 29A and B. The other points are in common with the fourth modification mode. The sixth through ninth modification modes of FIG. 31A through FIG. 34B are respectively items for which the inlet parts 916*b* through *e* formed in a taper shape are omitted from the second through fifth modification modes shown in FIG. 26A through FIG. 30B, and the other points are the same as the second through fifth modification modes.

With modification modes like those noted above as well, it is possible to obtain the same effects as with the first embodiment. However, it goes without saying that with the regulating units of the fourth, fifth, eight, and ninth modification modes which do not have the function of regulating the −Z axis direction movement of the alignment parts 756*t* and *w* of the device side terminal unit 70, it is not possible to obtain the effect by regulating the −Z axis direction movement, and with the regulating units of the second through fourth and the sixth through eighth modification modes which do not have the function of regulating the +Y direction movement, it is not possible to obtain the effect by regulating the +Y direction movement. Also, with the modification examples noted above, it is possible to easily form the first alignment part and the second alignment part by providing convex parts that project in the X axis direction respectively at the first side wall and the second side wall.

A-10. Effect:

As noted above, with the printing material holding container 4 of this embodiment, a piezo electric type detection mechanism for detecting that the ink inside the printing material holding container 4 has run out or the remainder is low (called "ink end detection") is not provided. By doing this, it is not necessary to provide a power supply or an electrical conduction means for sending and receiving signals between this kind of detection mechanism and the printer (wiring or electrode terminals or the like) on the interior of the printing material holding container 4, so it is possible to make the structure of the printing material holding container 4 simple. Thus, it is possible to make the printing material holding container 4 more compact. Also, it is possible to reduce the manufacturing cost of the printing material holding container 4. Also, with the printing material holding container 4, of the front wall 42, the second insertion hole 420 is provided at the intermediate position between the first side wall 43 and the second side wall 44. Specifically, since alignment of the printing material holding container 4 is performed at the intermediate position in the lengthwise direction (Z axis direction) of the front wall 42, it is possible to equally suppress the positional skew of both end parts of the lengthwise direction. Thus, it is possible to do alignment of the printing material holding container 4 to the printing material holding container mounting unit 6 with good precision and with good efficiency.

Also, there is a liquid injection port 122 that opens to the other surfaces excluding the front wall 42 (first side wall 43, back wall 47 and the like) at one end, and the other end is equipped with a liquid injection flow path 120 that is connected to the liquid holding portion 84, so when the ink held in the liquid holding portion 84 is consumed and runs out, it is possible to supply ink (fill) to the liquid holding portion 84. Therefore, it is possible to use this repeatedly without replacing the printing material holding container 4.

Also, the external liquid holding portion 124 arranged outside the case 40 is connected to the liquid injection port 122, and the liquid holding portion 84 and the external liquid holding portion 124 are an integrated unit and constitute a sealed type liquid holding portion, so as the ink held in the liquid holding portion 84 and the external liquid holding portion 124 is used, the interiors of these undergo reduced pressure, so it is possible to send ink to the printer 10 side. Also, when the ink is used and runs out, by replacing the external liquid holding portion 124, it is possible to use this repeatedly without replacing the printing material holding container 4 (liquid holding portion 84).

Also, with this embodiment, the rod shaped member 92 used to detect ink end also functions as the member for performing alignment of the printing material holding container 4 to the printing material holding container mounting unit 6. Thus, the liquid consuming system 1 does not have to be newly equipped with a member for alignment. By doing this, it is possible to reduce the number of parts of the liquid consuming system 1. Also, alignment of the printing material holding container 4 to the printing material holding container mounting unit 6 is performed using the rod shaped member 92 used for detecting ink end, so it is not necessary to provide a separate member for alignment, thus making it possible to reduce the number of parts, so it is possible to make the printing material holding container 4 more compact. Also, the printer 10 on which the printing material holding container 4 is mounted can also be made more compact.

Also, with this embodiment, the case 40 is equipped with an alignment member 40A and a protective member 40B. The liquid holding portion 84 is held in the protective member 40B. Also, the first insertion hole 440 and the second insertion hole 420 in which the member provided in the printing material holding container mounting unit 6 is inserted are provided on the alignment member 40A. Here, the protective member 40B has an overall weight greater than the alignment member 40A side. When the first side wall 43 of the case 40 is formed continuously from the front wall 42 side (−Y axis direction front end side) to the back wall 47 side (+Y axis direction front end side), there is the possibility of the overall printing material holding container tilting such that the back wall 47 side drops more than the front wall 42 side. In contrast to this, if the protective member 40B that holds the liquid holding portion 84 is made such that the alignment member 40A and the protective member 40B are separate members, it is possible to constitute this such that the protective member 40B can move slightly in relation to the alignment member 40A by the clearance amount between the alignment member 40A and the protective member 40B. Even if the weight of the liquid holding portion 84 is great, the tilt is only the part of the protective member 40B, and it is possible to keep the correct position of the alignment member 40A without tilting. By doing this, in the mounted state, it is possible to reduce the possibility of skewing from the correct position designed for the position of the first insertion hole 440 and the second insertion hole 420 provided on the alignment member 40A in relation to the printing material holding container mounting unit 6.

Also, with this embodiment, the printing material holding container side terminal group 521 is provided on the alignment member 40A for which the possibility of skewing from the correct position has been reduced. By doing this, it is possible to have stable electrical connection between the printing material holding container side terminal group 521 and the device side terminal group 721.

B. Modification Examples:

Above, we described an embodiment of the invention, but the invention is not limited to this kind of embodiment, and it is possible to use various constitutions within a range that does not stray from its gist. The following kinds of modifications are possible, for example. The modification examples below are all based on the embodiments noted above, so for the effects and modification examples described with the embodiments noted above, the same also applies for the modification examples noted below. Also, an explanation is omitted for parts that are in common with the embodiments noted above. Also, the same code number is used for elements in common with the embodiments noted above.

B-1. First Modification Example

Figure 35:
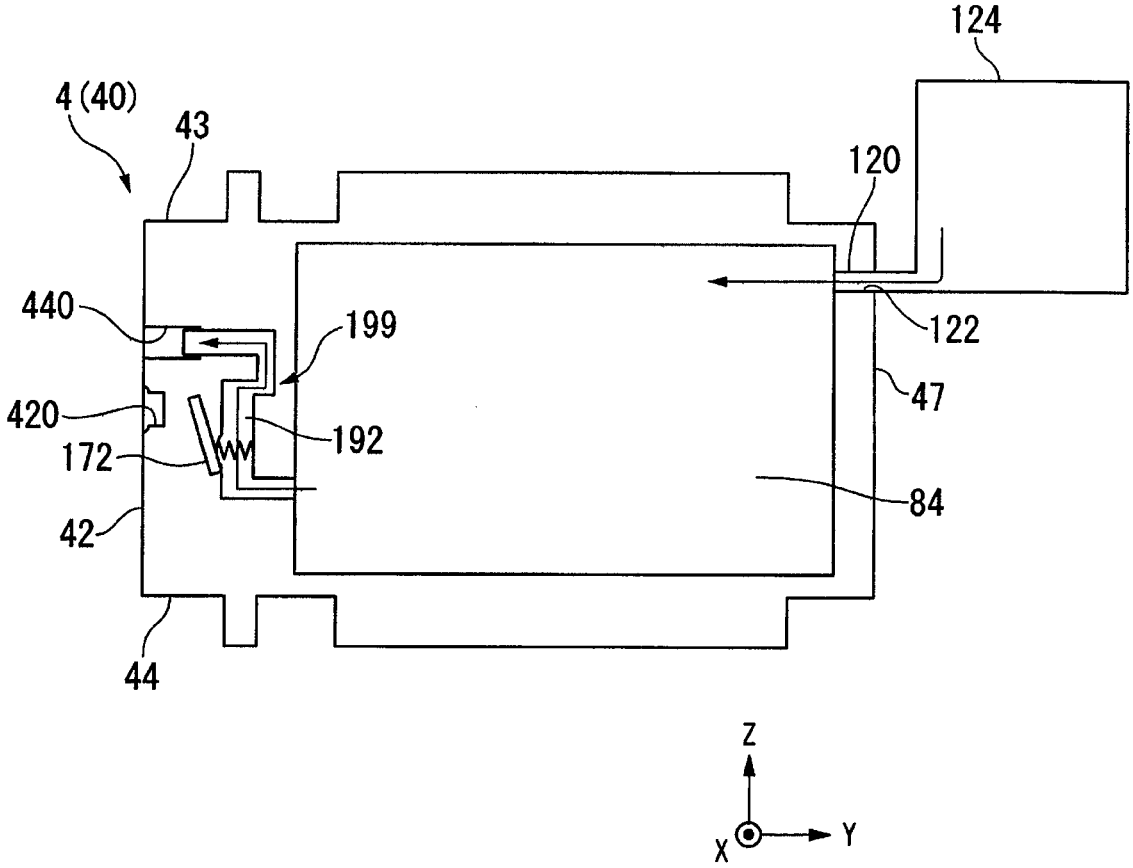
FIG. 35 is a cross section view showing the schematic structure of the printing material holding container 4.
Figure 36:
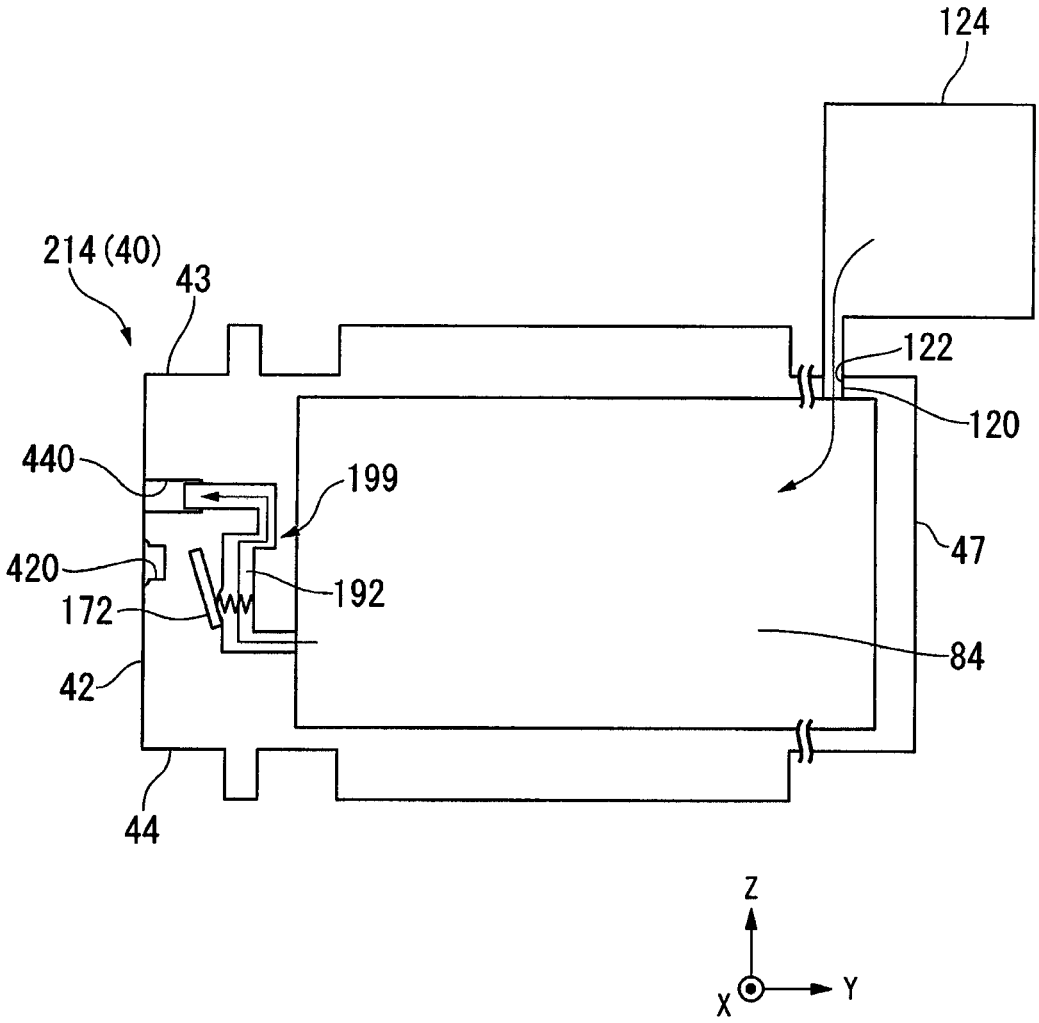
FIG. 36 is a cross section view showing the schematic structure of the printing material holding container 214 of the first modification example.

FIG. 35 is a cross section view showing the schematic structure of the printing material holding container 4. FIG. 36 is a cross section view showing the schematic structure of the printing material holding container 214 of the first modification example. With the printing material holding container 4, the Y axis direction length is almost the same as the depth of the printing material holding container holding chamber 61. Also, the liquid injection port 122 opens at the back wall 47 of the printing material holding container 4. In contrast to this, with the printing material holding container 214 of the first modification example, the Y axis direction length is sufficiently longer than the depth of the printing material holding container holding chamber 61. Because of this, the back wall 47 of the printing material holding container 214 is in a state standing out to the outside from the printing material holding container holding chamber 61. Then, of the first side wall 43 of the printing material holding container 214, the liquid injection port 122 opens to the area standing out to the outside from the printing material holding container holding chamber 61. Because of this, the external liquid holding portion 124 is arranged in the +Z axis direction of the printing material holding container 214 (liquid holding portion 84). The liquid holding portion 84 and the external liquid holding portion 124 constitute the sealed type liquid holding portion. Also, the liquid injection port 122 can form the surfaces other than the front wall 42. Also, the arrangement of the external liquid holding portion 124 can be set freely. Therefore, supplying of ink (filling) is easy. Also, with the printing material holding container 214 of the first modification example as well, it is possible to obtain the same effects as the printing material holding container 4.

Figure 37:
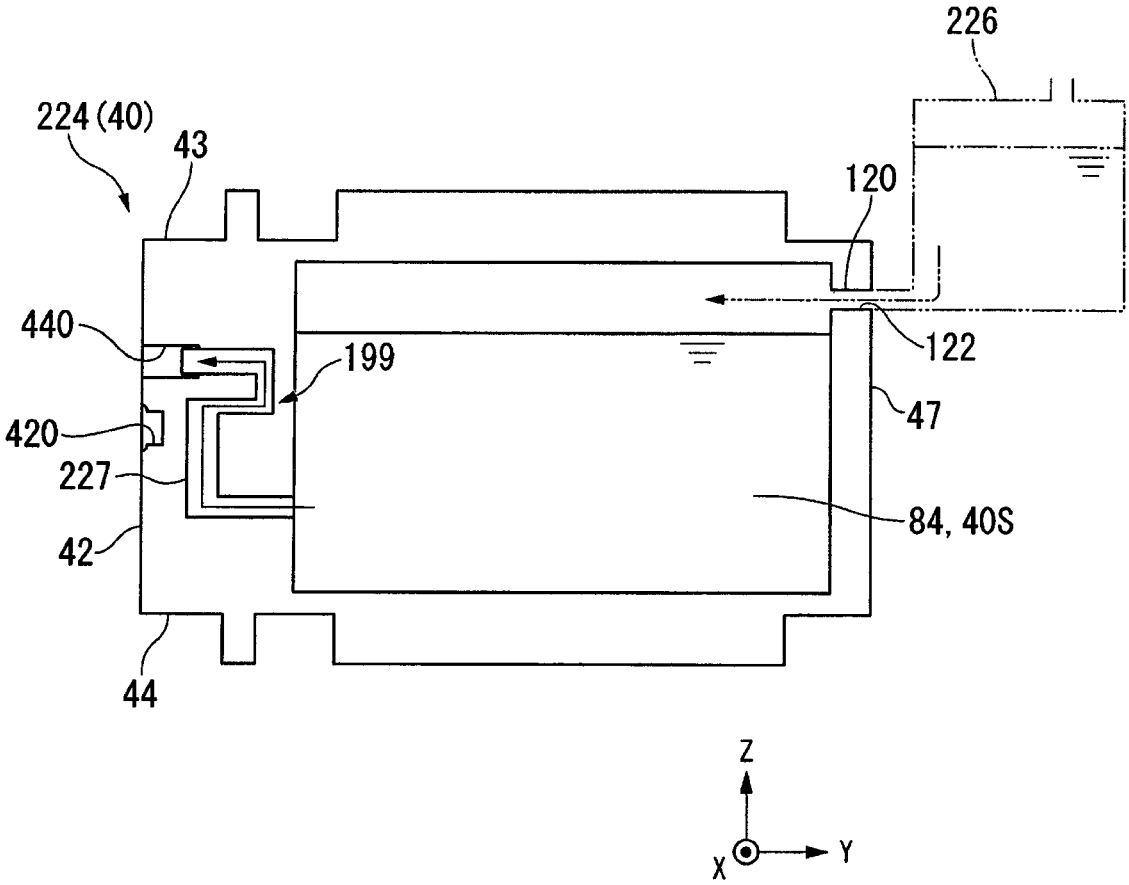
FIG. 37 is a cross section view showing the schematic structure of the printing material holding container 224 of the second modification example.

B-2. Second Modification Example:

FIG. 37 is a cross section view showing the schematic structure of the printing material holding container 224 of the second modification example. The printing material holding container 224 has the same external shape as the printing material holding container 4, and the liquid injection port 122 opens at the back wall 47. The external liquid holding portion 124 is linked to the liquid injection port 122, and a plug is not installed. In other words, it is possible for atmosphere (air) to flow into the interior of the liquid holding portion 84 via the liquid injection port 122. The liquid holding portion 84 is an open air type liquid holding portion. The Y axis direction length of the printing material holding container 224, the same as with the printing material holding container 214 of the first modification example, can be sufficiently longer than the depth of the printing material holding container holding chamber 61. In this case, of the first side wall 43 of the printing material holding container 224, the liquid injection port 122 opens at the area standing out to the outside from the printing material holding container holding chamber 61. It is also acceptable to connect a funnel or the like to inject ink into the liquid injection port 122. Also, an external liquid holding portion 226 can be connected to the liquid injection port 122. An opening for introducing air to the interior is provided on the external liquid holding portion 226. In other words, the printing material holding container 224 can be open to the air directly or indirectly via the liquid injection port 122.

As shown in FIG. 37, with the printing material holding container 224, in contrast to the printing material holding container 4, the film 174, the pressure plate 176, and the spring 179 and the like (FIG. 11) are not provided in the internal flow path 199 of the member for attachment 190. Also, the moving member 172, the contact part 185 and the like (FIG. 11) are not provided. With the printing material holding container 224, instead of the moving member 172, a hard abutting surface 227 is provided. The abutting surface 227 is formed with the moving member 172 in a state leaning to the rod shaped member 92 side (FIG. 16) and facing the rod shaped member 92 side at almost the same position. Because of this, when the other end part 92*b* of the rod shaped member 92 abuts the abutting surface 227, the rod shaped member 92 moves to the inward side (−Y axis direction side) of the printing material holding container mounting unit 6 (−Y axis direction side). As a result, the light shielding unit 91 of the rod shaped member 92 separates from the sensor 138, so the sensor 138 is in a state with light transmitted. In this way, the sensor 138 is able to detect that the printing material holding container 4 is mounted on the printing material holding container mounting unit 6 based on changing from the light blocked state to the transmitted state by movement of the light shielding unit 91 of the rod shaped member 92. With the printing material holding container 224, in contrast to the printing material holding container 4, this state is maintained even if the ink within the liquid holding portion 84 has run out or the remainder is low. In this state, as long as there is no other abnormality within the printing material holding container 4 or the printer 10, the printer 10 is controlled so as to be able to print.

Also, with the printing material holding container 224, it is possible to hold the ink directly in the internal space 40S formed on the interior of the case 40 (protective member 40B) without using the liquid holding container 84. In other words, the internal space 40S becomes the liquid holding portion. Since it is not necessary to use the bag shaped liquid holding portion 84 formed by the aluminum laminate multi-layer film, it is possible to reduce the manufacturing cost of the printing material holding container 224.

With the printing material holding container 224 of the second modification example as well, it is possible to obtain the same effects as the printing material holding container 4 and the like. Also, when the ink is used and runs out, it is possible to reuse the liquid holding portion 84 or the internal space 40S after filling with ink. In other words, when the ink is used and runs out, ink is injected from the liquid injection port 122, and ink is filled in the liquid holding portion 84 or the liquid injection port 122. It is possible to use repeatedly the printing material holding container 224 without replacing it, so it is possible to reduce the running cost of the printer 10. When using the external liquid holding portion 226, it is possible to newly replace the external liquid holding portion 226, or to fill ink from the opening of the external liquid holding portion 226.

Figure 38:
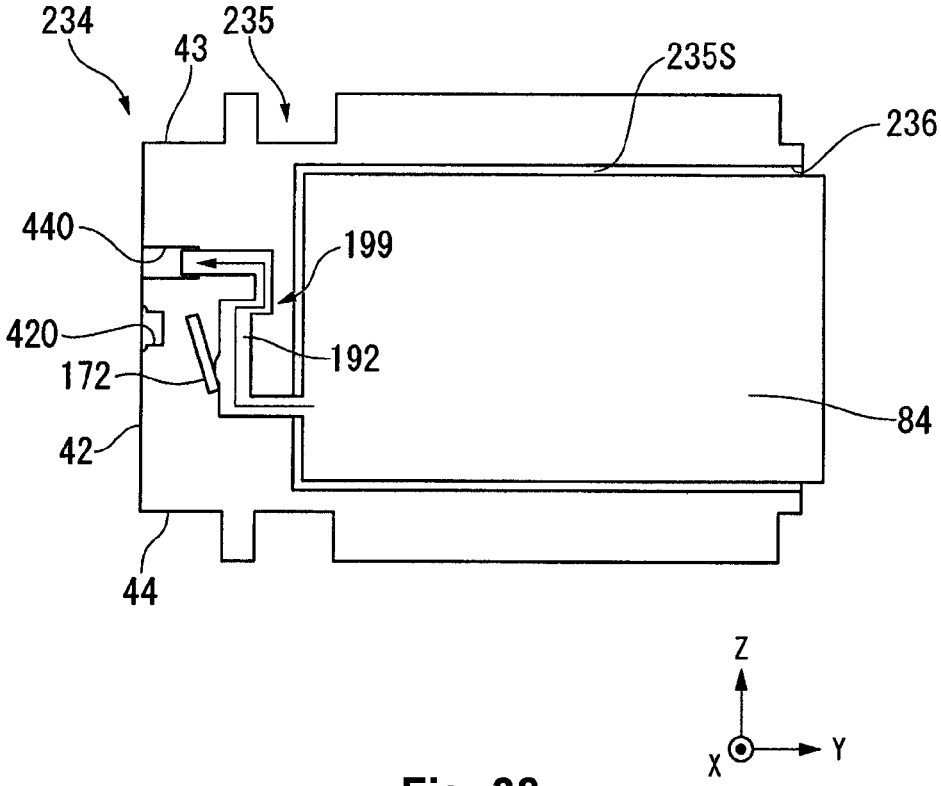
FIG. 38 is a cross section view showing the schematic structure of the printing material holding container 234 of the third modification example.

B-3. Third Modification Example:

FIG. 38 is a cross section view showing the schematic structure of the printing material holding container 234 of the third modification example. The printing material holding container 234, the same as with the printing material holding container 4 and 214, has a sealed type liquid holding portion (liquid holding portion 84). The external shape of the printing material holding container 234 is almost the same as the printing material holding container 4 and 214. The printing material holding container 234 uses an adapter 235 instead of the case 40. The adapter 235 has the equivalent function to the alignment member 40A of the printing material holding container 4. In contrast to the case 40, the adapter 235 has the opening 236 formed without the existence of the back wall 47. In other words, though the adapter 235 holds the liquid holding portion 84 in the internal space 235S, the liquid holding portion 84 is exposed to the +Y axis direction side via the opening 236. Also, the liquid holding portion 84 is detachable in relation to the adapter 235.

With the printing material holding container 234 of the third modification example as well, it is possible to obtain the same effects as the printing material holding container 4 and the like. Also, after the adapter 235 is mounted in the printing material holding container 6 (printing material holding container holding chamber 61), even if the ink is used and runs out, it is possible to use this repeatedly without removing it from the printing material holding container mounting unit 6. When the ink is used and runs out, the liquid holding portion 84 is replaced. In other words, the liquid holding portion 84 for which the ink has run out is removed from the adapter 235, and a new liquid holding portion 84 filled with ink is mounted in the adapter 235. It is not necessary to prepare the case 40 individually, so it is possible to reduce the manufacturing cost of the printing material holding container 234. The shape of the adapter 235 is not limited to being the shape shown in FIG. 38. It can also have a shape correlating to the alignment member 40A.

Figure 39:
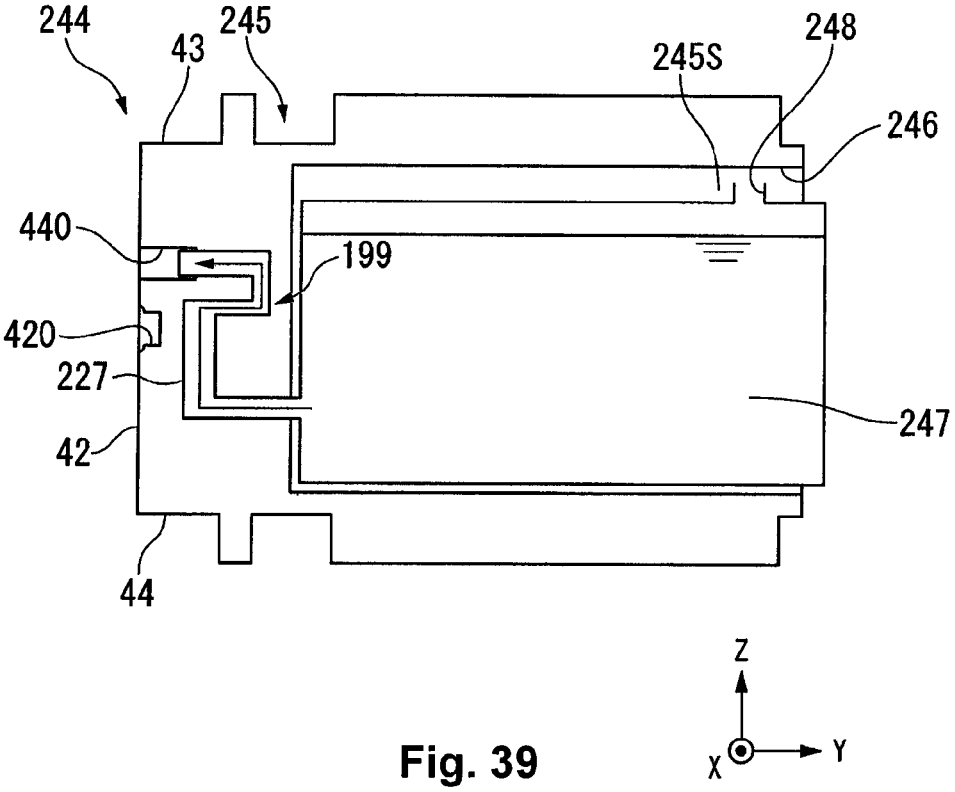
FIG. 39 is a cross section view showing the schematic structure of the printing material holding container 244 of the fourth modification example.

B-4. Fourth Modification Example:

FIG. 39 is a cross section view showing the schematic structure of the printing material holding container 244 of the fourth modification example. The printing material holding container 244, the same as the printing material holding container 224, has an open air type liquid holding portion (liquid holding portion 225). The external shape of the printing material holding container 244 is almost the same as that of the printing material holding container 224. The printing material holding container 244, the same as the printing material holding container 234, uses the adapter 245 instead of the case 40. The adapter 245 has the equivalent function to the alignment member 40A of the printing material holding container 224. In other words, the adapter 245 does not have the film 174, the pressure plate 176, the spring 179 and the like (FIG. 11) provided on the internal flow path 199 of the member for attachment 190. Also, the moving member 172, the contact part 185 and the like (FIG. 11) are not provided. With the printing material holding container 244, instead of the moving member 172, the hard abutting surface 227 is provided (see FIG. 37). The adapter 245 has the opening 246 formed without the existence of the back wall 47. The liquid holding portion 247 for which an air release port 248 is formed on the top surface is held in the internal space 245S of the adapter 245. The liquid holding portion 247 is detachable to the adapter 245.

With the printing material holding container 244 of the fourth modification example as well, it is possible to obtain the same effects as with the printing material holding container 4 and the like. Also, after the adapter 245 is mounted in the printing material holding container mounting unit 6 (printing material holding container holding chamber 61), even when the ink is used and runs out, it is possible to use it repeatedly without having to remove it from the printing material holding container mounting unit 6. When the ink is used and runs out, the liquid holding portion 247 is replaced. In other words, the liquid holding portion 247 for which the ink has run out is removed from the adapter 245, and the new liquid holding portion 247 in which ink is held is mounted in the adapter 245. It is not necessary to prepare the case 40 individually, so it is possible to reduce the manufacturing cost of the printing material holding container 234. It is also possible to reuse by filling the liquid holding portion 247 with ink without replacing the liquid holding portion 247. In other words, when the ink is used and runs out, the liquid holding portion 247 is removed from the adapter 245, and is mounted in the adapter 245 again after being filled with ink from the air release port 248. The printing material holding container 244 can be repeatedly used without replacing it, so it is possible to reduce the running cost of the printer 10. The Y axis direction length of the liquid holding portion 247 is sufficiently long, and it is possible to have a state with the +Y axis direction side of the liquid holding portion 247 standing out to the outside from the printing material holding container holding chamber 61. In this case, it is possible to fill ink from the air release port 248 exposed to the exterior. Therefore, it is possible to use repeatedly without replacing the printing material holding container 244, so it is possible to reduce the running cost of the printer 10.

B-5. Fifth Modification Example:

With the modification example shown in FIG. 35 or FIG. 36, the liquid holding chamber 192 (third liquid holding portion), the liquid holding portion 84 (first liquid holding portion), and the external liquid holding portion (second liquid holding portion) are connected in a sealed manner, and the deformation unit including the film 174 of the liquid holding chamber 192 (third liquid holding portion), or the film 174 and the spring 179, or the film 174, the spring 179, and the pressure plate 176, can be constituted to deform by pressure greater than the pressure by which each of the liquid holding portion 84 (first liquid holding portion) and the external liquid holding portion 124 (second liquid holding portion) is deformed. In this case, when the liquid residual volume within the external liquid holding portion 124 and the liquid holding portion 84 has decreased sufficiently, the external liquid holding portion 124 and the liquid holding portion 84 are deformed into a crushed state before the liquid holding chamber 192 is deformed in such a state that the film 174 is drawn into the inside. Therefore, it is possible to detect the state when the liquid residual volume has decreased sufficiently for the liquid holding portion 84 (first liquid holding portion) and the external liquid holding portion 124 (second liquid holding portion). With this modification example, when the deformation unit of the liquid holding chamber 192 (third liquid holding portion) includes the spring 179 (biasing member), the spring 179 biases the film 174 in the direction that expands the interior of the liquid holding chamber 192. With this constitution, the spring 179 biases the film 174 which is a part of the wall constituting the liquid holding chamber 192 in the direction that expands the interior of the liquid holding chamber 192, so when the liquid residual volume within the external liquid holding portion 124 and the liquid holding portion 84 has decreased sufficiently, the external liquid holding portion 124 and the liquid holding portion 84 have been deformed and in a crushed state before the liquid holding chamber 192 is deformed in such a state that the film 174 is drawn into the inside. Therefore, it is possible to detect a sufficiently reduced state of the liquid residual volume of the liquid holding portion 84 (first liquid holding portion) and the external liquid holding portion (second liquid holding portion).

B-6. Sixth Modification Example:

With the modification example shown in FIG. 35 or FIG. 36, it is also possible to have a constitution such that the liquid holding portion 84 is deformed using a pressure that is equivalent to or greater than the pressure by which the external liquid holding portion 124 is deformed. With this constitution, the external liquid holding portion 124 connected to the liquid holding portion 84 goes to a crushed state at the same time or earlier than the liquid holding portion 84, so it is easier for the liquid residual volume of the external liquid holding portion 124 to decrease than the residual liquid volume of the liquid holding portion 84, and because the liquid holding portion 84 connected to the liquid holding chamber 192 undergoing detection has the liquid residual volume decrease later than the external liquid holding portion 124, it is possible to detect the sufficiently reduced state of the liquid holding portion 84 and the external liquid holding portion 124.

B-7. Seventh Modification Example:

With the modification example shown in FIG. 35 or FIG. 36, the external liquid holding portion 124 is acceptable as a bag constituted using a flexible material. With this constitution, since the external liquid holding portion 124 is a bag constituted using a flexible material, it is easy to create a sealed structure, and easy to deform along with liquid consumption, so it is possible to more reliably detect the sufficiently reduced state of the liquid residual volume.

B-8. Eighth Modification Example:

With the modification example shown in FIG. 35 or FIG. 36, the liquid holding chamber 192 is at least partially covered by the case 40, and when the liquid supply port 194 (correlating to the "liquid outlet portion" in the Means for Solving the Problems) is connected to the liquid supply needle 82 provided in the printer 10 (correlating to the "liquid jet device" in the Means for Solving the Problems) side, the case 40 can be equipped with the printing material holding container side terminal group 521 (correlating to the "liquid holding portion side electrical connection part" in the Means for Solving the Problems) that can be in contact with the device side terminal unit 70 (correlating to the "main unit side electrical connection part" in the Means for Solving the Problems) provided on the printer 10 side. With this constitution, the case 40 that covers at least a portion of the liquid holding chamber 192 is equipped with the printing material holding container side terminal group 521, so it becomes possible to communicate electrical signals with the device side terminal group 721 of the device side terminal unit 70.

B-9. Ninth Modification Example:

The invention is not limited to the inkjet printer and its ink printing material holding container, and it can also be applied to any printing device that ejects liquid other than ink and its liquid holding container. For example, it can be applied to the following types of printing devices and their liquid holding containers. (1) Image recording devices such as fax machines and the like, (2) Printing devices for jetting color material used for manufacturing color filters for image display devices such as liquid crystal displays or the like, (3) Printing devices that eject electrode material used for forming electrodes of organic EL (Electro Luminescence) displays, surface emitting displays (Field Emission Display, FED) or the like, (4) Printing devices for ejecting liquid containing bioorganic substances used for manufacturing biochips, (5) Sample printing devices as precision pipettes, (6) Printing devices for lubricating oil, (7) Printing devices for resin liquid, (8) Printing devices for ejecting lubricating oil at a pinpoint on a precision device such as a clock, camera or the like, (9) Printing devices for ejecting a transparent resin liquid such as an ultraviolet ray curing resin liquid or the like on a substrate to form micro hemispherical lenses (optical lenses) used for optical communication devices or the like, (10) Printing devices for ejecting acidic or alkaline etching fluid to etch a substrate or the like, and (11) Printing devices equipped with a liquid jet head that discharges any other tiny volumes of droplets Note that the term "droplet" means a state of liquid ejected from the aforementioned liquid jetting device, and can be a granular shape, a teardrop shape, or a tailing shape. The term "liquid" represents any material that can be jetted from the liquid jetting device. The liquid can be any of liquid-phase materials including liquids of high viscosity and liquids of low viscosity, sols, gel water, various inorganic solvents, various organic solvents, solutions, liquid resins, and liquid metals (fused metals). It is not limited to just liquids as a single state substance, but can also include the particles of functional solid materials, such as colorant particles or metal particles, dissolved, dispersed, or mixed in a solvent. Typical examples of the liquid include ink described in the above embodiments and liquid crystal. Here, the "ink" includes aqueous inks, oil inks, gel inks, hot-melt inks, and other various liquid compositions.

What is claimed is:

1. A printing material holding container for mounting detachably on a printing material holding container mounting unit that comprises a printing material supply tube fixed to a device side front wall part, and having a central axis extending in a designated direction, a rod shaped member having an axis parallel to the central axis, that is movable along the axis direction, provided on the device side front wall part, and a sensor for detecting displacement of the rod shaped member, the printing material holding container comprising:

a case for which when three mutually orthogonal spatial axes are the X axis, the Y axis, and the Z axis, the directions along the X axis, the Y axis and the Z axis are the X axis direction, the Y axis direction, and the Z axis direction, the direction for which the printing material holding container is inserted in the printing material holding container mounting unit is the −Y axis direction, and the direction for which the printing material holding container is removed from the printing material holding container mounting unit is the +Y axis direction, the case comprises:

two surfaces facing opposite in the Y axis direction, being a front surface positioned at the −Y axis direction side, and roughly rectangular in shape with the Z axis direction dimension larger than the X axis direction dimension, and a back surface positioned at the +Y axis direction side, two surfaces that intersect with the front surface and the back surface and face opposite in the Z axis direction, being a first side surface positioned at the +Z axis direction side, and a second side surface positioned at the −Z axis direction side, and two surfaces that intersect with the front surface, the back surface, the first side surface, and the second side surface, facing opposite in the X axis direction, being a third side surface positioned at the +X axis direction side, and a fourth side surface positioned at the −X axis direction side, a printing material holding portion provided inside the case, a first insertion hole provided on the front surface, for which a printing material supply port in which the printing material supply tube is inserted is arranged in the interior, and also in which the printing material supply tube is inserted, a second insertion hole provided on the front surface in which the rod shaped member is inserted, a printing material flow path having the printing material supply port at one end, and for which the other end is connected to the printing material holding portion, and a printing material injection flow path having a printing material injection port that opens to another surface excluding the front surface at one end, and for which the other end is connected to the printing material holding portion, wherein of the front surface, the second insertion hole is provided at an intermediate position between the first side surface and the second side surface.

2. The printing material holding container according to claim 1, wherein an external printing material holding portion arranged outside the case is connected to the printing material injection port, and the printing material holding portion and the external printing material holding portion are an integrated unit and constitute a sealed type liquid holding portion.

3. The printing material holding container according to claim 2, comprising:

a detection chamber provided midway in the printing material flow path, for which the capacity changes according to changes in the internal pressure, and a lever member which abuts the tip of the rod shaped member, and moves the rod along the axis direction by displacing it according to changes in the capacity of the detection chamber.

4. The printing material holding container according to claim 1, wherein the printing material holding portion is an open type liquid holding portion open to the air via the printing material injection port.

5. The printing material holding container according to claim 4, further comprising an abutting part that abuts the tip of the rod shaped member when mounted on the printing material holding container mounting unit and moves the rod shaped member along the axis direction.

6. The printing material holding container according to claim 4, wherein the printing material holding portion is an internal space formed inside the case.

7. The printing material holding container according to claim 1, wherein the case comprises:

a protective container having an opening at the −Y axis direction side, for which the printing material holding portion is held or formed inside, and a cap provided at the −Y axis direction side, attached to the protective container so as to close the opening of the protective container, wherein the first insertion hole and the second insertion hole are provided on the cap.

8. The printing material holding container according to claim 7, further comprising:

a printing material holding container side terminal group that, in the mounted state, contacts the device side terminal group provided on the printing material holding container device unit, wherein the printing material holding container side terminal group is provided on the cap.

9. A printing material holding container for mounting detachably on a printing material holding container mounting that comprises a printing material supply tube fixed to a device side front wall part, and having a central axis extending in a designated direction, a rod shaped member having an axis parallel to the central axis, that is movable along the axis direction, provided on the device side front wall part, and a sensor for detecting displacement of the rod shaped member, comprising:

an adapter for which when three mutually orthogonal spatial axes are the X axis, the Y axis, and the Z axis, the directions along the X axis, the Y axis and the Z axis are the X axis direction, the Y axis direction, and the Z axis direction, the direction for which the printing material holding container is inserted in the printing material holding container mounting unit is the −Y axis direction, and the direction for which the printing material holding container is removed from the printing material holding container mounting unit is the +Y axis direction, the adapter comprising:

two surfaces facing opposite in the Y axis direction, being a front surface positioned at the −Y axis direction side, and roughly rectangular in shape with the Z axis direction dimension larger than the X axis direction dimension, and a back surface positioned at the +Y axis direction side, two surfaces that intersect with the front surface and the back surface and face opposite in the Z axis direction, being a first side surface positioned at the +Z axis direction side, and a second side surface positioned at the −Z axis direction side, and two surfaces that intersect with the front surface, the back surface, the first side surface, and the second side surface, facing opposite in the X axis direction, being a third side surface positioned at the +X axis direction side, and a fourth side surface positioned at the −X axis direction side, a printing material holding portion detachable on the back surface, a first insertion hole provided on the front surface, for which a printing material supply port in which the printing material supply tube is inserted is arranged in the interior, and also in which the printing material supply tube is inserted, a second insertion hole provided on the front surface in which the rod shaped member is inserted, and a printing material flow path provided inside the adapter, having the printing material supply port at one end, and for which the other end is connected to the printing material holding portion, wherein of the front surface, the second insertion hole is provided at an intermediate position between the first side surface and the second side surface.

10. The printing material holding container according to claim 9, wherein the printing material holding portion is a sealed type liquid holding portion.

11. The printing material holding container according to claim 10, comprising a detection chamber provided midway in the printing material flow path, for which the capacity changes according to changes in the internal pressure, and a lever member which abuts the tip of the rod shaped member, and moves the rod along the axis direction by displacing it according to changes in the capacity of the detection chamber.

12. The printing material holding container according to claim 9, wherein the printing material holding portion is an open type liquid holding portion having an air introduction opening.

13. The printing material holding container according to claim 12, further comprising an abutting part that abuts the tip of the rod shaped member when mounted on the printing material holding container mounting unit and moves the rod shaped member along the axis direction.

14. The printing material holding container according to claim 9, comprising a printing material holding container side terminal group that, in the mounted state, contacts the device side terminal group provided on the printing material holding container device unit, wherein the printing material holding container side terminal group is provided on the adapter.

15. A liquid supply system for supplying liquid to a liquid jet device, the liquid supply system comprising:

a sealed first liquid holding portion for holding liquid that can deform together with consumption of liquid, a sealed second liquid holding portion for holding liquid that can deform with consumption of liquid, connected in a sealed manner to the first liquid holding portion, and a third liquid holding portion provided with a liquid outlet portion connectable to the liquid jet device, connected in a sealed manner to the first liquid holding portion, having a deformation unit that is deformable by pressure greater than pressure at which each of the first liquid holding portion and the second liquid holding portion deforms, and by which the liquid consumption state is detected by deformation of the deformation unit.

16. The liquid supply system according to claim 15, wherein the deformation unit of the third liquid holding portion comprises a deformation member having flexibility, and a biasing member for biasing the deformation member in the direction that expands the inside of the third liquid holding portion.

17. The liquid supply system according to claim 15, wherein the first liquid holding portion is deformed by the equivalent pressure to that by which the second liquid holding portion is deformed, or by a pressure greater than the pressure by which the second liquid holding portion is deformed.

18. The liquid supply system according to claim 15, wherein the second liquid holding portion is a bag portion constituted using a flexible material.

19. The liquid supply system according to claim 15, wherein the third liquid holding portion has at least a portion covered by a case, and the case comprises a liquid holding portion side electrical connection part that can contact a main unit side electrical connection part provided in the liquid jet device when the liquid outlet portion is connected to the liquid jet device.

* * * * *